US005578437A

United States Patent [19]

Asami et al.

[11] Patent Number: 5,578,437

[45] Date of Patent: Nov. 26, 1996

[54] COLOR PHOTOGRAPHIC LIGHT-SENSITIVE MATERIAL

[75] Inventors: Masahiro Asami; Hiroyuki Yoneyama, both of Kanagawa, Japan

[73] Assignee: Fuji Photo Film Co., Ltd., Minami Ashigara, Japan

[21] Appl. No.: 437,370

[22] Filed: May 9, 1995

[30] Foreign Application Priority Data

May 11, 1994 [JP] Japan ..... 6-120763
Oct. 3, 1994 [JP] Japan ..... 6-260925

[51] Int. Cl.[6] ..... G03C 1/08; G03C 7/26; G03C 7/32

[52] U.S. Cl. ..... 430/558; 430/503; 430/543; 430/546; 430/567; 430/631

[58] Field of Search ..... 430/503, 505, 430/543, 546, 558, 567, 631

[56] References Cited

U.S. PATENT DOCUMENTS

| | | | |
|---|---|---|---|
| 4,882,266 | 11/1989 | Kawagishi et al. | 430/546 |
| 5,256,526 | 10/1993 | Suzuki et al. | 430/558 |
| 5,270,153 | 12/1993 | Suzuki et al. | 430/558 |
| 5,350,665 | 9/1994 | Hasebe | 430/503 |

FOREIGN PATENT DOCUMENTS

| | | |
|---|---|---|
| 0571959A2 | 12/1993 | European Pat. Off. . |
| 2296241 | 12/1990 | Japan . |

*Primary Examiner*—Geraldine Letscher
*Attorney, Agent, or Firm*—Burns, Doane, Swecker & Mathis, LLP

[57] ABSTRACT

A silver halide color photographic light-sensitive material comprising a support having provided thereon photographic constituent layers comprising at least a yellow dye-forming silver halide emulsion layer, a magenta dye-forming silver halide emulsion layer and a cyan dye-forming silver halide emulsion layer. The total silver coverage in said silver halide emulsion layers is 0.6 g/m$^2$ or less. The magenta dye-forming silver halide emulsion layer contains silver halide emulsion grains comprising silver chloride or silver chlorobromide substantially free of silver iodide having a silver chloride content of 90 mol % or more, at least one magenta dye-forming coupler represented by formula (M-I):

(M-I)

and the total coating amount of oil-soluble components contained in photographic constituent layers above the silver halide emulsion layer nearest to the support is 3.5 g/m$^2$ or less.

10 Claims, No Drawings

COLOR PHOTOGRAPHIC LIGHT-SENSITIVE MATERIAL

FIELD OF THE INVENTION

The present invention relates to a color photographic light-sensitive material and a color image formation method using the same material, more specifically, to a color photographic light-sensitive material and a color image formation method capable of rapid processing and providing prints having excellent storage stability of a dye image and a white background.

BACKGROUND OF THE INVENTION

In the field of color photographs widely popularized today, particularly, color prints, the production is carried out in a centralized processing system at a production base called a color lab. where a high speed printer for mass production or a large-sized processing equipment is installed or in a distributed processing system using a small-sized printer processor called a mini lab. installed in a shop.

The techniques in either of these print production systems have been recently developed while giving priority to the viewpoint that "how rapidly prints can be produced".

In particular, as a result of practical utilization of a light-sensitive material for printing using a high silver chloride emulsion and an image formation method using the material, the processing steps conducted on the market predominantly take 4 minutes or less for the time from the entering of a color printing paper into a processing solution after exposure to the completion of development followed by drying, namely, for a so-called dry-to-dry time.

However, the demand for more and more rapid processing goes ahead of the advancement in such a technique and is highly intensified. One of the reasons therefor is the appearance of various systems able to form a full color image. More specifically, in addition to a so-called conventional silver salt photographic system for obtaining a color image comprising exposing and then developing a photographic light-sensitive material using such silver halide as described above, a great number of image formation systems such as a heat development system or a heat-sensitive transfer system have been recently proposed. These systems are characterized in that the wet development which is a bottleneck in the application of silver salt photographic system is not required. Accordingly, in order to achieve further development of the silver salt photographic system to cope with these systems, the realization of more rapid and simple development processing is an important theme.

On the other hand, when considered the above-described concurrence, in parallel to the improvement in simplicity and rapidity of processing, it is also of course important to maintain and improve fastness of a dye image which is an advantage of the conventional silver salt photographic system without losing even under such processing conditions.

A light-sensitive material for color printing (color printing paper) usually comprises light-sensitive emulsion layers sensitive to blue, green and red lights lying in three different wavelength regions and each emulsion layer is constructed so that a dye in a complementary relation to the light to which the layer is sensitive, namely, a yellow dye in the blue-sensitive emulsion layer, a magenta dye in the green-sensitive emulsion and a cyan dye in the red-sensitive emulsion layer, can be formed. Each layer contains a combination of a silver halide emulsion as a light-sensitive element spectrally sensitized to a desired wavelength region and a color coupler as a dye-forming agent. The color coupler makes a coupling reaction with an oxidation product of a developing agent formed during development of an exposed silver halide emulsion to form a dye image. Accordingly, a great number of techniques have been proposed on the color coupler so as to improve fastness of a dye image. However, the current techniques have not yet reached a sufficient level to achieve a rapid and at the same time simple development processing.

One of the techniques for realizing a rapid processing is a technique where a high silver chloride emulsion is used to increase the development speed of silver halide to thereby achieve a rapid processing.

From the viewpoints other than this, a large number of techniques have been reported to attain reduction in the development time of a silver halide photographic light-sensitive material.

For example, JP-A-63-38937 (the term "JP-A" as used herein means an "unexamined published Japanese patent application") discloses a technique for controlling the swelled film thickness of a light-sensitive material or a coating amount of gelatin by means of a processing solution.

Also, JP-A-3-109549 discloses a technique for suppressing the alkali consumption in emulsion layers constituting the light-sensitive material to achieve a rapid development.

Further, JP-A-4-443 describes that a dye image having superior fastness and a super high speed processing at a low replenishing rate for the developer can be realized by processing a light-sensitive material containing a high silver chloride silver halide emulsion with a color developer containing a hydroxyalkyl-substituted p-phenylenediamine derivative of a specific structure as a color developing agent.

However, these methods can hardly achieve a rapid processing and at the same time high fastness of a dye image to light or heat. In other words, the light-sensitive material produced according to conventional techniques may be able to be processed rapidly and simply, but the fatness of a dye image obtained, in particular, a magenta dye image, is readily impaired and further, the white background after a long-term storage of processed prints is easily deteriorated, which is a problem.

It is known to improve the fatness of a dye image by bettering a dye-forming coupler used. For example, JP-A-1-302249 presents the use of a magenta coupler having a branched alkyl group as a substituent in the pyrazolotriazole ring to improve the light or heat fastness of the resulting magenta dye image, however, the effect is not sufficient when applied a rapid processing requiring a short processing time and using the above-described high silver chloride emulsion and the technique is not suitable for a further rapid processing. Also, the magenta coupler described in the patent publication above is broad in color hue of the resulting dye and has a problem to be solved in view of reproduction of a highly pure color.

EP 0571959 discloses that the use of a 1H-pyrazolo-[1,5-b][1,2,4]triazole magenta coupler having, in the pyrazolotriazole ring, a tertiary alkyl group at the 6-position and an amido group-substituted phenyl group at the 2-position brings about a small change in color density even under fluctuation in the processing solution compositions or a reduction in regression of a latent image and also that the color image formed has superior fastness to light or heat.

However, a still further improvement is desired in view of color forming property or preservability of a white background of prints in the application of a rapid processing, in particular, a rapid processing requiring the total processing time from color development to water washing or stabilization of 2 minutes or shorter.

SUMMARY OF THE INVENTION

Accordingly, the object of the present invention is to provide a color photographic light-sensitive material and a color image formation method capable of rapid processing and providing a high color-forming property and also superior fastness of a dye image formed. In particular, the object of the present invention is to provide a color photographic light-sensitive material and a color image formation method ensuring the reduction in discoloration of a white background after a long-term storage of prints even when a rapid processing in a short processing time is applied.

DETAILED DESCRIPTION OF THE INVENTION

These and other objects of the present invention have been achieved by:

(1) a silver halide color photographic light-sensitive material comprising a support having provided thereon at least a yellow dye forming silver halide emulsion layer, a magenta dye-forming silver halide emulsion layer and a cyan dye-forming silver halide emulsion layer, wherein the total silver coverage in the silver halide emulsion layers is 0.6 g/m$^2$ or less, the magenta dye-forming silver halide emulsion layer contains silver halide emulsion grains comprising silver chloride or silver chlorobromide substantially free of silver iodide having a silver chloride content of 90 mol % or more and at least one magenta dye-forming coupler represented by formula (M-I), and the total coating amount of oil-soluble components contained in photographic constituent layers above the silver halide emulsion layer nearest to the support is 3.5 g/m$^2$ or less:

(M-I)

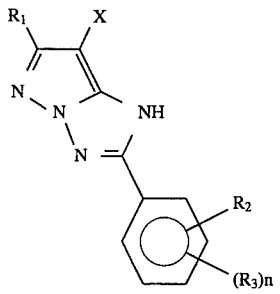

wherein $R_1$ represents a group represented by formula (Q-1), (Q-2) or (Q-3), $R_2$ and $R_3$ each represents a substituent, n represents from 0 to 4 and when n is 2 or greater, a plurality of $R_3$ groups may be the same or different, and X represents a group capable of being released on coupling reaction with an oxidation product of a developing agent;

$$—C(R_4)(R_5)—R_6 \quad (Q\text{-}1)$$

wherein $R_4$ represents an alkyl group, a cycloalkyl group, an aryl group or a heterocyclic group, $R_5$ and $R_6$ each represents a substituent, and $R_4$, $R_5$ and $R_6$ may be combined with each other to form a 5-, 6- or 7-membered monocyclic or condensed ring;

$$—CH(R_7)—R_8 \quad (Q\text{-}2)$$

wherein $R_7$ represents an alkyl group, a cycloalkyl group, an aryl group or a heterocyclic group, $R_8$ represents a substituent, and $R_7$ and $R_8$ may be combined with each other to form a 5-, 6- or 7-membered monocyclic or condensed ring;

(Q-3)

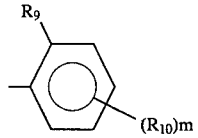

wherein $R_9$ and $R_{10}$ each represents a substituent and m represents from 0 to 4 and when m is 2 or greater, a plurality of $R_{10}$ groups may be the same or different;

(2) the silver halide color photographic light-sensitive material as described in item (1) above, wherein the magenta dye-forming coupler is represented by formula (M-1) where $R_1$ is a substituent represented by formula (Q-1) or (Q-3);

(3) the silver halide color photographic light-sensitive material as described in item (1) above, wherein the magenta dye-forming coupler is represented by formula (M-II):

(M-II)

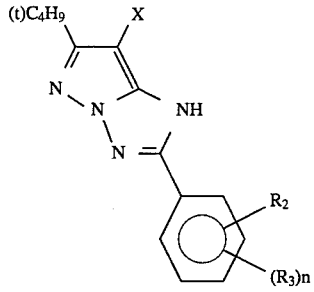

wherein $R_2$, $R_3$, n and X have the same meaning as $R_2$, $R_3$, n and X in formula (M-I), respectively;

(4) the silver halide color photographic light-sensitive material as described in item (1) above, wherein at least one layer of the cyan dye-forming layer contains at least one cyan dye-forming coupler represented by formula (C-I):

(C-I)

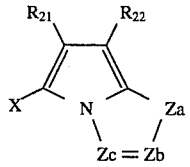

wherein Za represents —NH— or —CH($R_{23}$)—, Zb and Zc each represents —C($R_{24}$)= or —N=, $R_{21}$, $R_{22}$ and $R_{23}$ each represents an electron-attractive group having a Hammett's substituent constant σp of 0.20 or more, with the proviso that the sum of σp values of $R_{21}$ and $R_{22}$ is 0.65 or more, $R_{24}$ represents a hydrogen atom or a substituent and when two or more of $R_{24}$ groups are present, they may be the same or different, X represents a group capable of being released on coupling reaction with an oxidation product of a developing agent, and $R_{21}$, $R_{22}$, $R_{23}$, $R_{24}$ or X may be a divalent group and combined with a dimer or greater polymer or a polymer chain to form a polymer;

(5) a color image formation method comprising processing the photographic light-sensitive material described in item (1) above with a color developer containing an aromatic primary amine developing agent within a color development time of 30 seconds or shorter; and (6) a color image formation method comprising continuously processing the photographic light-sensitive material described in item (1) above with a color developer containing an aromatic primary amine developing agent at a replenishing rate of from 20 to 45 ml per m$^2$ of the photographic light-sensitive material.

Now, the present invention will be described in detail below.

The magenta dye-forming coupler represented by general formula (M-1) is known in EP 0571959A2, but only the use of this coupler could not realize a rapid and simple processing. The above-described patent publication describes merely that the density changes to a small degree even when the processing solution compositions fluctuate or that the regression of a latent image is low, and it is an effect newly found in the present invention that when the coupler is used in a light-sensitive material comprising dye-forming silver halide emulsion layers having a coated silver amount in total of 0.6 g/m$^2$ or less with photographic constituent layers provided above the silver halide emulsion layer nearest to the support having an oil-soluble component coated amount in total of 3.5 g/m$^2$ or less and a rapid processing is applied thereto, the resulting dye image as well as white background can have excellent storage stability.

In the present invention, the photographic constituent layers above the silver halide emulsion layer nearest to the support indicate the photographic constituent layers farther from the support than the silver halide emulsion layer nearest to the support.

The light-sensitive material of the present invention comprises at least one yellow dye-forming silver halide emulsion layer, at least one magenta dye-forming silver halide emulsion layer and at least one cyan dye-forming silver halide emulsion layer. The total coated silver amount of light-sensitive silver halide emulsions contained in these dye-forming layers must be 0.6 g/m$^2$ or less. The coated silver amount is obtained by calculating the amount of silver halide emulsions contained in respective light-sensitive emulsion layers provided on the support in terms of metal silver. Thus, the coated silver amount as used in the present invention excludes those contained in light-insensitive layers other than light-sensitive emulsion layers, such as light-insensitive silver halide fine grains or colloidal silver contained in an antihalation layer or a yellow filter layer.

If the coated silver amount exceeds 0.6 g/m$^2$, it is difficult to reduce the development processing time to 30 seconds or 20 or less seconds. The coated silver amount set at a low level is advantageous in shortening the development processing time. Accordingly, in order to achieve a constant maximum coloring (dye) density, a color coupler capable of forming a dye having a large molar extinction coefficient is preferably used. The lower limit of the coated silver amount is not particularly limited and can be freely established within the range where a necessary maximum coloring density can be obtained, but preferably it is 0.05g/m$^2$ or more.

The light-sensitive material of the present invention must contain in at least one magenta dye-forming layer silver halide grains composed of silver chloride or silver chlorobromide having a silver chloride content of 90 mol % or more and substantially free of silver iodide and at least one magenta dye-forming coupler represented by formula (M-I).

If the silver chloride content in the above-described emulsion of the present invention is less than 90 mol %, the rapidity of the development processing is impaired and so, the silver chloride content needs to be 90 mol % or more. In view of a rapid development processing, a higher silver chloride content is preferred. The silver chloride content is preferably 95 mol % or more, more preferably 98 mol % or more.

In the present invention, it is preferred to substantially exclude the silver iodide. "To substantially exclude the silver iodide" as used herein means that the silver iodide content is 1 mol % or less, preferably 0.2 mol % or less. On the other hand, in some cases, for the purpose of increasing a high illumination sensitivity, elevating spectral sensitization sensitivity or enhancing the storage stability of the light-sensitive material, high silver chloride grains containing from 0.01 to 0.3 mol % of silver iodide are preferably used on the emulsion surface as described in JP-A-3-84545.

The light-sensitive material of the present invention needs to contain in at least one magenta dye-forming layer silver halide grains having a silver chloride content of 90 mol % or more in combination with at least one magenta dye-forming coupler represented by formula (M-I) and it is also preferred that other light-sensitive emulsions have a silver chloride content of 90 mol % or more.

The compound represented by formula (M-I) will be described below in detail.

$R_2$ represents an alkyl group (preferably a linear or branched alkyl group having from 1 to 32 carbon atoms, e.g., methyl, ethyl, propyl, isopropyl, butyl, t-butyl, 1-octyl, tridecyl), a cycloalkyl group (preferably a cycloalkyl group having from 3 to 32 carbon atoms, e.g., cyclopropyl, cyclopentyl, cyclohexyl), an alkenyl group (preferably an alkenyl group having from 2 to 32 carbon atoms, e.g., vinyl allyl, 3-butene-1-yl), an aryl group (preferably an aryl group having from 6 to 32 carbon atoms, e.g., phenyl, 1-naphthyl, 2-naphthyl), a heterocyclic group (preferably a 5-, 6-, 7- or 8-membered heterocyclic ring having from 1 to 32 carbon atoms, e.g., 2-thienyl, 4-pyridyl, 2-furyl, 2-pyrmidinyl, 1-pyridyl, 2-benzothiazolyl, 1-imidazolyl, 1-pyrazolyl, benzotriazole-2-yl), a cyano group, a halogen atom (e.g., fluorine, chlorine, bromine), a hydroxyl group, a nitro group, a carboxyl group, an alkoxy group (preferably an alkoxy group having from 1 to 32 carbon atoms, e.g., methoxy, ethoxy, 1-butoxy, 2-butoxy, isopropoxy, t-butoxy, dodecyloxy), a cycloalkyloxy group (preferably a cycloalkyloxy group having from 3 to 32 carbon atoms, e.g., cyclopentyloxy, cyclohexyloxy), an aryloxy group (preferably an aryloxy group having from 6 to 32 carbon atoms, e.g., phenoxy, 2-naphthoxy), a heterocyclic oxy group (preferably a heterocyclic oxy group having from 1 to 32 carbon atoms, e.g., 1-phenyltetrazole-5-oxy, 2-tetrahydropyranyloxy, 2-furyloxy), a silyloxy group (preferably a silyloxy group having from 1 to 32 carbon atoms, e.g., trimethylsilyloxy, t-butyldimethylsilyloxy, diphenylmethylsilyloxy), an acyloxy group (preferably an acyloxy group having from 2 to 32 carbon atoms, e.g., acetoxy, pivaloyloxy, benzoyloxy, dodecanoyloxy), an alkoxycarbonyloxy group (preferably an alkoxycarbonyloxy group having from 2 to 32 carbon atoms, e.g., ethoxycarbonyloxy, t-butoxycarbonyloxy), cycloalkyloxycarbonyloxy group (preferably a cycloalkyloxycarbonyloxy group having from 4 to 32 carbon atoms, e.g., cyclohexyloxycarbonyloxy), an aryloxycarbonyloxy group (preferably an aryloxycarbonyloxy group having from 7 to 32 carbon atoms, e.g., phenoxycarbonyloxy), a carbamoyloxy group (preferably a carbamoyloxy group having from 1 to 32 carbon atoms, e.g., N,N-dimethylcarbamoyloxy, N-butylcarbamoyloxy), a sulfamoyloxy group (preferably a sulfamoyloxy group having from 1 to 32 carbon atoms, e.g., N,N-diethylsulfamoyloxy, N-propylsulfamoyloxy), an alkanesulfonyloxy group (preferably an alkanesulfonyloxy group having from 1 to 32 carbon atoms, e.g., methanesulfonyloxy, hexadecanesulfonyloxy), an arylsulfonyloxy group (preferably an arylsulfonyloxy group having from 6 to 32 carbon atoms, e.g., benzenesulfonyloxy), an acyl group (preferably an acyl group having from 1 to 32 carbon atoms, e.g., formyl, acetyl, pivaloyl, benzoyl, tetradecanoyl), an alkoxycarbonyl group (preferably an alkoxycarbonyl group having from 2 to 32 carbon atoms, e.g., methoxycarbonyl, ethoxycarbonyl, octadecyloxycarbonyl), a cycloalkyloxycarbonyl group (preferably a cycloalkyloxycarbonyl group having from 2 to 32 carbon atoms, e.g., cyclohexyloxycarbonyl), an aryloxycarbonyl group (preferably an aryloxycarbonyl group having from 7 to 32 carbon atoms, e.g., phenoxycarbonyl), a carbamoyl group (preferably a carbamoyl group having from 1 to 32 carbon atoms, e.g., carbamoyl, N,N-dibutylcarbamoyl, N-ethyl-N-octylcarbamoyl, N-propylcarbamoyl), an amino group (preferably an amino group having 32 or less carbon atoms, e.g., amino, methylamino, N,N-dioctylamino, tetradecylamino, octadecylamino), an anilino group (preferably an anilino group having from 6 to 32 carbon atoms, e.g., anilino, N-methylanilino), a heterocyclic amino group (preferably a heterocyclic amino group having from 1 to 32 carbon atoms, e.g., 4-pyridylamino), a carbonamido group (preferably a carbonamido group having from 2 to 32 carbon atoms, e.g., acetamide, benzamido, tetradecaneamido, carbonamido group in the formula (M-III)), a ureido group (preferably a ureido group having from 1 to 32 carbon atoms, e.g., ureido, N,N-dimethylureido, N-phenylureido), an imido group (preferably an imido group having 10 or less carbon atoms, e.g., N-succinimido, N-phthalimido), an alkoxycarbonylamino group (preferably an alkoxycarbonylamino group having from 2 to 32 carbon atoms, e.g., methoxycarbonylamino, ethoxycarbonylamino, t-butoxycarbonylamino, octadecyloxycarbonylamino), an aryloxycarbonylamino group (preferably an aryloxycarbonylamino group having from 7 to 32 carbon atoms, e.g., phenoxycarbonylamino), a sulfonamido group (preferably a sulfonamido group having from 1 to 32 carbon atoms, e.g., methanesulfonamido, butanesulfonamido, benzenesulfonamido, hexadecanesulfonamido, groups in the formula (M-III)), a sulfamoylamino group (a sulfamoylamino group having from 1 to 32 carbon atoms, e.g., N,N-dipropylsulfamoylamino, N-ethyl-N-dodecylsulfamoylamino), an azo group (preferably an azo group having from 1 to 32 carbon atoms, e.g., phenyl azo), an alkylthio group (preferably an alkylthio group having from 1 to 32 carbon atoms, e.g., ethylthio, octylthio), an arylthio group (preferably an arylthio group having from 6 to 32 carbon atoms, e.g., phenylthio), a heterocyclic thio group (preferably a heterocyclic thio group having from 1 to 32 carbon atoms, e.g., 2-benzothiazolylthio, 2-pyridylthio, 1-phenyltetrazolylthio), an alkylsulfinyl group (an alkylsulfinyl group having from 1 to 32 carbon atoms, e.g., dodecanesulfinyl), an arylsulfinyl group (preferably an arylsulfinyl group having from 6 to 32 carbon atoms, e.g., benzenesulfinyl), an alkanesulfonyl group (an alkanesulfonyl group having from 1 to 32 carbon atoms, e.g., methanesulfonyl, octanesulfonyl), an arylsulfonyl group (preferably an arylsulfonyl group having from 6 to 32 carbon atoms, e.g., benzenesulfonyl, 1-naphthalenesulfonyl), a sulfamoyl group (preferably a sulfamoyl group having 32 or less carbon atoms, e.g., sulfamoyl, N,N-dipropylsulfamoyl, N-ethyl-N-dodecylsulfamoyl), a sulfo group or a phosphonyl group (preferably a phosphonyl group having from 1 to 32 carbon atoms, e.g., phenoxyphosphonyl, octyloxyphosphonyl, phenylphosphonyl).

$R_3$ has the same meaning as $R_2$.

In formula (Q-1), $R_4$ represents an alkyl group, a cycloalkyl group, an aryl group, or a heterocyclic group. The preferred embodiment and specific examples of these groups are the same as those described in the group for $R_2$. $R_5$ and $R_6$ each has the same meaning as $R_2$, and at least two groups freely selected from $R_4$, $R_5$ and $R_6$ may be combined with each other to form a 5-, 6- or 7-membered hydrocarbon or heterocyclic ring preferably containing at least one of N, S and O (either monocyclic or condensed ring).

In formula (Q-2), $R_7$ has the same meaning as $R_4$ of formula (Q-1), $R_8$ has the same meaning as $R_2$, and $R_7$ and $R_8$ may be combined with each other to form a 5-, 6- or 7-membered hydrocarbon or heterocyclic ring preferably containing at least one of N, S and O (either monocyclic or condensed ring).

In formula (Q-3), $R_9$ and $R_{10}$ each has the same meaning as $R_2$.

X represents a hydrogen atom or a group capable of being released on the reaction with an oxidation product of a developing agent. More specifically, the group capable of being released is a halogen atom, an alkoxy group, an aryloxy group, an acyloxy group, a carbamoyloxy group, a sulfonyloxy group, a carbonamido group, a sulfonamido group, a carbamoylamino group, a heterocyclic group, an arylazo group, an alkylthio group, an arylthio group or a heterocyclic thio group. The preferred embodiment and specific examples of these groups are the same as those described in the group for $R_2$. Other than these, X may be a bis-form coupler having bonded thereto bimolecular 4-equivalent coupler through aldehyde or ketone or may be a photographically useful group such as a development accelerator, a development inhibitor, a desilverization accelerator or a leuco dye or a precursor thereof.

The group represented by $R_1$, $R_2$, $R_3$ or X may further have a substituent and preferred examples of the substituent include a halogen atom, an alkyl group, a cycloalkyl group, an alkenyl group, an aryl group, a heterocyclic group, a cyano group, a hydroxyl group, a nitro group, an alkoxy group, an aryloxy group, a heterocyclic oxy group, a silyloxy group, an acyloxy group, an alkoxycarbonyloxy group, a cycloalkyloxycarbonyloxy group, an aryloxycarbonyloxy group, a carbamoyloxy group, a sulfamoyloxy group, an alkanesulfonyl oxy group, an arylsulfonyloxy group, a carboxyl group, an acyl group, an alkoxycarbonyl group, a cycloalkyloxycarbonyl group, an aryloxycarbonyl group, a carbamoyl group, an amino group, an anilino group, a heterocyclic amino group, a carbonamido group, an alkoxycarbonylamino group, an aryloxycarbonylamino group, a ureido group, a sulfonamido group, a sulfamoylamino group, an imido group, an alkylthio group, an arylthio group, a heterocyclic thio group, a sulfinyl group, a sulfo group, an alkanesulfonyl group, an arylsulfonyl group, a sulfamoyl group and a phosphonyl group.

The compound represented by formula (M-I) may form a dimer or greater polymeric substance or a polymer via the substituents $R_1$, $R_2$, $R_3$ and X.

Preferred embodiments of the compound represented by formula (M-I) will be described below.

In formula (Q-1), $R_4$ is preferably an alkyl group and $R_5$ and $R_6$ each is preferably an alkyl group, a cycloalkyl group, an aryl group, a hydroxyl group, an alkoxy group, an aryloxy group, an amino group, an anilino group, a carbonamido group, a ureido group, a sulfonamido group, a sulfamoylamino group, an imido group, an alkylthio group or an arylthio group, more preferably an alkyl group, a cycloalkyl group or an aryl group, most preferably an alkyl group.

In formula (Q-2), $R_7$ is preferably an alkyl group, a cycloalkyl group or an aryl group, more preferably a secondary or tertiary alkyl group or a cycloalkyl group and $R_8$ is preferably an alkyl group, a cycloalkyl group or an aryl group, more preferably an alkyl group or a cycloalkyl group.

In formula (Q-3), $R_9$ and $R_{10}$ each is preferably a halogen atom, an alkyl group, a cycloalkyl group, an aryl group, an alkoxy group, an aryloxy group, an acyl group, an alkoxycarbonyl group, a cycloalkyloxycarbonyl group, an aryloxycarbonyl group, a carbamoyl group, an amino group, an anilino group, a carbonamido group, an alkoxycarbonylamino group, an aryloxycarbonylamino group, a ureido group, a sulfonamido group, a sulfamoylamino group, an imido group, an alkylthio group, an arylthio group, a heterocyclic thio group, a sulfinyl group, an alkanesulfonyl group, an arylsulfonyl group, a sulfamoyl group or a phosphonyl group, more preferably a halogen atom, an alkyl group, a cycloalkyl group, an aryl group, an alkoxy group, an aryloxy group, an amino group, an anilino group, a carbonamido group, a ureido group, a sulfonamido group, a sulfamoylamino group, an alkylthio group or an arylthio group, most preferably an alkyl group, a cycloalkyl group, an aryl group, an alkoxy group, an aryloxy group, an alkylthio group or an arylthio group, m is preferably from 0 to 3, more preferably 1 or 2, and the substitution site of $R_9$ is more preferably the orth position of the phenyl group.

$R_1$ is more preferably a group represented by formula (Q-1) or (Q-3), still more preferably a group represented by formula (Q-1), still further preferably a group represented by formula (Q-1) where $R_4$, $R_5$ and $R_6$ each is an alkyl group, and most preferably a t-butyl group. Specific examples of preferred groups represented by $R_1$ are described below, but the present invention is by no means limited to these.

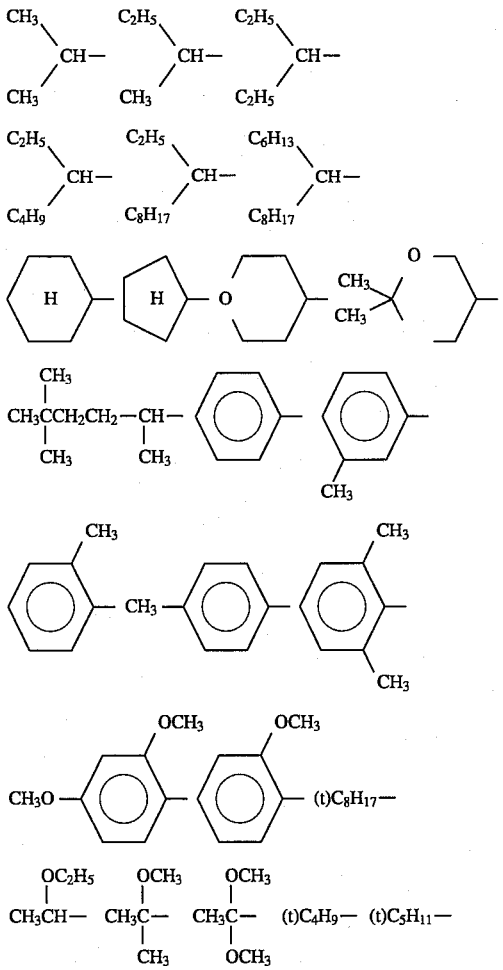

-continued

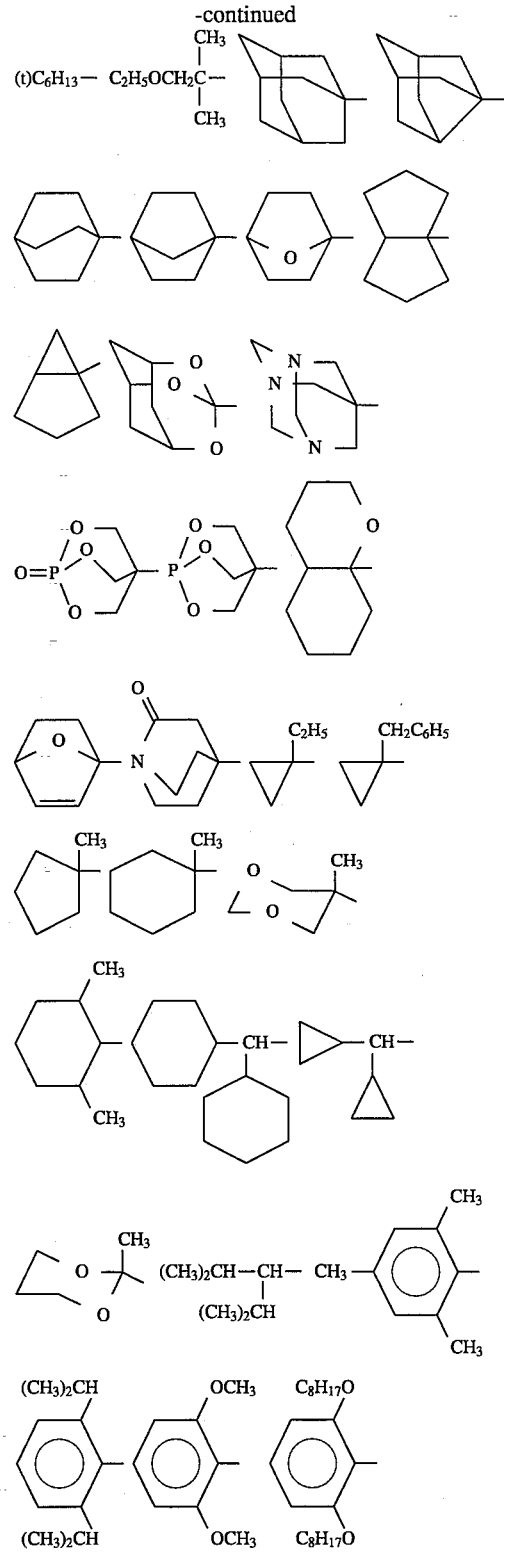

-continued

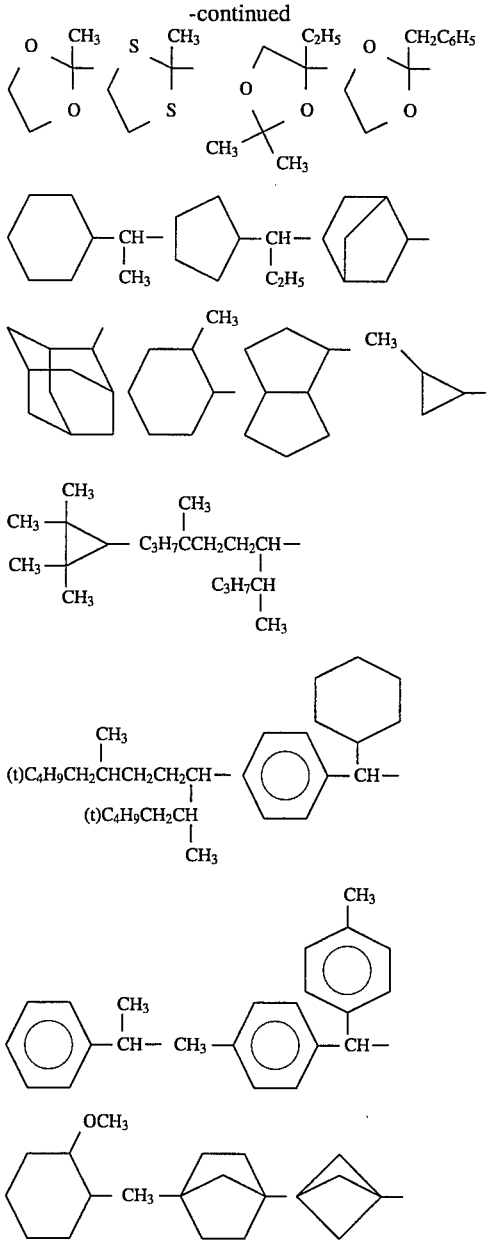

$R_2$ is preferably an alkoxy group, an aryloxy group, an acyloxy group, an alkoxycarbonyloxy group, a cycloalkyloxycarbonyloxy group, an aryloxycarbonyloxy group, a carbamoyloxy group, a sulfamoyloxy group, an alkanesulfonyloxy group, an arylsulfonyloxy group, an acyl group, an alkoxycarbonyl group, a cycloalkyloxycarbonyl group, an aryloxycarbonyl group, a carbamoyl group, an amino group, an anilino group, a carbonamido group, an alkoxycarbonylamino group, an aryloxycarbonylamino group, a ureido group, a sulfonamido group, a sulfamoylamino group, an imido group, an alkylthio group, an arylthio group, a heterocyclic thio group, an alkanesulfonyl group, an arylsulfonyl group or a sulfamoyl group, more preferably an alkoxy group, an aryloxy group, an acyl group, an alkoxycarbonyl group, a cycloalkyloxycarbonyl group, an aryloxycarbonyl group, a carbamoyl group, an amino group, an anilino group, a carbonamido group, an alkoxycarbonylamino group, an aryloxycarbonylamino group, a ureido group, a sulfonamido group, a sulfamoylamino group, an imido group, an alkylthio group, an arylthio group or a sulfamoyl group or a group represented by —N($R_{14}$)—A—$R_{13}$ in which A, $R_{13}$ and $R_{14}$ are defined later. The substitution site of $R_2$ is preferably a meta- or para-position to the carbon atom bonded to the pyrazolotriazole ring, more preferably the para-position.

$R_3$ is preferably a fluorine atom, a chlorine atom, a bromine atom, an alkyl group, a cycloalkyl group, an aryl group, a heterocyclic group, a cyano group, a hydroxyl group, a nitro group, an alkoxy group, an aryloxy group, a carboxyl group, an acyl group, an alkoxycarbonyl group, a cycloalkyloxycarbonyl group, an aryloxycarbonyl group, a carbamoyl group, an amino group, an anilino group, a carbonamido group, an alkoxycarbonylamino group, an aryloxycarbonylamino group, a ureido group, a sulfonamido group, a sulfamoylamino group, an imido group, an alkykthio group, an arylthio group, a heterocyclic thio group, a sulfinyl group, a sulfo group, an alkanesulfonyl group, an arylsuofonyl group, a sulfamoyl group or a phosphonyl group. n is preferably from 0 to 3, more preferably 0 or 1.

X is preferably a hydrogen atom, a chlorine atom, a bromine atom, an aryloxy group, an alkylthio group, an arylthio group, a heterocyclic thio group or a heterocyclic group, more preferably a chlorine atom or an aryloxy group, most preferably a chlorine atom. Specific examples of preferred groups represented by X are described below, but the present invention is by no means limited thereto.

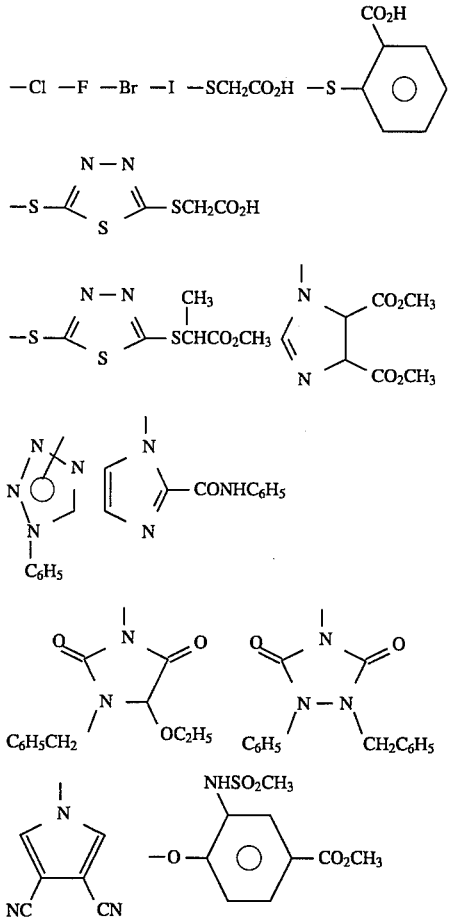

-continued
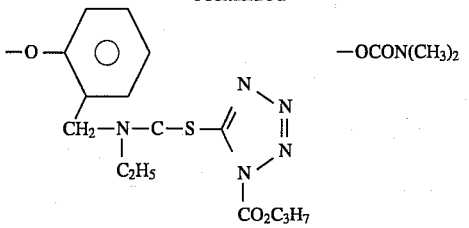
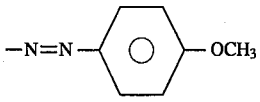
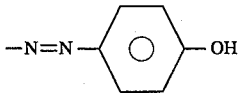
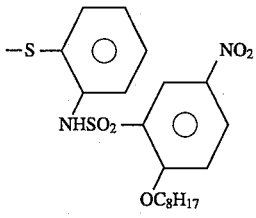
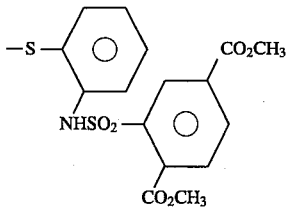
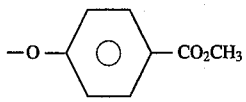
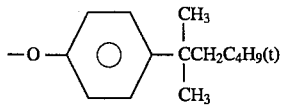
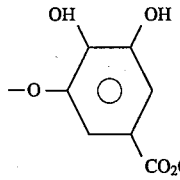
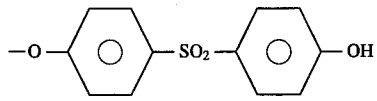
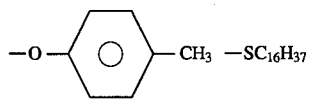
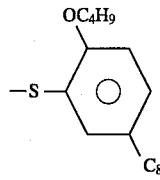
-continued
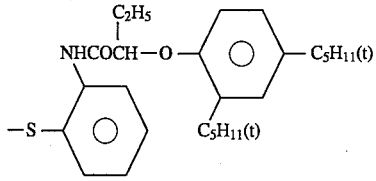
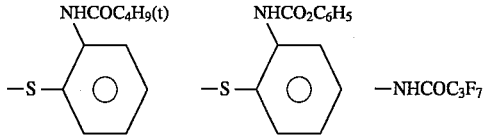
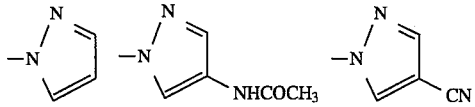
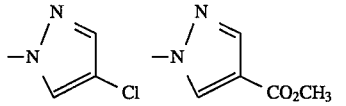
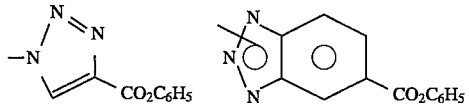
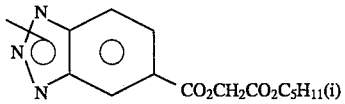
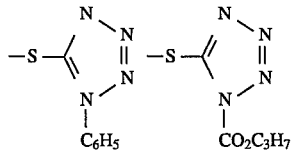
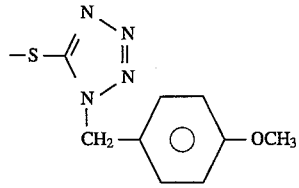
In view of the effects of the present invention, preferred among compounds represented by formula (M-I) is the compound represented by formula (M-II), more preferably the compound represented by formula (M-III):
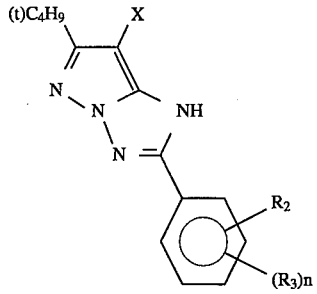
(M-II)
wherein $R_2$, $R_3$, n and X have the same meaning as $R_2$, $R_3$, n and X of formula (M-I), respectively:

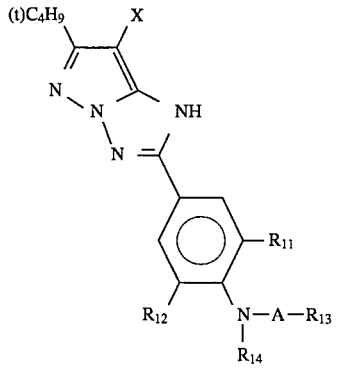

(M-III)

wherein $R_{11}$ and $R_{12}$ each represents a hydrogen atom or a substituent, A represents —CO— or —$SO_2$—, $R_{13}$ represents an alkyl group, an aryl group, an alkoxy group, an alkylamino group or an anilino group, $R_{14}$ represents a hydrogen atom, an alkyl group, an aryl group, an acyl group, an alkanesulfonyl group or an arylsulfonyl group, X represents a hydrogen atom or a group capable of being released on the coupling reaction with an oxidation product of a developing agent, and $R_{13}$ and $R_{14}$ may be combined with each other to form a 5-, 6- or 7-membered monocyclic or condensed ring.

In formula (M-III), $R_{11}$ and $R_{12}$ each is preferably a hydrogen atom, a fluorine atom, a chlorine atom, a bromine atom, an alkyl group, a cycloalkyl group, an aryl group, a heterocyclic group, a cyano group, a hydroxyl group, a nitro group, an alkoxy group, an aryloxy group, a carboxyl group, an acyl group, an alkoxycarbonyl group, a cycloalkyloxycarbonyl group, an aryloxycarbonyl group, a carbamoyl group, an amino group, an anilino group, a carbonamido group, an alkoxycarbonylamino group, an aryloxycarbonylamino group, a ureido group, a sulfonamido group, a sulfamoylamino group, an imido group, an alkylthio group, an arylthio group, a heterocyclic thio group, a sulfinyl group, a sulfo group, an alkanesulfonyl group, an arylsulfonyl group, a sulfamoyl group or a phosphonyl group, $R_{13}$ is preferably an alkyl group or an aryl group, $R_{14}$ is preferably a hydrogen atom or an alkyl group, A is preferably —CO—, and X is preferably a hydrogen atom, a chlorine atom, a bromine atom, an aryloxy group, an alkylthio group, an arylthio group, a heterocyclic thio group or a heterocyclic group, more preferably a chlorine atom or an aryloxy group, most preferably a chlorine atom.

Specific examples of the pyrazolotriazole magenta coupler represented by formula (M-I), which can be used in the present invention, are described below, but the present invention is by no means limited thereto.

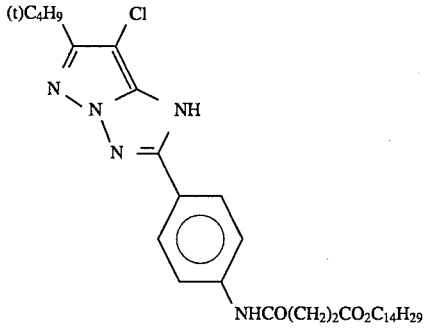

M-1

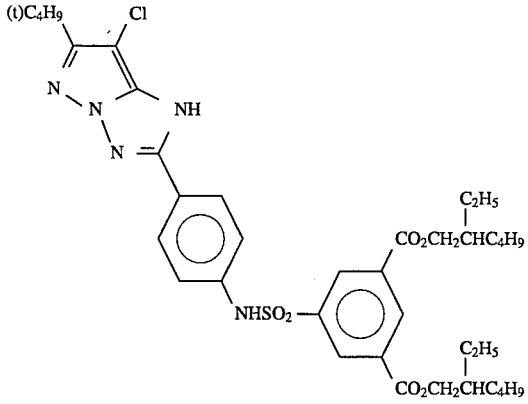

M-2

-continued
M-3
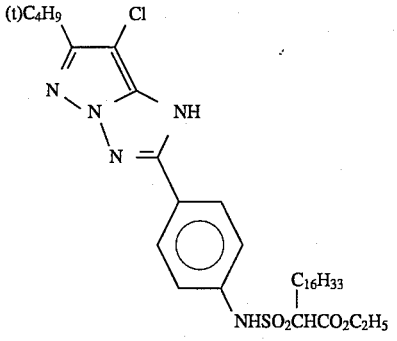
M-4
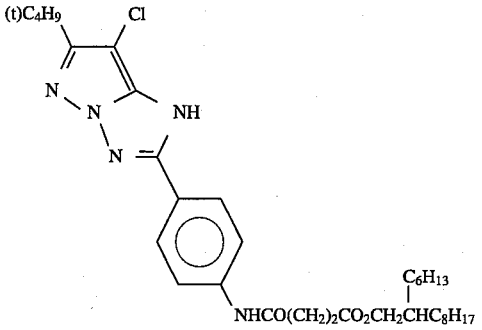
M-5
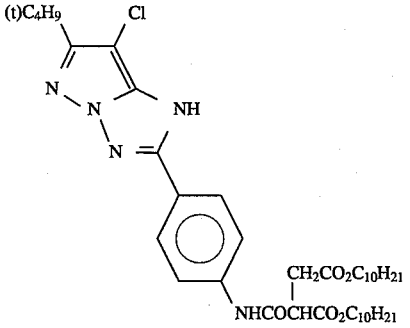
M-6
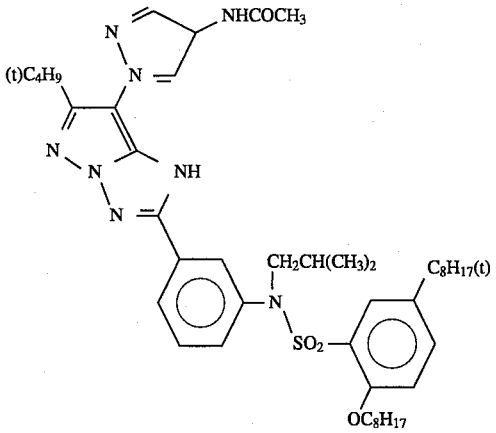

-continued
M-7
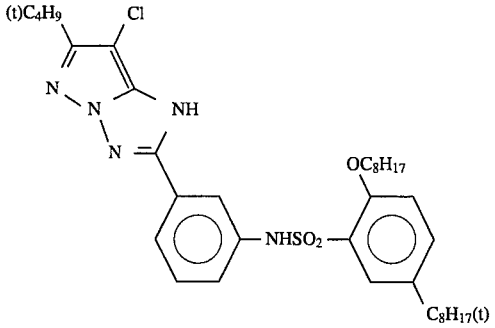
M-8
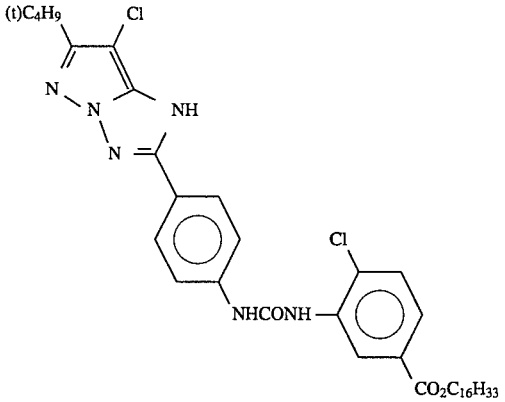
M-9
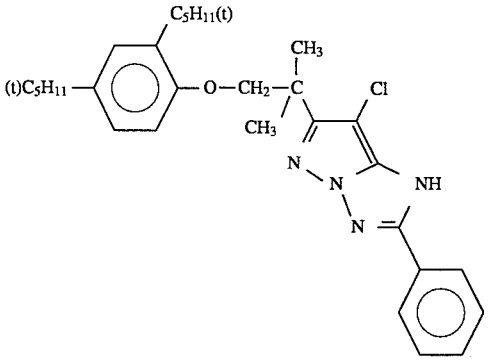
M-10
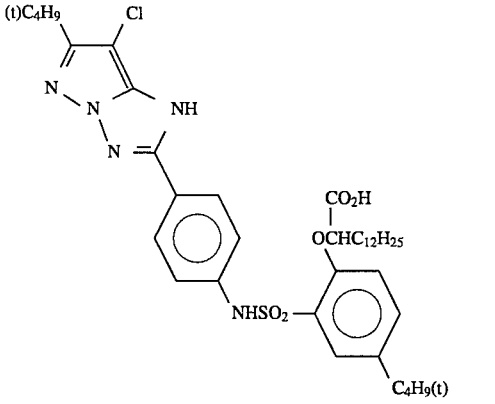

-continued
M-11
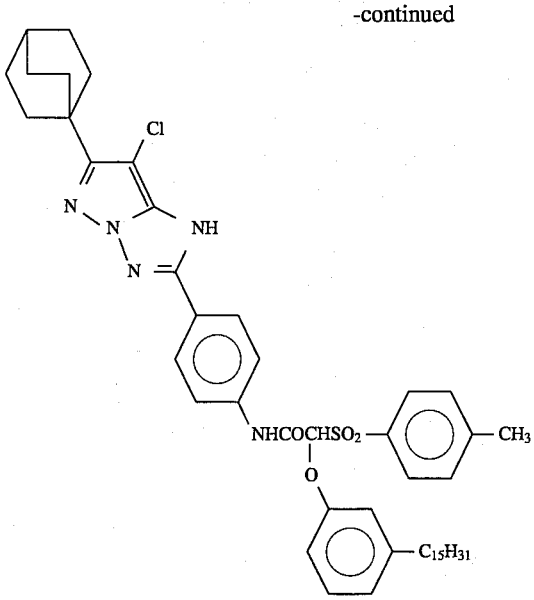
M-12
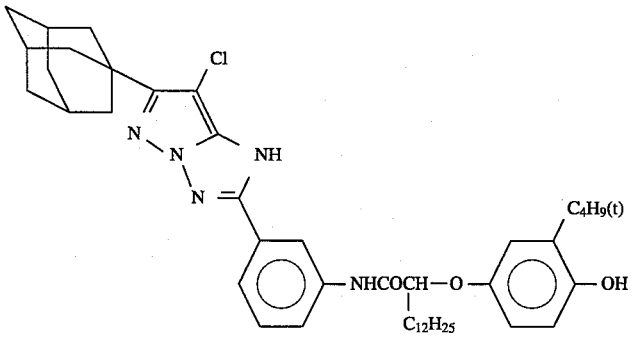
M-13
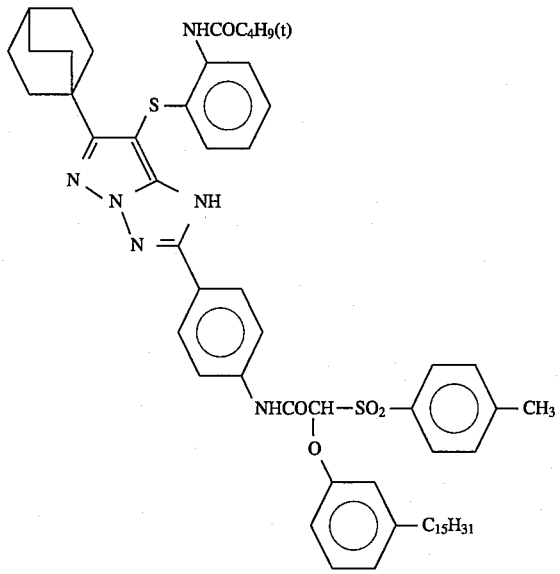

-continued
M-14
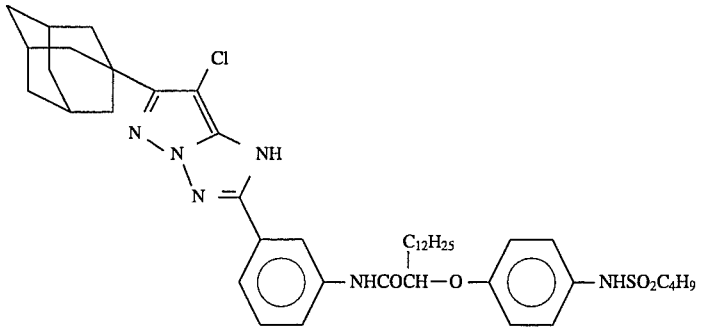
M-15
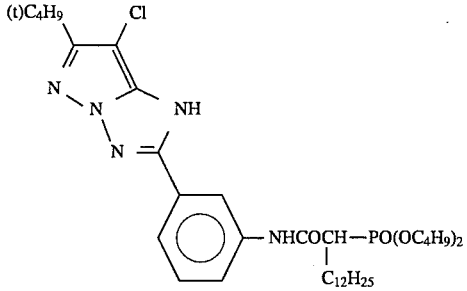
M-16
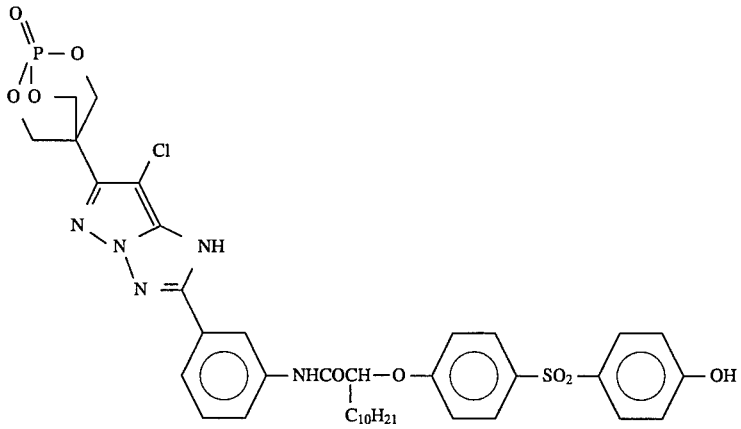
M-17
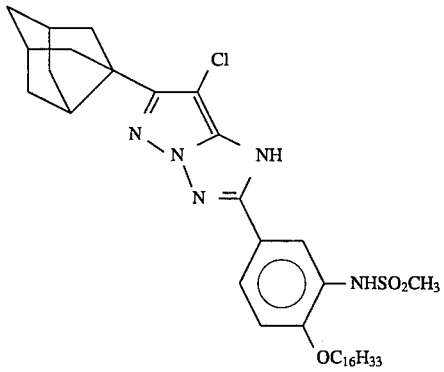

-continued
M-18
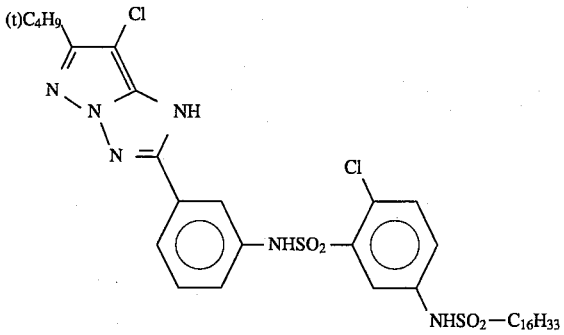
M-19
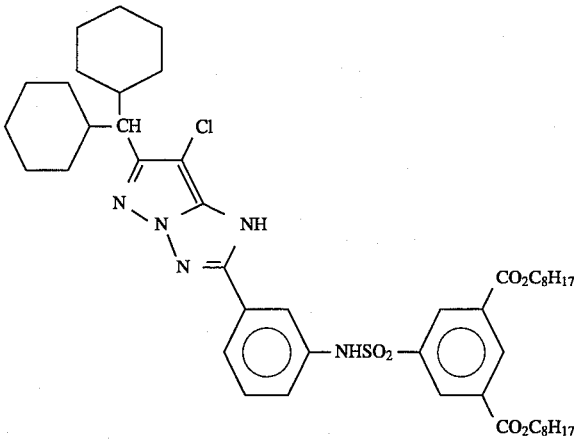
M-20
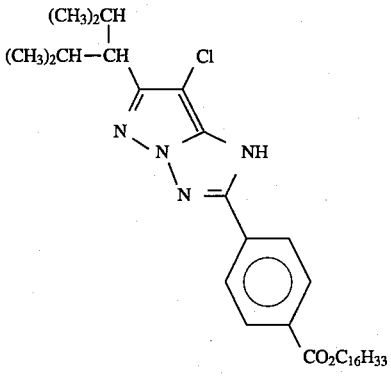
M-21
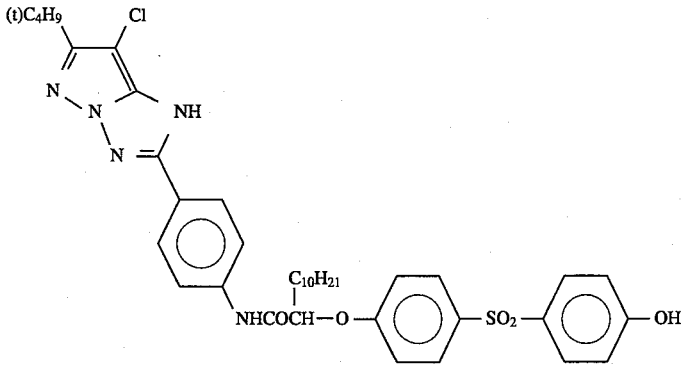

-continued
M-22
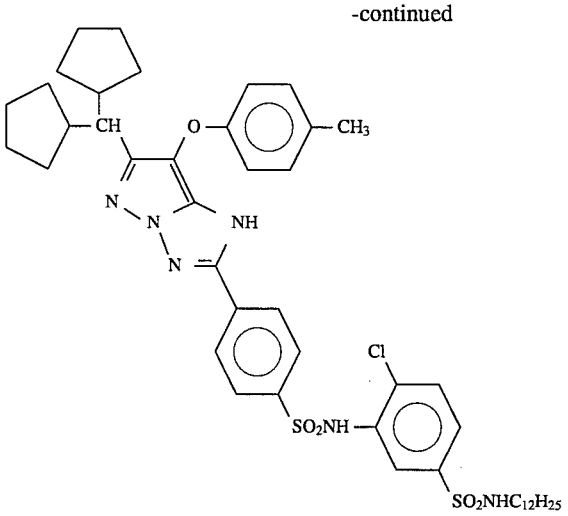
M-23
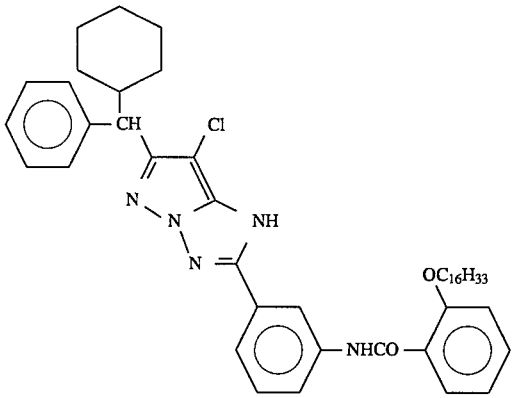
M-24
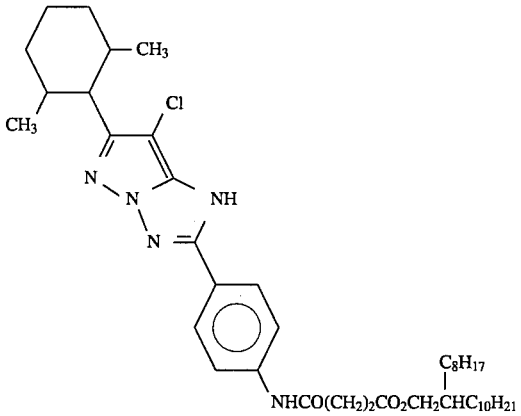
M-25
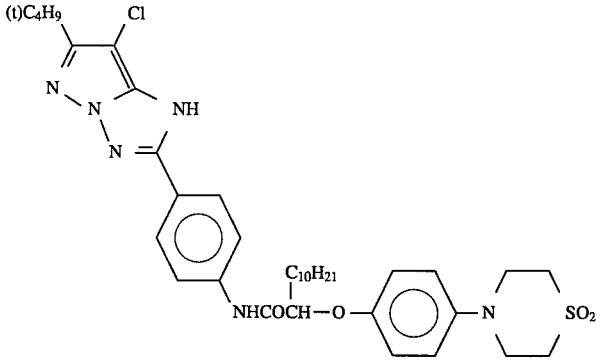

-continued
M-26
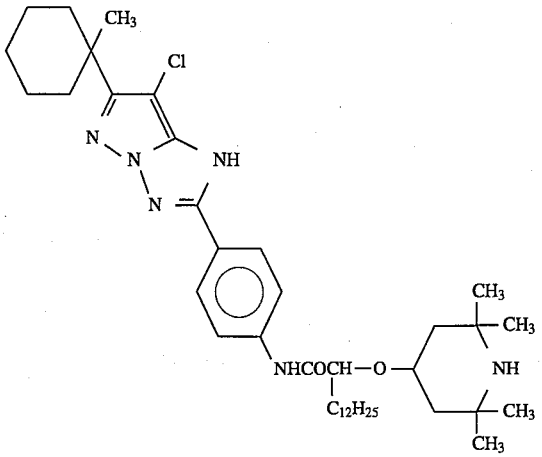
M-27
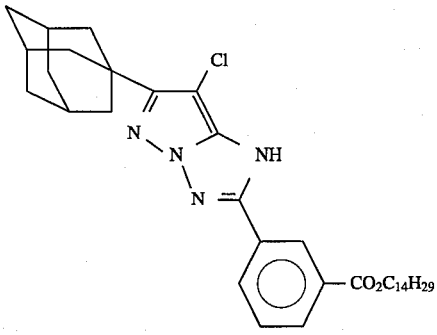
M-28
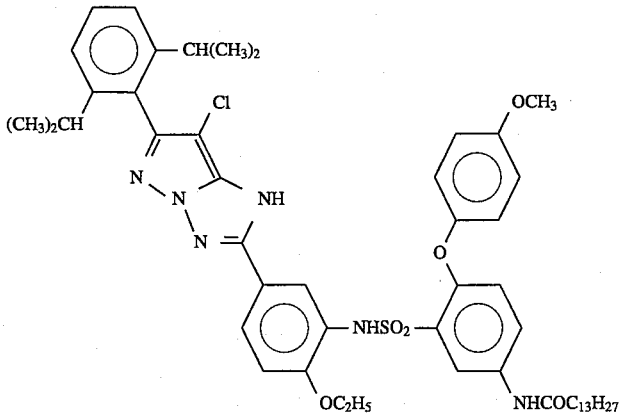
M-29
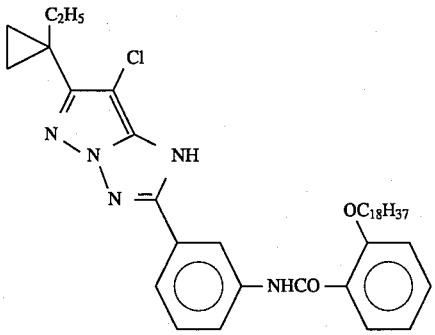

-continued
M-30
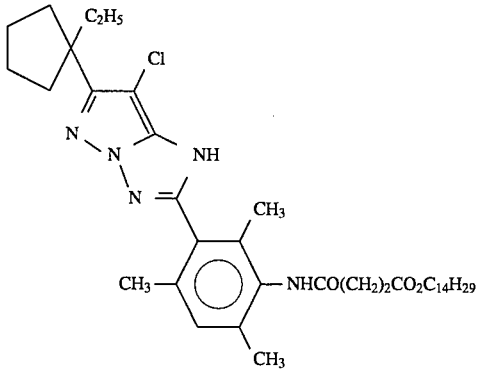
M-31
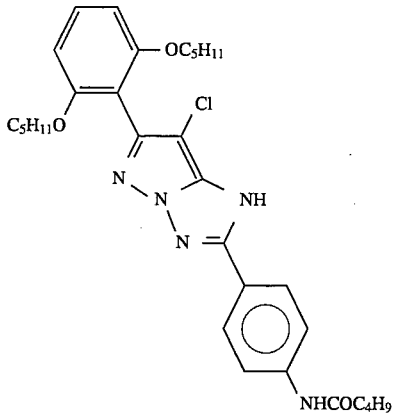
M-32
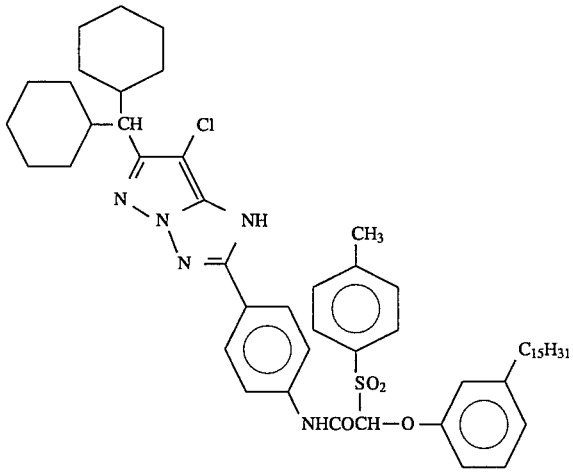
M-33
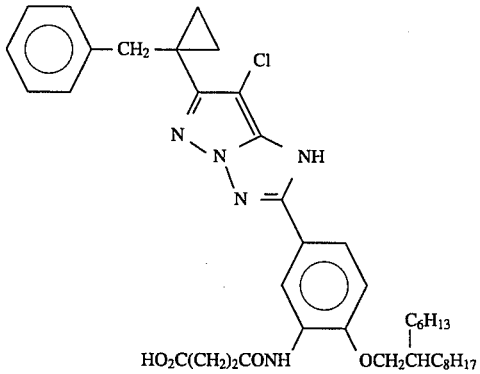

-continued
M-34
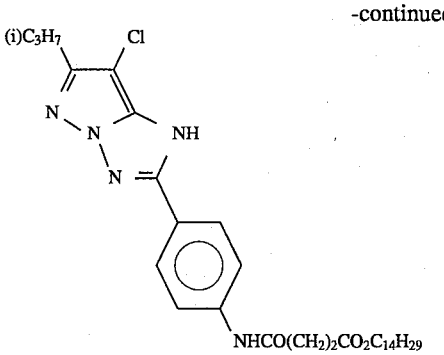
M-35
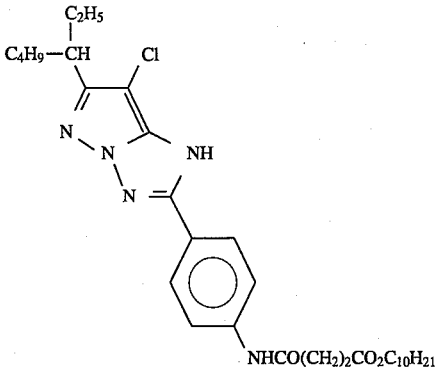
M-36
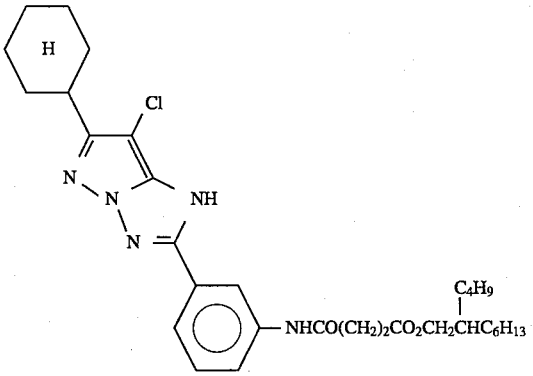
M-37
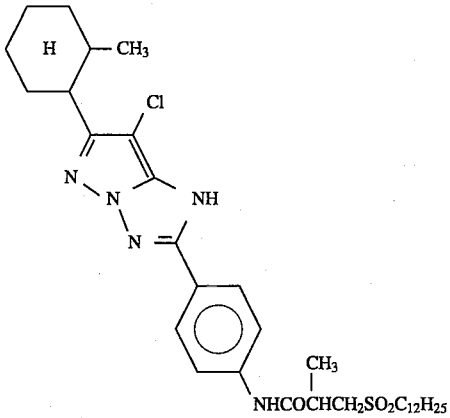

-continued
M-38
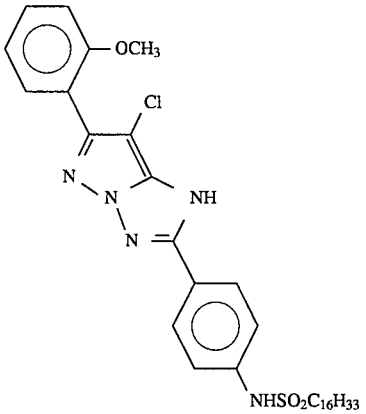
M-39
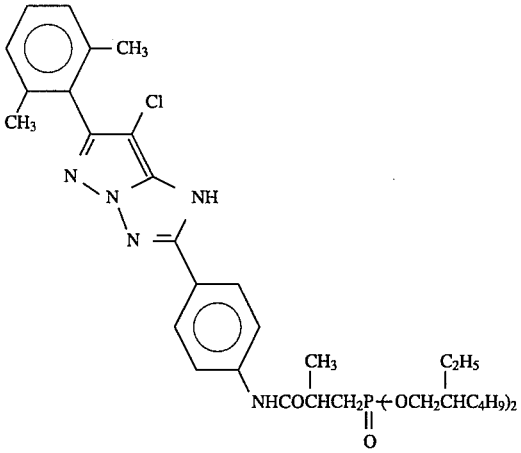
M-40
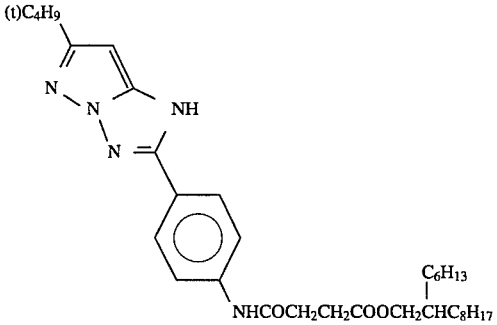
M-41
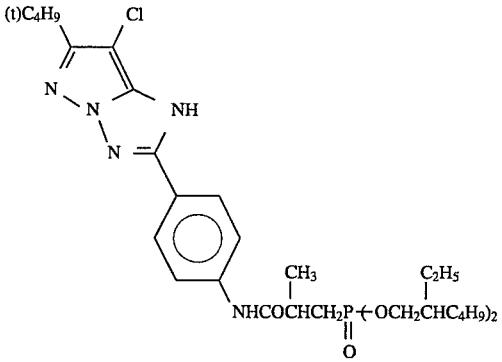

-continued
M-42
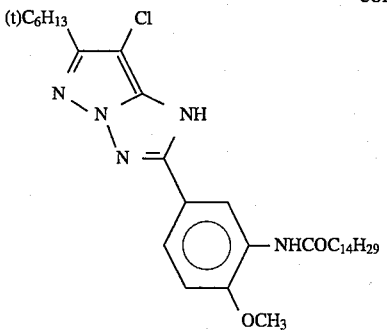
M-43
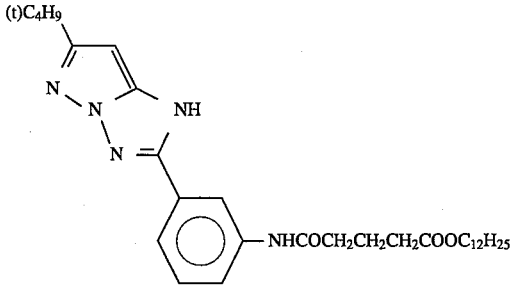
M-44
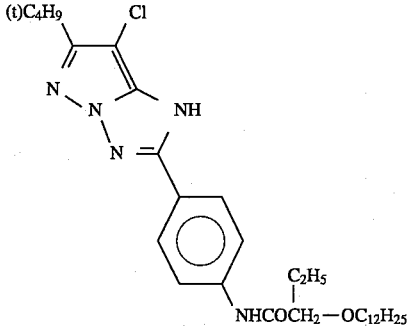
M-45
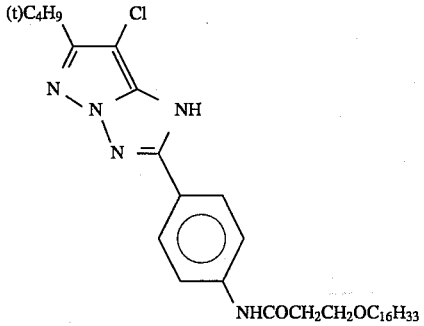
M-46
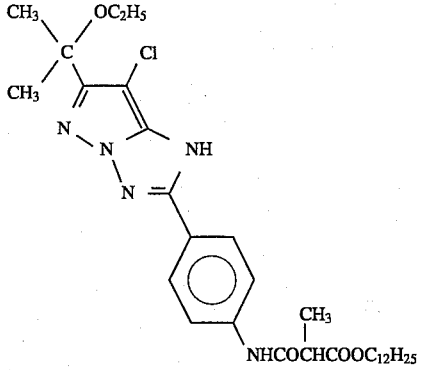

-continued
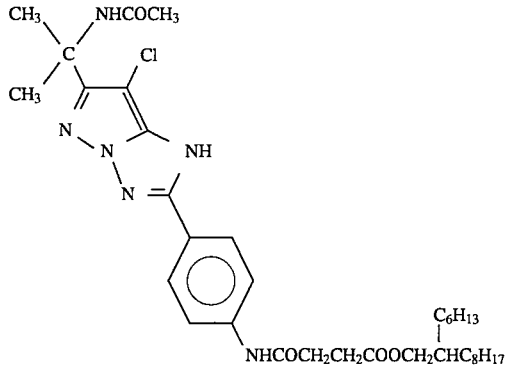
M-47
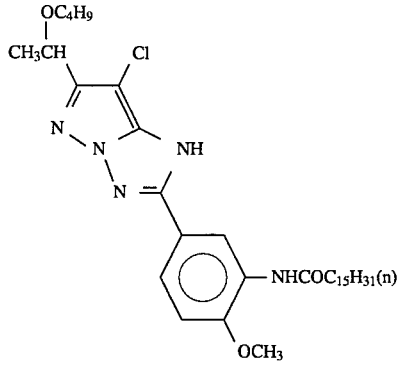
M-48
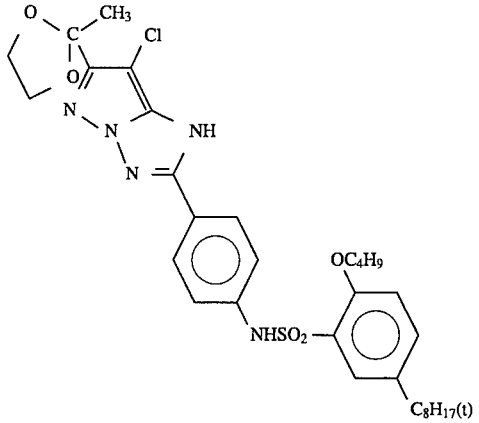
M-49
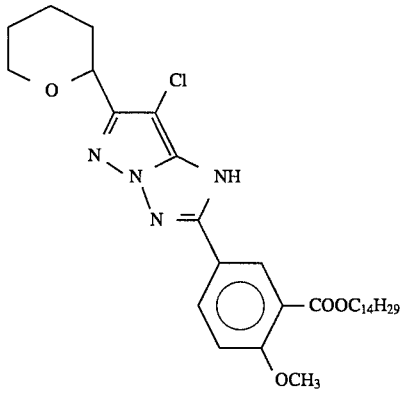
M-50

-continued

M-51

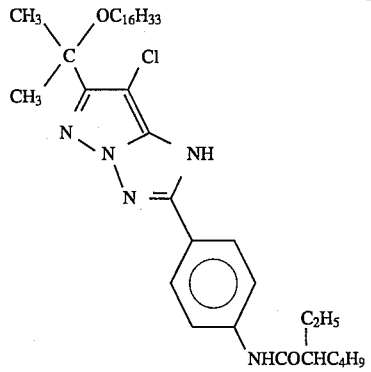

The magenta coupler represented by formula (M-I) of the present invention is preferably used in the silver halide photographic light-sensitive material in an amount of from 0.01 to 10 mmol/m$^2$, more preferably from 0.05 to 5 mmol/m$^2$, most preferably from 0.1 to 2mmol/m$^2$. The coupler of formula (M-I) can of course be used in combination of two or more thereof. In this case, the coupler used in combination may be a coupler other than the coupler of formula (M-I) and when such a coupler is used, the magenta coupler of the present invention is preferably used at a rate of 50 mol % or more. If the use amount of the magenta coupler of the present invention is less than 0.01 mmol/m$^2$, a necessary coloring density is hardly obtained, whereas if it exceeds 10 mmol/m$^2$, a disadvantageous effect arises in view of the cost.

The cyan coupler of formula (C-I) of the present invention will be described in greater detail.

The cyan coupler of formula (C-I) of the present invention is specifically represented by formulae (IIa) to (VIIIa):

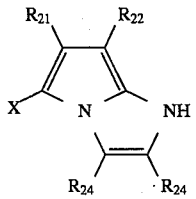

(IIa)

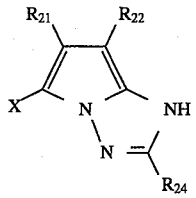

(IIIa)

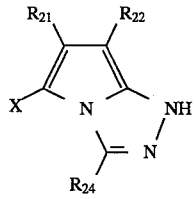

(IVa)

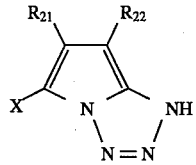

(Va)

-continued

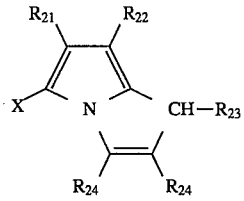

(VIa)

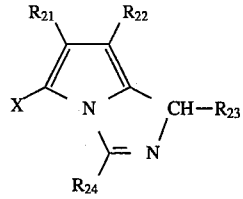

(VIIa)

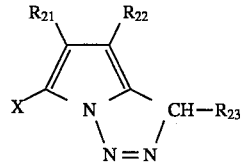

(VIIIa)

In formulae (IIa) to (VIIIa), $R_{21}$, $R_{22}$, $R_{23}$, $R_{24}$ and X each has the same meaning as in formula (C-I).

Among these, preferred are the cyan couplers represented by formula (IIa), (IIIa) and (IVa), more preferred is the cyan coupler represented by formula (IIIa).

In the cyan coupler of the present invention, $R_{21}$, $R_{22}$ and $R_{23}$ each is an electron-attractive group having a σp value of 0.20 or more and the sum of the σp values of $R_{21}$ and $R_{22}$ is 0.65 or more, preferably 0.70 or more, with the upper limit thereof being around 1.8.

$R_{21}$, $R_{22}$ and $R_{23}$ each is an electron-attractive group having a σp value of 0.20 or more, preferably 0.35 or more, still more preferably 0.40 or more, with the upper limit being 1.0, and more preferably being 0.75. The Hammett's rule is a rule of thumb advanced by L. P. Hammett in 1935 for the convenience in quantitatively discussing the effect of the substituent on the reaction or equilibrium of benzene derivatives and is widely acknowledge to be adequate at present. The substituent constant determined by the Hammett's rule includes a σp value and a σm value and these values are described in many general publications, for example, in J. A. Dean, *Lange's Handbook of Chemistry,* Ver. 12, McGraw-Hill (1979) and *Kagaku no Ryoiki Zoukan,* No. 122, pp. 96–103, Nan'kodo (1979). Although $R_{21}$, $R_{22}$ and $R_{23}$ are prescribed by the Hammett's substituent constant σp value, they are not limited to the substituents of which values are known in publications but of course include those of which values, when determined according to the Hammett's rule, fall in the prescribed range even though they are unknown in published literatures.

Specific examples of $R_{21}$, $R_{22}$ and $R_{23}$ each having a σp value of 0.20 or more include an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfonyl group, an alkylsulfonyl group, an arylsulfonyl group, a sulfonyloxy group, an acylthio group, a sulfamoyl group, a thiocyanate group, a thiocarbonyl group, a halogenated alkyl group, a halogenated alkoxy group, a halogenated aryloxy group, a halogenated alkylamino group, a halogenated alkylthio group, an aryl group substituted by another electron-attractive group having a σp value of 0.20 or more, a heterocyclic group, a halogen atom, an azo group and a selenocyanate group. Of these substituents, the groups capable of further having a substituent may have further a substituent as described for $R_{24}$ later.

Stated more specifically about $R_{21}$, $R_{22}$ and $R_{23}$, examples of the electron-attractive group having a σp value of 2.0 or more include an acyl group (e.g., acetyl, 3-phenylpropanoyl, benzoyl, 4-dodecyloxybenzoyl), an acyloxy group (e.g., acetoxy), a carbamoyl group (e.g., carbamoyl, N-ethylcarbamoyl, N-phenylcarbamoyl, N,N-dibutylcarbamoyl, N-(2-dodecyloxyethyl)carbamoyl, N-(4-n-pentadecaneamido)phenylcarbamoyl, N-methyl-N-dodecylcarbamoyl, N-{3-(2,4-di-t-amylphenoxy)propyl}carbamoyl), an alkoxy carbonyl group (e.g., methoxycarbonyl, ethoxycarbonyl, iso-propyloxycarbonyl, tert-butyloxycarbonyl, iso-butyloxycarbonyl, butyloxycarbonyl, dodecyloxycarbonyl, octadecyloxycarbonyl, diethylcarbamoylethoxycarbonyl, perfluorohexylethoxycarbonyl, 2-decylhexyloxycarbonylmethoxycarbonyl), an aryloxycarbonyl group (e.g., phenoxycarbonyl, 2,5-amylphenoxycarbonyl), a cyano group, a nitro group, a dialkylphosphono group (e.g., dimethylphosphono), a diarylphosphono group (e.g., diphenylphosphono), a dialkoxyphosphoryl group (e.g., dimethoxyphosphoryl), a diarylphosphinyl group (e.g., diphenylphosphinyl), an alkylsulfinyl group (e.g., 3-phenoxypropylsulfinyl), an arylsulfinyl group (e.g., 3-pentadecylphenylsulfinyl), an alkylsulfonyl group (e.g., methanesulfonyl, octanesulfonyl), an arylsulfonyl group (e.g., benzenesulfonyl, toluenesulfonyl), a sulfonyloxy group (e.g., methanesulfonyloxy, toluenesulfonyloxy), an acylthio group (e.g., acetylthio, benzoylthio), a sulfamoyl group (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a thiocyanate group, a thiocarbonyl group (e.g., methylthiocarbonyl, phenylthiocarbonyl), a halogenated alkyl group (e.g., trifluoromethyl, heptafluoropropyl), a halogenated alkoxy group (e.g., trifluoromethyloxy), a halogenated aryloxy group (e.g., pentafluorophenyloxy), a halogenated alkylamino group (e.g., N,N-di(trifluoromethyl)amino), a halogenated alkylthio group (e.g., difluoromethylthio, 1,1,2,2-tetrafluoroethylthio), an aryl group substituted by another electron-attractive group having a up value of 0.20 or more (e.g., 2,4-dinitrophenyl, 2,4,6-trichlorophenyl, pentachlorophenyl), a heterocyclic group (e.g., 2-benzoxazolyl, 2-benzothiazolyl, 1-phenyl-2-benzimidazolyl, pyrazolyl, 5-chloro-1-tetrazolyl, 1-pyrrolyl), a halogen atom (e.g., chlorine, bromine), an azo group (e.g., phenylazo) or a selenocyanate group.

Representative electron-attractive groups have a σp value as follows: a cyano group (0.66), a nitro group (0.78), a trifluoromethyl group (0.54), an acetyl group (0.50), a trifluoromethanesulfonyl group (0.92), a methanesulfonyl group (0.72), a benzenesulfonyl group (0.70), a methanesulfinyl group (0.49), a carbamoyl group (0.36), a methoxycarbonyl group (0.45), a pyrazolyl group (0.37), a methanesulfonyloxy group (0.36), a dimethoxyphosphoryl group (0.60), a sulfamoyl group (0.57).

$R_{21}$, $R_{22}$ and $R_{23}$ each is preferably an acyl group, an acyloxy group, a carbamoyl group, an alkoxycarbonyl group, an aryloxycarbonyl group, a cyano group, a nitro group, an alkylsulfinyl group, an arylsulfinyl group, an alkylsulfonyl group, an arylsulfonyl group, a sulfamoyl group, a halogenated alkyl group, a halogenated alkyloxy group, a halogenated alkylthio group, a halogenated aryloxy group, a halogenated aryl group, an aryl group substituted by two or more nitro groups or a heterocyclic group, more preferably an acyl group, an alkoxycarbonyl group, an aryloxycarbonyl group, a nitro group, a cyano group, an arylsulfonyl group, a carbamoyl group or a halogenated alkyl group, still more preferably a cyano group, an alkoxycarbonyl group, an aryloxycarbonyl group or a halogenated alkyl group, and particularly preferably a cyano group, a fluorinated alkyl group, a sulfamoyl group or an alkoxycarbonyl group.

A preferred combination of $R_{21}$ and $R_{22}$ is such that $R_{21}$ is a cyano group and $R_{22}$ is a fluorinated alkyl group or an alkoxycarbonyl group, preferably an alkoxycarbonyl group having a branched alkyl chain or an alkoxycarbonyl group having a cyclic alkyl chain, more preferably an alkoxycarbonyl group having a cyclic alkyl chain.

$R_{24}$ represents a hydrogen atom or a substituent (including an atom) and examples of the substituent include a halogen atom, an aliphatic group, an aryl group, a heterocyclic group, an alkoxy group, an aryloxy group, a heterocyclic oxy group, an alkyl-, aryl- or heterocyclic thio group, an acyloxy group, a carbamoyloxy group, a silyloxy group, a sulfonyloxy group, an acylamino group, an alkylamino group, an arylamino group, a ureido group, a sulfamoylamino group, an alkenyloxy group, a formyl group, an alkyl-, aryl- or heterocyclic acyl group, an alkyl-, aryl- or heterocyclic sulfonyl group, an alkyl-, aryl- or heterocyclic sulfinyl group, an alkyl-, aryl- or heterocyclic oxycarbonyl group, an alkyl-, aryl- or heterocyclic oxycarbonylamino group, a sulfonamido group, a carbamoyl group, a sulfamoyl group, a phosphonyl group, a sulfamido group, an imido group, a hydroxy group, a cyano group, a carboxyl group, a nitro group, a sulfo group and an unsubstituted amino group. The alkyl group, aryl group or heterocyclic group contained in these groups each may be further substituted by a substituent exemplified for $R_{24}$.

More specifically, $R_{24}$ is a hydrogen atom, a halogen atom (e.g., chlorine, bromine), an aliphatic hydrocarbon group (e.g., a linear or branched alkyl group having from 1 to 36 carbon atoms, an aralkyl group, an alkenyl group, an alkynyl group), an alicyclic hydrocarbon residue (e.g., a cycloalkyl group, a cycloalkenyl group, and specific examples thereof include methyl, ethyl, propyl, isopropyl, t-butyl, tridecyl, 2-methanesulfonylethyl, 3-(3-pentadecylphenoxy)propyl, 3-{4-{2-[4-(4-hydroxyphenylsulfonyl)phenoxy] dodecaneamido}phenyl}-propyl, 2-ethoxytridecyl, trifluoromethyl, cyclopentyl and 3-(2,4-di-t-amylphenoxy)propyl , an aryl group (preferably having from 6 to 36 carbon atoms, e.g., phenyl naphthyl, 4-hexadecyloxyphenyl, 4-t-butylphenyl, 2,4-di-t-amylphenyl, 4-tetradecaneamidophenyl, 3-(2,4-tert-amylphenoxyacetamido)phenyl a heterocyclic group (e.g., 3-pyridyl, 2-furyl, 2-thienyl, 2-pyridyl, 2-pyrimidinyl, 2-benzothiazolyl), an alkoxy group (e.g., methoxy, ethoxy, 2-methoxyethoxy, 2-dodecyloxyethoxy, 2-methanesulfonylethoxy), an aryloxy group (e.g., phenoxy, 2-methylphenoxy, 4-tert-butylphenoxy, 2,4-di-tert-amylphenoxy, 2-chlorophenoxy, 4-cyanophenoxy, 3-nitrophenoxy, 3-t-butyloxycarbamoylphenoxy, 3-methoxycarbamoylphenoxy), an alkyl-, aryl- or heterocyclic thio group (e.g., methylthio, ethylthio, octylthio, tetradecylthio, 2-phenoxyethylthio, 3-phenoxypropylthio, 3-(4-tert-butylphenoxy)propylthio, phenylthio, 2-butoxy-5-tert-octylphenylthio, 3-pentadecylphenylthio, 2-carboxyphenylthio, 4-tetradecaneamidophenylthio, 2-benzothiazolylthio, 2,4-di-phenoxy-1,3,4 -triazole-6-thio, 2-pyridylthio), an acyloxy group (e.g., acetoxy, hexadecanoyloxy), a carbamoyloxy group (e.g., N-ethylcarbamoyloxy, N-phenylcarbamoyloxy), a silyloxy group (e.g., a trimethylsilyloxy, dibutylmethylsilyloxy), a sulfonyloxy group (e.g., dodecylsulfonyloxy), an acylamino group (e.g., acetamido, benzamido, tetradecaneamido, 2-(2,4-tert-amylphenoxy)acetamido, 2-[4-(4-hydroxyphenylsulfonyl)phenoxy)]decaneamido, isopentadecaneamido, 2-(2,4-di-t-amylphenoxy)butaneamido, 4-(3-t-butyl-4-hydroxyphenoxy)butaneamido), an alkylamino group (e.g., methylamino, butylamino, dodecylamino, dimethylamino, diethylamino, methylbutylamino), an arylamino group (e.g., phenylamino, 2-chloroanilino, 2-chloro-5-tetradecaneamidoanilino, N-acetylanilino, 2-chloro-5-[α-2-tert-butyl-4-hydroxyphenoxy)dodecaneamido]anilino, 2-chloro-5-dodecyloxycarbonylanilino), a ureido group (e.g., methylureido, phenylureido, N,N-dibutylureido, dimethylureido), a sulfamoyl amino group (e.g., N,N-dipropylsulfamoylamino, N-methyl-N-decylsulfamoylamino), an alkenyloxy group (e.g., 2-propenyloxy), a formyl group, an alkyl-, aryl- or heterocyclic acyl group (e.g., acetyl, benzoyl, 2,4-di-tert-amylphenylacetyl, 3-phenylpropanoyl, 4-dodecyloxybenzoyl), an alkyl-, aryl- or heterocyclic sulfonyl group (e.g., methanesulfonyl, octanesulfonyl, benzenesulfonyl, toluenesulfonyl), an alkyl-, aryl- or heterocyclic sulfinyl group (e.g., octanesulfinyl, dodecanesulfinyl, phenylsulfinyl, 3-pentadecylphenylsulfinyl, 3-phenoxypropylsulfinyl), an alkyl, aryl- or heterocyclic oxycarbonyl group (e.g., methoxycarbonyl, butoxycarbonyl, dodecyloxycarbonyl, octadecyloxycarbonyl, phenyloxycarbonyl, 2-pentadecyloxycarbonyl), an alkyl-, aryl- or heterocyclic oxycarbonylamino group (e.g., methoxycarbonylamino, tetradecyloxycarbonylamino, phenoxycarbonylamino, 2,4-di-tert-butylphenoxycarbonylamino), a sulfonamido group (e.g., methanesulfonamido, hexadecanesulfonamido, benzenesulfonamido, p-toluenesulfonamido, octadecanesulfonamido, 2-methoxy-5-tert-butylbenzenesulfonamido), a carbamoyl group (e.g., N-ethylcarbamoyl, N,N-dibutylcarbamoyl, N-(2-dodecyloxyethyl)carbamoyl, N-methyl-N-dodecylcarbamoyl, N-[3-(2,4-di-tert-amylphenoxy)propyl]carbamoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl), a phosphonyl group (e.g., phenoxyphosphonyl, octyloxyphosphonyl, phenylphosphonyl), a sulfamido group (e.g., dipropylsulfamoylamino), an imido group (e.g., N-succinimido, hydantoinyl, N-phthalimido, 3-octadecenylsuccinimido), a hydroxy group, a cyano group, a carboxyl group, a nitro group, a sulfo group or an unsubstituted amino group.

$R_{24}$ is preferably an alkyl group, an aryl group, a heterocyclic group, a cyano group, a nitro group, an acylamino group, an arylamino group, a ureido group, a sulfamoylamino group, an alkylthio group, an arylthio group, a heterocyclic thio group, an alkoxycarbonylamino group, an aryloxycarbonylamino group, a sulfonamido group, a carbamoyl group, a sulfamoyl group, a sulfonyl group, an alkoxycarbonyl group, an aryloxycarbonyl group, a heterocyclic oxy group, an acyloxy group, a carbamoyloxy group, an imido group, a sulfinyl group, a phosphonyl group, an acyl group or an azolyl group, more preferably an alkyl group or an aryl group, still more preferably an alkyl or aryl group having as a substituent at least one alkoxy group, sulfonyl group, sulfamoyl group, carbamoyl group, carbonamido group or sulfonamido group, still further preferably an aryl group having an alkoxy group or an alkylamino group at the orth position. In the alkoxy group, the structure in the moiety linking to the oxygen atom is a linear alkyl group, a branched alkyl group, a cyclic alkyl group or a substituted alkyl group and specific examples thereof include methyl, ethyl, isopropyl, hexyl, 2-ethylhexyl, octyl and benzyl 2,6-dimethylcyclohexyl but it is by no means limited to these. The alkylamino group may be either a monoalkylamino group or a dialkylamino group. The alkyl group may be either linear or branched or may have a substituent and specific examples thereof include a monomethylamino group, a dimethylamino group, a diethylamino group and a diisopropylamino group, but it is by no means limited to these. The aryl group having an alkoxy or alkylamino group at the ortho position may have further another substituent and examples of the substituent include an acylamino group, a sulfonylamino group and a halogen atom.

X in formula (C-I) represents a group split off on the reaction of the coupler with an oxidation product of an aromatic primary amine color developing agent (hereinafter referred to a "splitting-off group") and examples of the splitting-off group include a halogen atom, an aromatic azo group, an alkyl, aryl, heterocyclic, alkyl- or arylsufonyl, arylsulfinyl, alkoxy- or aryloxy, heterocyclic oxycarbonyl, alkyl-, aryl- or heterocyclic carbonyl or alkyl-, aryl- or heterocyclic aminocarbonyl group bonded to the coupling site through an oxygen, nitrogen, sulfur or carbon atom and a heterocyclic group bonded to the coupling site by the nitrogen atom in the heterocyclic ring, such as a halogen atom, an alkoxy group, an aryloxy group, an acyloxy group, an alkyl- or arylsulfonyloxy group, an acylamino group, an alkyl- or arylsulfonamido group, an alkoxycarbonyloxy group, an aryloxycarbonyloxy group, an alkyl-, aryl- or heterocyclic thio group, a carbamoyl group, an arylsulfinyl group, an arylsulfonyl group, a 5- or 6-membered nitrogen-containing heterocyclic group, an imido group and an arylazo group. The alkyl, aryl or heterocyclic group contained in these splitting-off group may further be substituted by a substituent described for $R_{24}$ and when two or more substituents are present, they may be the same or different and they may also be substituted by a substituent described for $R_{24}$.

More specifically, the splitting-off group is a halogen atom (e.g., fluorine, chlorine, bromine), an alkoxy group (e.g., ethoxy, dodecyloxy, methoxyethylcarbamoylmethoxy, carboxypropyloxy, methylsulfonylethoxy, ethoxycarbonylmethoxy), an aryloxy group (e.g., 4-methylphenoxy, 4-chlorophenoxy, 4-methoxyphenoxy, 4-carboxyphenoxy, 3-ethoxycarboxyphenoxy, 3-acetylaminophenoxy, 2-carboxyphenoxy), a heterocyclic oxy group (e.g., 5-phenyltetrazolyloxy, 2-benzothiazolyloxy), an alkyl-, aryl- or heterocyclic acyloxy group (e.g., acetoxy, tetradecanoyloxy, benzoyloxy), an alkyl-, aryl- or heterocyclic sulfonyloxy group (e.g., methanesulfonyloxy, toluenesulfonyloxy), a dialkyl- or diarylphosphonooxy group (e.g., diethylphosphonooxy, diphenylphosphonooxy), a dialkyl- or diarylphosphinooxy group (e.g., dimethylphosphinooxy), an alkyl-, aryl- or heterocyclic sulfonyl group (e.g., toluenesulfonyl, methanesulfonyl, tetrazolylsulfonyl), an alkyl-, aryl- or heterocyclic sulfinyl group (e.g., phenylsulfinyl, i-propylsulfinyl, tetrazolylsulfinyl), an alkyl-, aryl- or heterocyclic acylamino group (e.g., dichloroacetylamino, heptafluorobutyrylamino), an alkyl, aryl- or heterocyclic sulfonamido group (e.g., methanesulfonamido, trifluoromethanesulfonamido, p-toluenesulfonamido), an alkoxycarbonyloxy group (e.g., ethoxycarbonyloxy, benzyloxycarbonyloxy), an aryloxycarbonyloxy group (e.g., phenoxycarbonyloxy), an alkyl-, aryl- or heterocyclic thio group (e.g., ethylthio, 2-carboxyethylthio, dodecylthio, 1-carboxydodecylthio, phenylthio, perfluorophenylthio, 2-butoxy-5-t-octylphenylthio, tetrazolylthio), a carbamoylamino group (e.g., N-methylcarbamoylamino, N-phenylcarbamoylamino), a 5- or 6-membered nitrogen-containing heterocyclic group bonded to the coupling site by the nitrogen atom (e.g., imidazolyl, pyrazolyl, triazolyl, tetrazolyl, 1,2-dihydro-2-oxo-1-pyridyl), an imido group (e.g., succinimido, hydantoinyl) or an arylazo group (e.g., phenylazo, 4-methoxyphenylazo). These groups may be of course substituted by a substituent described for $R_{24}$. The splitting-off group bonded via a carbon atom includes a bis- form coupler obtained by condensing a four-equivalent coupler with an aldehyde or a ketone. The splitting-off group of the present invention may contain a photographically useful group such as a development inhibitor and a development accelerator.

X is preferably a halogen atom, an alkoxy group, an aryloxy group, an alkyl- or aryl thio group, or a 5- or 6-membered nitrogen-containing heterocyclic group bonded to the coupling active site by the nitrogen atom, more preferably a halogen atom, still more preferably a chlorine atom.

The cyan coupler represented by formula (C-I) may form a dimer or greater polymer where the $R_{21}$, $R_{22}$, $R_{23}$, $R_{24}$ or X group contains a cyan coupler residue represented by (C-I) or may form a homopolymer or copolymer wherein $R_{21}$, $R_{22}$, $R_{23}$, $R_{24}$ or X group contains a polymer chain. A typical example of the homopolymer or copolymer having a polymer chain is a homo- or copolymer of an addition-polymerizable ethylenic unsaturated compound having a cyan coupler residue represented by formula (C—I). In this case, the polymer may contain one or more cyan color-forming repeating unit having a cyan coupler residue represented by formula (C—I) or the copolymer may contain one or more non-color-forming ethylenic monomer incapable of coupling with an oxidation product of an aromatic primary amine developing agent as a copolymer component, such as an acrylic ester, a methacrylic ester or a maleic acid ester.

Specific examples of the coupler of the present invention are described below, but the present invention is by no means limited to these.

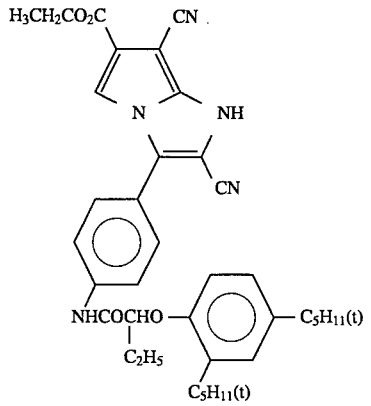

C-1

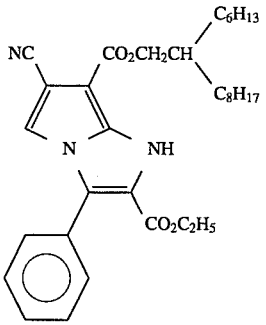

C-2

-continued
C-3
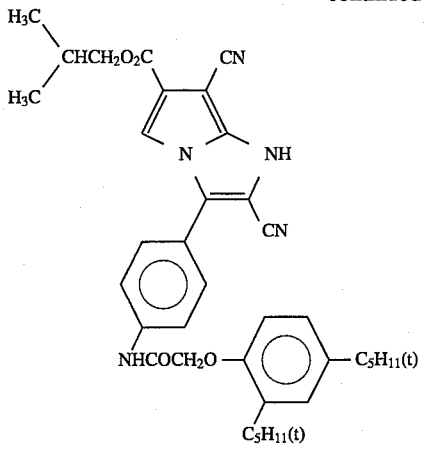
C-4
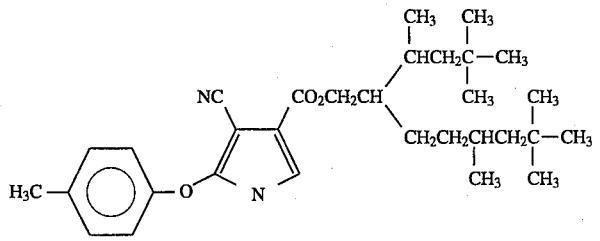
C-5
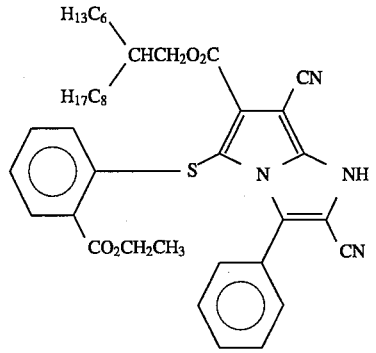
C-6
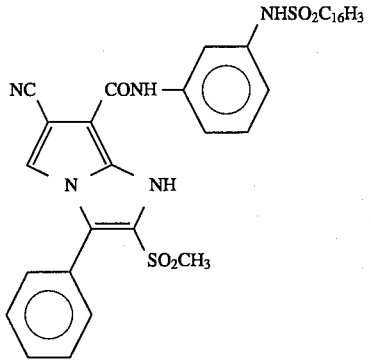

-continued
C-7
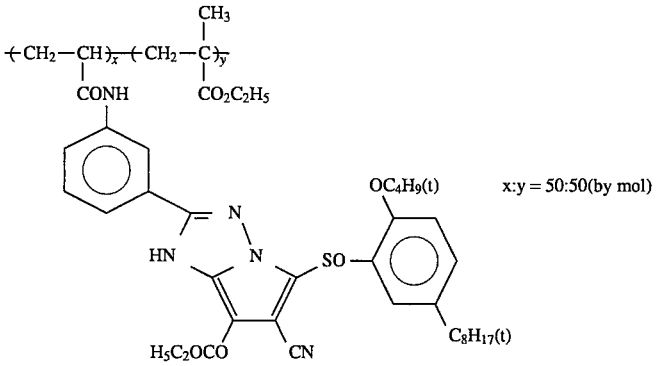
x:y = 50:50(by mol)

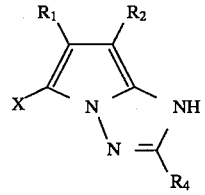
| No. | $R_1$ | $R_2$ | $R_4$ | X |
|---|---|---|---|---|
| C-8 | $CO_2CH_3$ | CN | 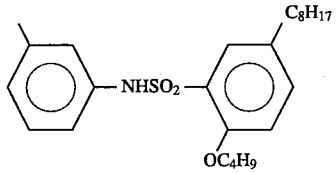  | H |
| C-9 | CN | 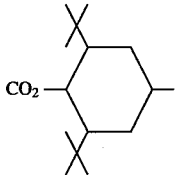  | 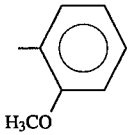  | H |
| C-10 | CN | 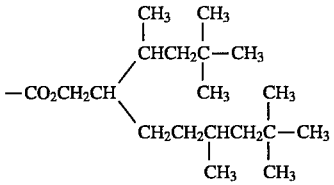  | 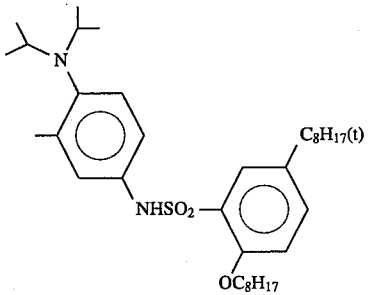  | H |
| C-11 | CN | 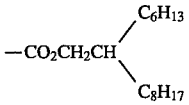  | 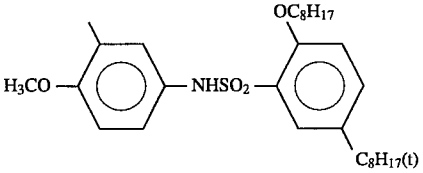  | Cl |

-continued
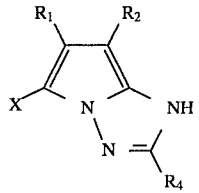
| No. | $R_1$ | $R_2$ | $R_4$ | X |
|---|---|---|---|---|
| C-12 | CN | 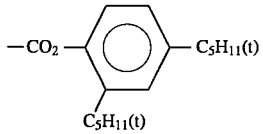 | 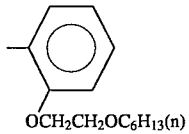 | H |
| C-13 | CN | 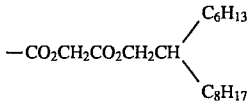 | 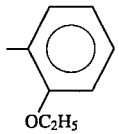 | Cl |
| C-14 | CN | 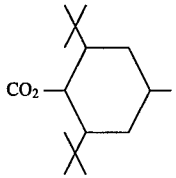 | 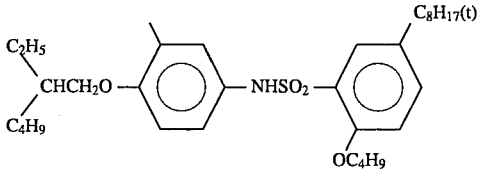 | Cl |
| C-15 | CN | 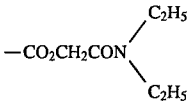 | 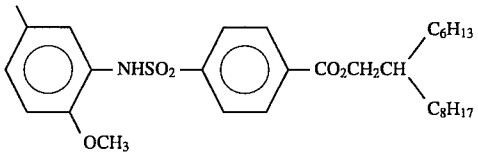 | 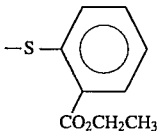 |
| C-16 | CN | $-CO_2CH_2CH_2(CF_2)_6F$ | 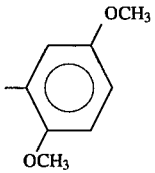 | 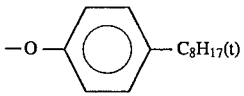 |

-continued
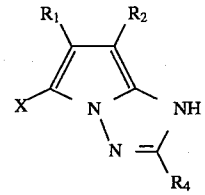
| No. | $R_1$ | $R_2$ | $R_4$ | X |
|---|---|---|---|---|
| C-17 | CN | 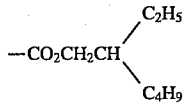 | 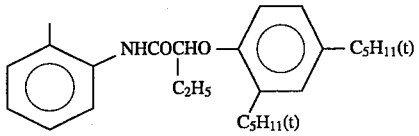 | 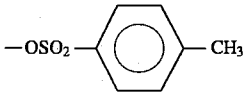 |
| C-18 | CN | 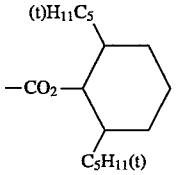 | 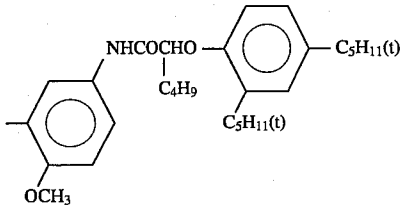 | 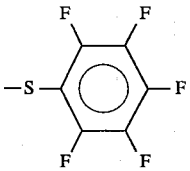 |
| C-19 | CN | 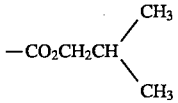 | 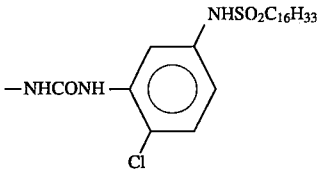 | 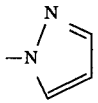 |
| C-20 | CN | $-CO_2CH_2(CF_2)_4H$ | 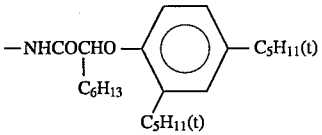 | 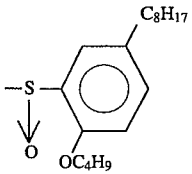 |

-continued
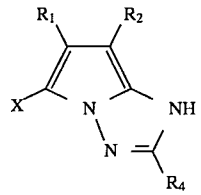
| No. | $R_1$ | $R_2$ | $R_4$ | X |
|---|---|---|---|---|
| C-21 | CN | $-CO_2CH_2CH(C_8H_{17})(C_6H_{13})$ | 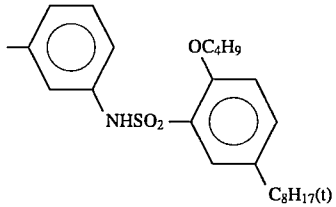 | Cl |
| C-22 | 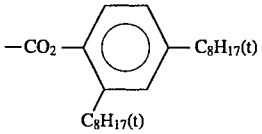 | CN | $-C(CH_3)_3$ | 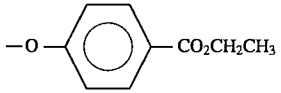 |
| C-23 | $-CO_2CH_2C_6F_{13}$ | CN | 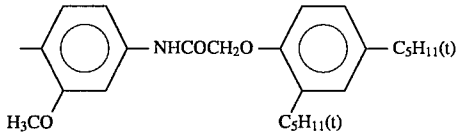 | Cl |
| C-24 | 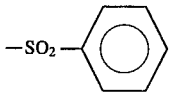 | 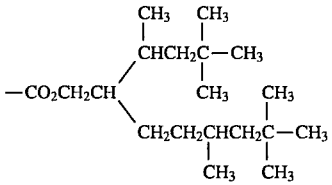 | $CH_3$ | $-OCOCH_3$ |
| C-25 | CN | $-CO_2CH_2CO_2CH_3$ | 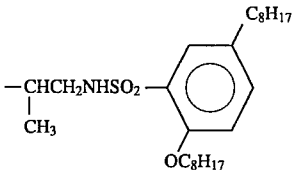 | 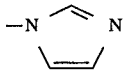 |

-continued
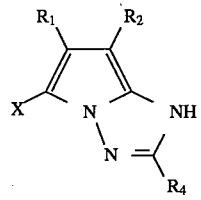
| No. | $R_1$ | $R_2$ | $R_4$ | X |
|---|---|---|---|---|
| C-26 | CN | 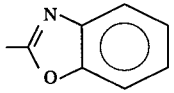 | 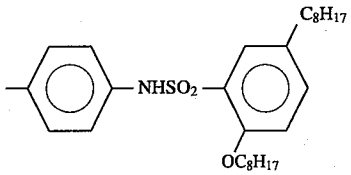 | 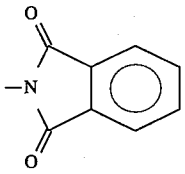 |
| C-27 | CN | 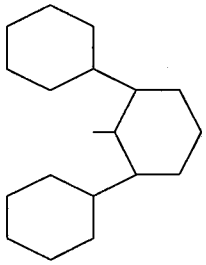 | 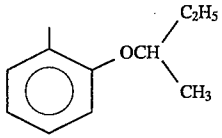 | Cl |
| C-28 | 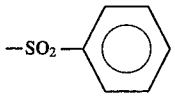 | $CF_3$ | 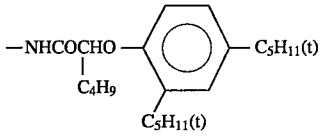 | F |
| C-29 | CN | 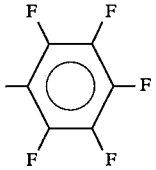 | 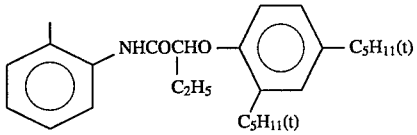 | 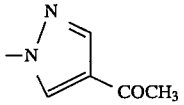 |

-continued
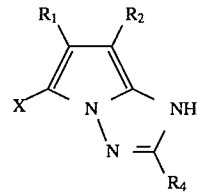
| No. | $R_1$ | $R_2$ | $R_4$ | X |
|---|---|---|---|---|
| C-30 | 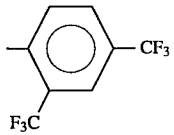 | 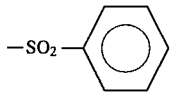 | 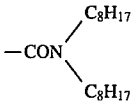 | 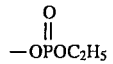 |
| C-31 | CN | 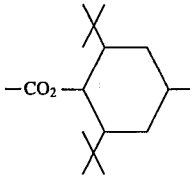 | 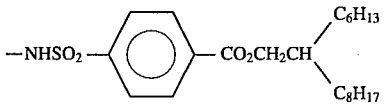 | 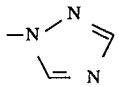 |
| C-32 | CN | 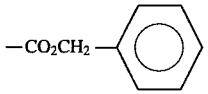 | 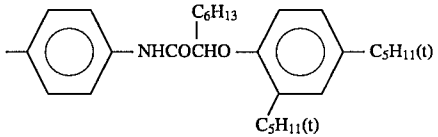 | H |
| C-33 | CN | 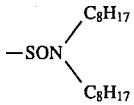 | 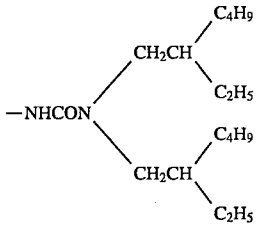 | $-OSO_2CH_3$ |

-continued
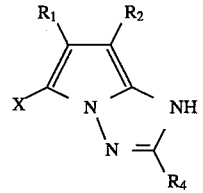
| No. | $R_1$ | $R_2$ | $R_4$ | X |
|---|---|---|---|---|
| C-34 | CN | $-COOC_{14}H_{29}$(sec) | 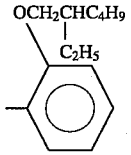  | Cl |
| C-35 | CN | 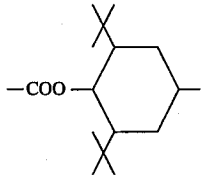  | 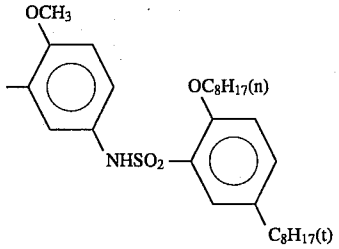  | Cl |
| C-36 | CN | 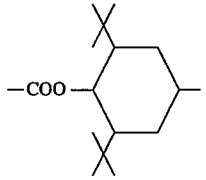  | 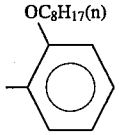  | Cl |
| C-37 | CN | 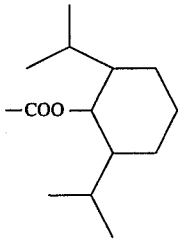  | 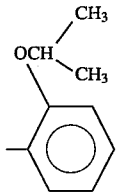  | Cl |

-continued
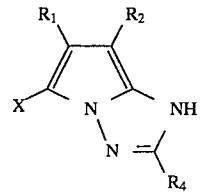
| No. | $R_1$ | $R_2$ | $R_4$ | X |
|---|---|---|---|---|
| C-38 | CN | 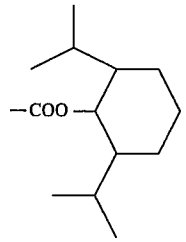 | 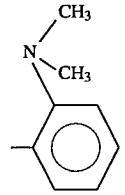 | Cl |
| C-39 | CN | 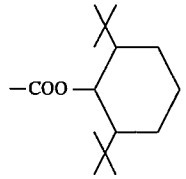 | 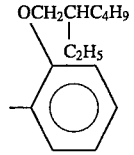 | Cl |
| C-40 | CN | 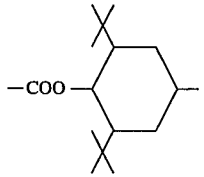 | 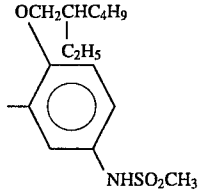 | Cl |

-continued
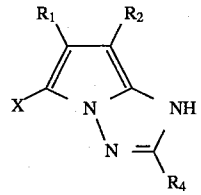
| No. | $R_1$ | $R_2$ | $R_4$ | X |
|---|---|---|---|---|
| C-41 | CN | 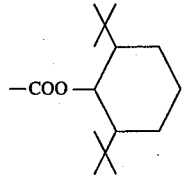 | 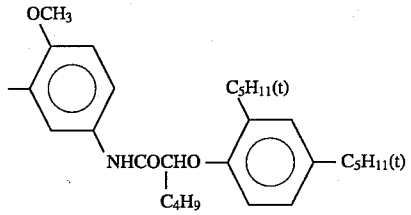 | 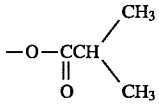 |
| C-42 | CN | 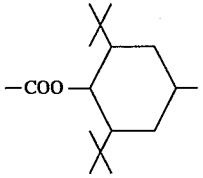 | 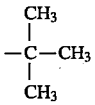 | Cl |
| C-43 | CN | 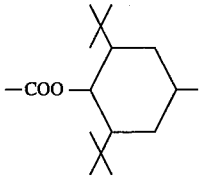 | 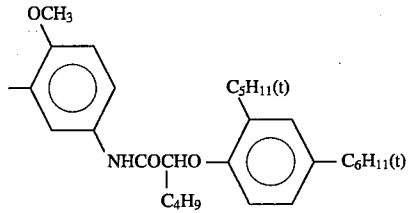 | Cl |
| C-44 | CN | 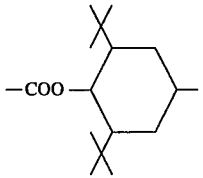 | 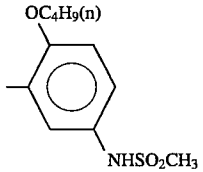 | Cl |

-continued
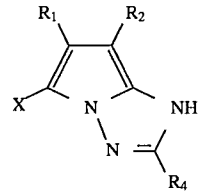
| No. | $R_1$ | $R_2$ | $R_4$ | X |
|---|---|---|---|---|
| C-45 | CN | 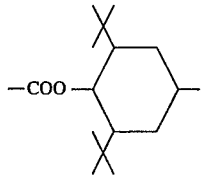  | 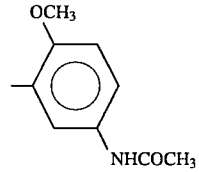  | Cl |

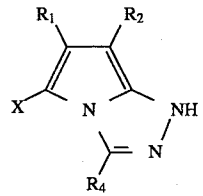
| No. | $R_1$ | $R_2$ | $R_4$ | X |
|---|---|---|---|---|
| C-46 | $-CO_2C_2H_5$ | CN | 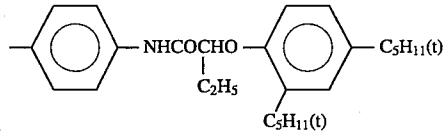 | Cl |
| C-47 | CN | 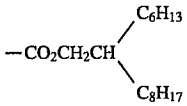 | 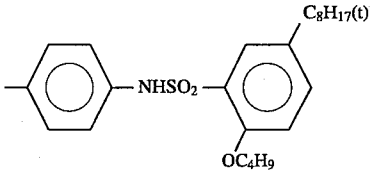 | H |
| C-48 | CN | $-CO_2CH_2CH_2(CF_2)_6F$ | 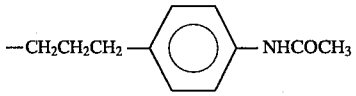 | 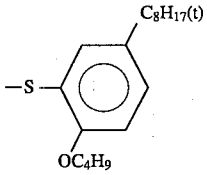 |
| C-49 | CN | 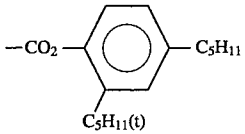 | 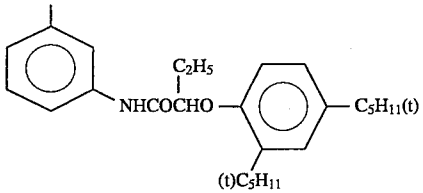 | 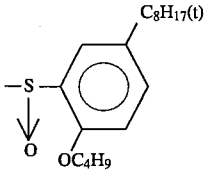 |

-continued
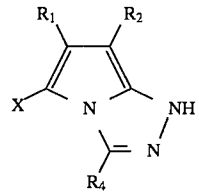
| No. | $R_1$ | $R_2$ | $R_4$ | X |
|---|---|---|---|---|
| C-50 | CN | 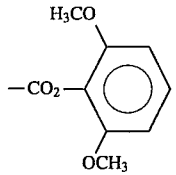 | 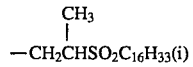 | 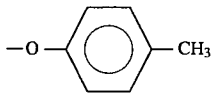 |
| C-51 | CN | 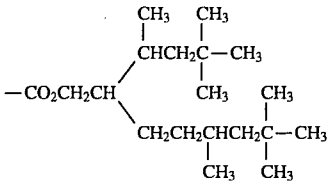 | 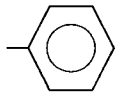 | H |
| C-52 | CN | 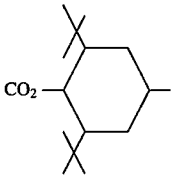 | 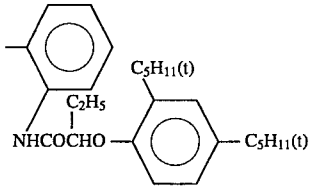 | Cl |
| C-53 | CN | 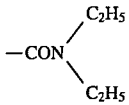 | 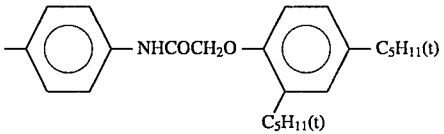 | $-OSO_2CH_3$ |

C-54

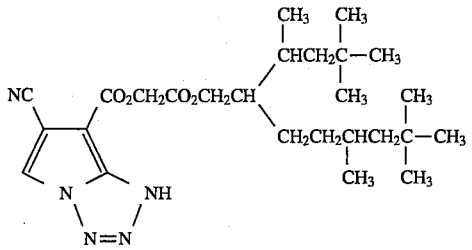

C-55

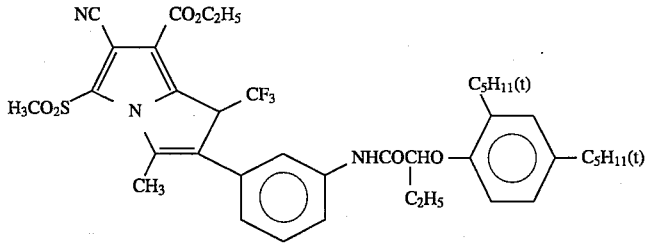

C-56

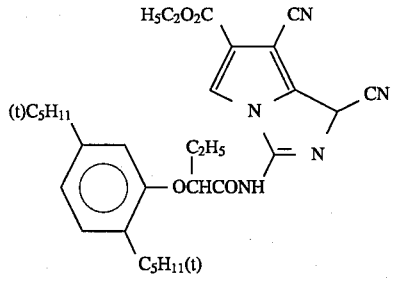

C-57

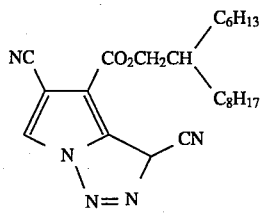

C-58

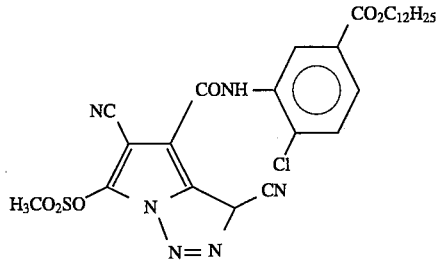

The compound of the present invention or an intermediate thereof can be synthesized according to known methods, for example, methods described in *J. Am. Soc.*, No. 80, 5332 (1958), *J. Am. Chem. Soc.*, No. 81, 2452 (1959), *J. Am. Chem. Soc.*, No. 112, 2465 (1990), *Org. Synth., I*, 270 (1941), *J. Chem. Soc.*, 5149 (1962), *Heterocycles.*, No. 27, 2301 (1988), *Rec. Tray. Chim.*, 80, 1075 (1961) or literatures cited therein or methods analogous thereto.

The use amount of the cyan dye-forming coupler represented by formula (C—I) of the present invention is preferably in the range from 0.01 to 10 mmol/m$^2$, more preferably from 0.05 to 5 mmol/m$^2$, most preferably 0.1 to 2 mmol/m$^2$.

If the use amount of the cyan dye-forming coupler represented by formula (C—I) is less than 0.01 mmol/m$^2$, a necessary coloring density can hardly be obtained, whereas if it exceeds 10 mmol/m$^2$, an disadvantageous effect arises in view of the cost.

A specific synthesis example is described below.

SYNTHESIS EXAMPLE 1

Preparation of Compound (9)

Compound (9) was synthesized through the following route:

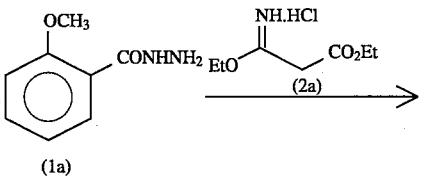

-continued

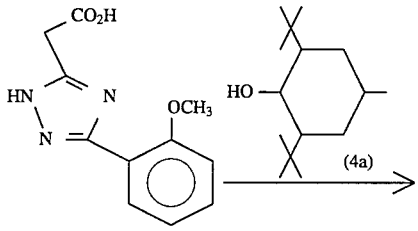

(3a)

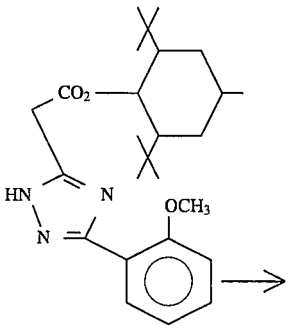

(5a)

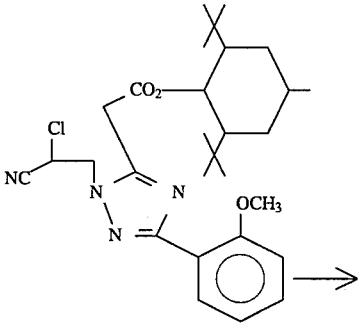

(6a)

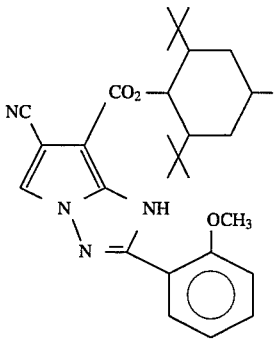

C-9

To 42.3 g of Compound (2a) in 250 ml of an ethanol solution, 45 ml of sodium methoxide (28% methanol solution) was added under ice cooling followed by further addition of 34.7 g of Compound (1a) and then heated under reflux for 2 hours. After the reaction, 500 ml of ethyl acetate was added thereto and washed with water. The ethyl acetate layer was dried over magnesium sulfate and removed by distillation and the residue was recrystallized in an ethyl acetate-hexane system (yield: 62%). 36.8 g of the resulting crystal was suspended in 400 ml of water and thereto 8.4 g of sodium hydroxide was added. The inner temperature was kept at 80° C. and after heating for about 4 hours, the product was neutralized by a hydrochloric acid solution and crystallized (yield: 80%). 2.1 g of the resulting crystal (3a) was dissolved in 30 ml of acetonitrile and thereto 2.5 g of Compound (4a) and 1.6 ml of trifluoroacetic anhydride were added under ice cooling. After stirring for 2 hours, the crystal produced was filtered to obtain Compound (5a) (yield: 77%).

3.1 g of Compound (5a) obtained above was dissolved in 20 ml of dimethylformamide and 5 ml of methanol and thereto 3.1 g of 2-chloroacetonitrile was added. Further, thereto 0.4 g of 1,1,3,3-tetramethylguanidine was added under ice cooling and stirred for 2 hours.

After the reaction, 50 ml of ethyl acetate was added thereto and washed with water. After the extraction, the organic layer was dried to remove ethyl acetate by distillation. The residue was purified by a silica gel chromatography to obtain 2.0 g of Compound (6a) (yield 55.0%).

2.0 g of Compound (6a) obtained was dissolved in 20 ml of tetrahydrofuran and thereto 1.2 g of pyridinium perbromide was added, followed by stirring at room temperature. After the reaction, 50 ml of ethylacetate was added thereto and washed with water. The ethyl acetate layer was removed by distillation after drying and to the resulting residue, 20 ml of dimethylformamide was added. While keeping the reaction temperature at −15° C., 1.5 g of 1,1,3,3-tetramethylguanidine was gradually dropwise added. After the reaction, 50 ml of ethyl acetate was added thereto and the mixture was washed with water. The ethyl acetate layer was removed after drying and the residue was purified by a silica gel chromatography to obtain 0.56 g of objective Compound (9) (yield: 30%). The melting point was from 210° to 212° C.

In the light-sensitive material of the present invention, it is necessary that the total coated amount of oil-soluble components contained in the photographic constituent layers above the silver halide emulsion layer nearest to the support is 3.5 g/m$^2$ or less.

The "total coated amount of coated oil-soluble components contained in the photographic constituent layers above the silver halide emulsion layer nearest to the support" as used herein means the total coated amount of photographic organic additives and water-insoluble high boiling point organic solvents therefor contained in the hydrophilic colloid layers in the form of a dispersion dissolved in the solvent. Specifically, the element includes a color dye-forming coupler, a color image stabilizer, a color mixing inhibitor, an ultraviolet absorbent, a coloration accelerator and a high boiling point organic solvent. In other words, the water-insoluble particles dispersed and contained in hydrophilic colloid layers in the form of fine oil droplets must be designed to be present in a total amount of 3.5 g or less per m$^2$.

In the light-sensitive material of the present invention, the total coated amount of oil-soluble components contained in photographic constituent layers above the silver halide emulsion layer nearest to the support is preferably 3.4 g/m$^2$ or less, more preferably 3.3 g/m$^2$ or less, still more preferably 3.0 g/m$^2$ or less. The lower limit is determined from the viewpoint whether an adequate coloring density can be obtained and sufficient color mixing inhibition and discoloration inhibition can be attained. One of standard values is 1.0 g/m$^2$ or more.

If the total amount of the coated oil-soluble components exceeds 3.5 g/m$^2$, the aptitude for a rapid processing is disadvantageously impaired.

If the total coated amount of the oil-soluble components is 3.5 g/m$^2$ or less, a rapid processing may be feasible but only with the reduction in the coated amount of oil-soluble components, the fastness to light of the color image formed is worsened. The aptitude for a rapid processing and fastness to light, and also the storage stability of the white background of prints can be first satisfied when the magenta dye-forming coupler of the present invention is used in combination.

By using at least one cyan coupler represented by formula (C—I) (hereinafter referred to as the cyan coupler of the present invention) as the cyan dye-forming coupler of the present invention, a light-sensitive material more suitable for a rapid processing can be provided. In other words, for imparting the aptitude for rapid processing, it is surely advantageous to reduce more and more the coated amount of oil-soluble components contained in photographic constituent layers above the silver halide emulsion layer nearest to the support to increase the development processing speed, however, the reduction in the coated amount of oil-soluble components in silver halide emulsion layers unavoidably involves the reduction in the amount of couplers or coupler solvents, whereby the maintenance of necessary color density is limited. By using the cyan coupler of the present invention, a high coloring density can be obtained and the development rate can be made faster even with a small coated amount of oil-soluble components.

The light-sensitive material of the present invention comprises a support having provided thereon at least one yellow dye-forming silver halide emulsion layer, at least one magenta dye-forming silver halide emulsion layer and at least one cyan dye-forming silver halide emulsion layer. The light-sensitive material of the present invention is suitably used as a color printing paper. The light-sensitive material can have such a construction, similarly to general light-sensitive materials for color printing which is described above, as that a yellow dye-containing blue-sensitive emulsion layer, a magenta dye-containing green-sensitive emulsion layer and a cyan dye-forming red-sensitive emulsion layer are provided in this order on the support, where a dye-forming coupler in a complementary relation to the color of light in the wavelength region to which each light-sensitive emulsion layer is sensitive is used in combination, and also may comprise a different combination from this. More specifically, a yellow dye-forming coupler, a magenta dye-forming coupler and a cyan dye-forming coupler can be freely used in combination in a plurality of emulsion layers capable of color separation and sensitized to at least three different wavelength regions. In the case of exposure of a color print using a normal negative film, the former construction in a complementary relation is indispensable but the order for application onto the support can be changed. Namely, in order to increase the development processing speed, a light-sensitive layer containing silver halide emulsion grains having the largest average grain size may be provided as the uppermost layer or in order to enhance the fastness of a dye image under light irradiation, a magenta dye-forming coupler-containing layer may be provided as the lowermost layer. In the case where a light-sensitive material for printing is subjected to scan exposure by means of LED or a laser source having at least three different wavelengths with an output modulated according to the image information, a free combination as in the latter can be employed. In this case, the wavelength region of sensitive light may be established at the infrared region.

The light-sensitive material of the present invention may comprise, in addition to the above-described dye image forming layers, a color-mixing inhibitory interlayer, an ultraviolet absorbent-containing light-insensitive layer or an antihalation layer in combination.

The support for use in the present invention may be any support as long as it is a support on which photographic emulsion layers can be provided, such as paper or plastic, and the most preferred is a reflection-type support.

The "reflection-type support" as used in the present invention means the support capable of rendering a dye image formed on the silver halide emulsion layer sharp owing to the increased reflectivity and such a reflection-type support includes those obtained by covering the support with a hydrophobic resin having dispersed therein and containing a light-reflective substance such as titanium oxide, zinc oxide, calcium carbonate or calcium sulfate, or a hydrophobic resin having incorporated therein a disperson of a light-reflective substance itself may be used as the support. Examples thereof include a polyethylene-coated paper, polyethylene terephthalate-coated paper, polypropylene-based synthetic paper, a transparent support provided with a reflection layer or comprising a reflective substance in combination such as a glass plate, a polyester film (e.g., polyethylene terephthalate, cellulose triacetate, cellulose nitrate), a polyamide film, a polycarbonate film, a polystyrene film or a vinyl chloride resin. The reflection-type support used in the present invention is preferably a paper support of which both surfaces are coated with waterproof resin layers, with at least one of waterproof resin layers containing a white pigment fine particles. The white pigment particles are preferably contained at a density of 12 wt % or more, more preferably 14 wt % or more. A support comprising a waterproof resin layer composed of a plurality of layers having different white pigment contents is also preferably used. In this case, a layer having a higher white pigment content is preferably provided near to the upside layer. The light-reflective white pigment particles are preferably prepared by thoroughly kneading a white pigment in the presence of a surface active agent and the surface of pigment particles is preferably treated with a dihydric, trihydric or tetrahydric alcohol.

The white pigment fine particles are preferably dispersed uniformly in the reflection layer without causing aggregate of particles and the size of distribution can be obtained by determining the occupied area ratio (%) (Ri) of fine particles projected per the unit area. The coefficient of fluctuation in the occupied area ratio (%) can be obtained by the ratio s/R where R is an average of Ri and s is the standard deviation of Ri. In the present invention the coefficient of fluctuation in the occupied area ratio (%) of pigment fine particles is preferably 0.15 or less, more preferably 0.12 or less, still more preferably 0.08 or less.

In the present invention, a support having a surface of a second-class diffuse reflection may be used. The second-class diffuse reflection means the diffuse reflectance which is obtained when the specular surface is made uneven to have finely divided specular faces directed toward different directions and the directions of finely divided surface (specular faces) are decentralized. The unevenness on the surface of second-class diffuse reflectance is preferably provided such that the three-dimensional average height to the center plane is from 0.1 to 2 μm, preferably from 0.1 to 1.2 and the frequency of unevenness on the surface (unevenness having a height of 0.1 μm or more) is preferably from 0.1 to 2,000 cycles/mm, more preferably from 50 to 600 cycles/mm. JP-A-2-239244 describes such a support in detail.

In the present invention, at least one of magenta dye-forming layers uses silver halide grains having a silver chloride content of 90 mol % or more and as other silver halide grains, silver chloride, silver chlorobromide or silver chloroiodobromide grains having a silver chloride content of 80 mol % or more are preferably used. In particular, in order to expedite the development processing time, grains composed of silver chlorobromide or silver chloride and substantially free of silver iodide are preferably used in the present invention. The "substantially free of silver iodide" as used herein means that the silver iodide content is 1 mol % or less, preferably 0.2 mol % or less. On the other hand, for the purposes of raising a high illumination sensitivity, enhancing a spectral sensitization sensitivity, or increasing aging stability of the light-sensitive material, high silver chloride grains having a silver iodide content of from 0.01 to 3 mol % may be used on the emulsion surface in some cases as described in JP-A-3-84545. The halide composition of the emulsion may be different or the same among particles but when an emulsion comprising grains having the same halide composition is used, it is easy to homogenize the properties of grains. Also, with respect to the halide composition distribution inside of the silver halide emulsion grain, the grain may have a so-called uniform-type structure where any portion of the silver halide grain has the same composition, the grain may have a so-called laminate-type structure where the halide composition is different between the core inside the silver halide grain and the shell (single layer or a plurality of layers) surrounding the core, or the grain may have such a structure that non-layered portions different in the halide composition are provided inside the grain or on the grain surface (when provided on the grain surface, the portions are conjugated at edges, corners or on planes), and these are appropriately selected depending on the use. For achieving a high sensitivity, either of the latter two cases is advantageously used rather than the grain of uniform-type structure and also preferred in view of pressure stability. When the silver halide grain has either of the above-described structures, the boundary between portions different in the halide composition may be clear, may be ambiguous because of mixed crystals formed due to difference in the composition, or may have sequential structural change provided positively.

The high silver chloride emulsion used in the present invention preferably has such a structure that a silver bromide localized phase of layer or non-layer form is present in the inside and/or on the surface of silver halide grain as described above. In the halide composition of the above-described localized phase, the silver bromide content is preferably at least 10 mol %, more preferably exceeds 20 mol %. The silver bromide content of the silver bromide localized phase can be analyzed according to the X-ray diffraction method (as described, for example, in *Shin-jikken Kagaku Koza* 6, *Kozo-Kaiseki,* compiled by Nippon Kagaku Kai, Maruzen). Such a localized phase can be present at edges, corners or on planes inside the grain or on the surface of the grain and one preferred example is the case where the localized phase is epitaxially grown at a corner of grain.

It is also effective to further increase the silver chloride content of silver halide emulsions so as to reduce the replenishing amount of development processing solution. In this case, an emulsion composed of nearly pure silver chloride as having a silver chloride content of 98 to 100 mol % is preferably used.

The silver halide grain contained in the silver halide emulsion used in the present invention has an average grain size (a number average in the diameter as a grain size of a circle equivalent to the projected area of a grain) of preferably from 0.1 to 2 μm.

The coefficient of fluctuation in the grain size distribution (obtained by dividing the standard deviation of the grain size distribution by the average grain size) is 20% or less, preferably 15% or less, more preferably 10% or less, namely, monodisperse. For the purpose of obtaining a wide latitude, it is also preferred to blend monodisperse emulsions as described above in the same layer or coat the monodisperse emulsions in a superposed fashion.

The silver halide grain contained in the photographic emulsion may have a regular crystal form such as cube, tetradecahedron or octahedron, an irregular crystal form such as spherical or tabular, or a composite form of these. Also, a mixture of grains having various crystal forms may be used. In the present invention, grains having the above-described regular crystal form preferably accounts for 50% or more, more preferably 70% or more, still more preferably 90% or more. An emulsion where the projected area of tabular grains having an average aspect ratio (circle-converted diameter/thickness) of 5 or more, preferably 8 or more, exceeds 50% of that of the total grains can also be preferably used.

The silver chloride/silver chlorobromide emulsion used in the present invention can be prepared according to the methods described in P. Glafkides, *Chimie et Phisique Photographique,* Paul Montel (1967), G. F. Duffin, *Photographic Emulsion Chemistry,* Focal Press (1966) or V. L. Zelikman et al, *Making and Coating Photographic Emulsion,* Focal Press (1964). More specifically, any of acid process, neutral process and ammonia process may be used and the reaction between a soluble silver salt and a soluble halogen salt may be conducted by a single jet method, a double jet method or a combination of these. Also, the grain can be formed in an atmosphere of excess silver ions (so-called reverse mixing method). A so-called controlled double jet method, which is one system of the double jet method, of keeping constant the pAg of the liquid phase where silver halide is formed can also be used. According to this method, the silver halide emulsion obtained can be composed of grains having regular crystal forms and a nearly uniform grain size.

The localized phase or substrate of the silver halide grain of the present invention preferably contains different kinds of metal ions or their complex ions. Preferred metals are selected from metal ions or metal complexes belonging to Group VIII and Group IIb of the Periodic Table, a lead ion and a thallium ion. In the localized phase, ions of iridium, rhodium or iron, complex ions thereof or a combination of these are mainly used and in the substrate, metal ions selected from osmium, iridium, rhodium, platinum, ruthenium, palladium, cobalt, nickel and iron, complex ions thereof or a .combination of these are mainly used. The kind and concentration of the metal ion may be changed between the localized phase and the substrate. Plural kinds of these metals may also be used. In particular, it is preferred that an iridium compound is present in a silver bromide localized phase. In doping an iron compound in the substrate, the compound is preferably doped at a high density in the vicinity of the surface of substrate grain.

The above-described metal ion-providing compound is added to a dispersion medium such as an aqueous gelatin solution, an aqueous halide solution, an aqueous silver salt solution or other aqueous solutions during formation of silver halide grains, or silver halide fine grains having incorporated therein metal ions in advance are added and then the fine grains are dissolved, whereby the metal ions are incorporated into the localized phase and/or other portions of the grain (substrate).

The metal ion used in the present invention can be incorporated into the emulsion grains before grain formation, during grain formation or immediately after grain formation. The time may be changed according to the portion of the grain to which the metal ions are incorporated.

The silver halide emulsion for use in the present invention is usually subjected to chemical sensitization and spectral sensitization.

The chemical sensitization may be performed by effecting chemical sensitization using a chalcogen sensitizer (specifically, sulfur sensitization represented by the addition of an unstable sulfur compound, selenium sensitization using a selenium compound or tellurium sensitization using a terrulium compound), noble metal sensitization represented by gold sensitization, or reduction sensitization, individually or in combination. Preferred examples of the compound for use in the chemical sensitization include those described in JP-A-62-215272, from page 18, right lower column to page 22, right upper column.

The effect provided by the construction of the light-sensitive material of the present invention is outstanding when a high silver chloride emulsion subjected to gold sensitization is used. The emulsion used in the present invention is a so-called surface latent image-type emulsion where a latent image is mainly formed on the grain surface.

The silver halide emulsion for use in the present invention may contain various compounds or precursors thereof for the purpose of preventing fog during preparation, storage or photographic processing of a light-sensitive material, or for stabilizing the photographic performance. Specific and preferred examples of these compounds include those described in JP-A-62-215272, pp. 39–72. The 5-arylamino-1,2,3,4-thiatriazole compound (the aryl residue having at least one electron-attractive group) described in EP 0447647 is also preferably used.

The light-sensitive material of the present invention is subjected to spectral sensitization so as to impart spectral sensitivity at a desired light wavelength region to the emulsion of each layer.

Examples of the spectral sensitization dye used for spectral sensitization of the light-sensitive material of the present invention at blue, green and red regions include those described in F. M. Hamer, *Heterocyclic Compounds-Cyanine Dyes and Related Compounds,* John Wiley & Sons, New York, London (1964). Specific examples of the compound and the spectral sensitization method include those described in JP-A-62-215272, from page 22, right upper column to page 38. As the red-sensitive spectral sensitizing dye for silver halide emulsion grains having a particularly high silver chloride content, spectral sensitizing dyes described in JP-A-3-123340 are very preferred in view of stability, strength of adsorption and temperature dependency of exposure.

For effecting spectral sensitization of the light-sensitive material of the present invention at the infrared region efficiently, sensitizing dyes described in JP-A-3-15049, from page 12, left upper column to page 21, left lower column, JP-A-3-20730, from page 4, left lower column to page 15, left lower column, EP 0420011, from page 4, line 21 to page 6, line 54, EP 0420012, page 4, line 12 to page 10, line 33, EP 0443466 and U.S. Pat. No. 4,975,362 are preferably used.

Such a spectral sensitizing dye may be incorporated into a silver halide emulsion by dispersing the dye directly in the emulsion or may be dissolved in a single solvent such as water, methanol, ethanol, propanol, methyl cellosolve or 2,2,3,3-tetrafluoropropanol or a mixed solvent of these and then added to the emulsion. Also, an aqueous solution of the dye may be prepared in the presence of an acid or a base together as described in JP-B-44-23389 (the term "JP-B" as used herein means an "examined Japanese patent publication"), JP-B-44-27555 and JP-B-57-22089, or an aqueous solution or colloid dispersion of the dye with a surface active agent being present together may be added to the emulsion as described in U.S. Pat. Nos. 3,822,135 and 4,060,025. Further, the dye may be dissolved in a solvent substantially incompatible with water such as phenoxyethanol, dispersed in water or a hydrophilic colloid and then added to the emulsion. Furthermore, the dye may be dispersed directly in a hydrophilic colloid and the dispersion thereof may be added to an emulsion as described in JP-A-53-102733 and JP-A-58-105141. The time when the dye is added to the emulsion may be any stage hitherto considered useful during preparation of an emulsion. More specifically, it may be added before grain formation of silver halide emulsion, during grain formation of silver halide emulsion, between immediately after grain formation of silver halide emulsion and prior to entering into a washing step, before chemical sensitization, during chemical sensitization or between immediately after chemical sensitization and solidification under cooling of the emulsion or during preparation of coating solutions. Most commonly, the dye is added to the emulsion after completion of chemical sensitization prior to coating but the dye may be added at the same time with a chemical sensitizer to effect spectral sensitization and chemical sensitization simultaneously as described in U.S. Pat. Nos. 3,628,969 and 4,225,666, the dye may be added in advance of chemical sensitization as described in JP-A-58-113928, or the dye may be added before precipitation of silver halide grains is completed to start spectral sensitization. Further, the spectral sensitizing dye may be added in fractions, namely, a part may be added prior to chemical sensitization and the remaining may be added after chemical sensitization as described in U.S. Pat. No. 4,225,666, and the addition may be effected in any stage during formation of silver halide grains as described in U.S. Pat. No. 4,183,756. In particular, the sensitizing dye is preferably added before water washing or before chemical sensitization, of the emulsion.

The addition amount of the spectral sensitizing dye changes over a wide range according to the case but it is preferably in the range from $0.5\times10^{-6}$ to $1.0\times10^{-2}$ mol, more preferably from $1.0\times10^{-6}$ to $5.0\times10^{-3}$ mol, per mol of silver halide.

When a sensitizing dye having a spectral sensitization sensitivity, particularly, in a region from red to infrared is used in the present invention, compounds described in JP-A-2-157749, from page 13, right lower column to page 22, right lower column are preferably used in combination. By using such a compound, preservability and processing stability of the light-sensitive material and supersensitization effect can be peculiarly increased. In particular, compounds represented by formulae (IV), (V) and (VI) of JP-A-2-157749 are preferably used in combination. Such a compound is advantageously used in an amount of from $0.5\times10^{-5}$ to $5.0\times10^{-2}$ mol, preferably from $5.0\times10^{-5}$ to $5.0\times10^{-3}$ mol, pre mol of silver halide, and in a range from 0.1 to 10,000 times, preferably from 0.5 to 5,000 times, per mol of sensitizing dye.

The light-sensitive material of the present invention is used for a printing system using a normal negative printer and in addition, preferably used for a digital scan exposure using a monochromatic high density light such as a second harmonic generation source (SHG) using a combination of a nonlinear optical crystal with a gas laser, a light emitting diode, a semiconductor laser or a solid-state laser using a semiconductor laser as an excitation source. In order to render the system compact and inexpensive, the semiconductor laser or the second harmonic generation source (SHG) using a combination of a nonlinear optical crystal with a semiconductor laser or a solid-state laser may be preferably used. In particular, when a compact, cheap and highly stable device having a long life is intended, the use of a semiconductor laser is preferred and it is preferred to use a semiconductor laser as at least one of light sources for exposure.

When such a light source for scan exposure is used, the spectral sensitivity maximum of the light-sensitive material of the present invention may be freely established according to the wavelength of the light source for scan exposure used. In the case of a solid-state laser using a semiconductor laser as an excitation source or an SHG source using a combination of a semiconductor laser with a nonlinear optical crystal, the oscillation wavelength of laser can be made half and accordingly, blue light and green light can be obtained. Thus, the light-sensitive material can have a spectral sensitivity maximum at three regions of normal blue, green and red. When a semiconductor laser is used as a light source to render the device cheap, highly stable and compact, at least two layers are preferred to have a spectral sensitivity maximum at 670 nm or more. This is because the cheap and stable Group III-V type semiconductor laser now available has a light-emitting wavelength region at from red to infrared regions. However, on a laboratory level, it is confirmed that the Group II-VI type semiconductor laser oscillates at green or blue region and accordingly, it can be well expected that if a production technique of semiconductor lasers is advanced, such a semiconductor laser would be used cheaply and stably. If so, the necessity for at least two layers to have a spectral sensitivity maximum at 670 nm or higher would be diminished.

In such a scan exposure, the exposure time for silver halide of a light-sensitive material means the time required to expose a certain fine area. The fine area is generally a minimum unit for controlling the quantity of light from respective digital data and called a picture element. Accordingly, the exposure time per picture element varies depending on the size of picture element. The size of picture element depends on the picture element density which is practically in the range from 50 to 2,000 dpi. If the exposure time is defined as the time required to expose a picture element in a size such that the picture element density is 400 dpi, the exposure time is preferably $10^{-4}$ second or less, more preferably from $10^{-10}$ to $10^{-4}$ second. Here, the time after exposure to initiation of development is within 20 seconds, preferably 5 seconds.

In the light-sensitive material according to the present invention, the hydrophilic colloidal layer preferably contains a dye (particularly, an oxonol dye or a cyanine dye) capable of being decolorized on processing described in EP 0337490A2, pp. 27–76, so as to prevent irradiation or halation or to improve safety for safelight.

Some water-soluble dyes may worsen the color separation or safety for safelight when used in an increased amount. As the dye which can be used without causing any deterioration in color separation, water-soluble dyes described in Japanese Patent Application Nos. 3-310143, 3-310189 and 3-310139 are preferred.

In the present invention, a colored layer may be provided which is used in place of a water-soluble dye or in combination with a water-soluble dye and decolored on processing. The colored layer capable of being decolored on processing may be put into direct contact with the emulsion layer or may be provided through an interlayer containing gelatin or a processing color mixing inhibitor such as hydroquinone. The colored layer is preferably provided as an underlayer (on the support side) of an emulsion layer to be colored to the same elementary color as the color of the colored layer. Colored layers corresponding to all elementary colors may be individually provided or a part of such colored layers may be freely selected and provided. Also, a colored layer colored so as to correspond to a plurality of elementary color regions may be provided. With respect to the optical reflection density of the colored layer, the optical density at a wavelength having the highest optical density in the wavelength regions used for exposure (a visible light region of from 400 to 700 nm in the case of a normal printer exposure and a wavelength of the scan exposure source used in the case of scan exposure) is preferably from 0.2 to 3.0, more preferably from 0.5 to 2.5, still more preferably from 0.8 to 2.0.

The colored layer can be formed according conventionally known methods. For example, a method where a dye as described in JP-A-2-282244, from page 3, right upper column to page. 8, or a dye as described in JP-A-3-7931, from page 3, right upper column to page 11, left lower column is incorporated into a hydrophilic colloid layer in the sate of a solid fine particle dispersion, a method where an anionic dye is mordanted to a cation polymer, a method where a dye is adsorbed to fine particles such as silver halide to fix it in the layer, or a method using colloidal sliver as described in JP-A-1-239533 may be used. An example of the method for dispersing fine particles of a dye in the solid state include a method described in JP-A-2-308244 which comprises incorporating a fine particle dye substantially water-insoluble at a pH of 6 or less but substantially water-soluble at a pH of 8 or more. The method for mordanting an anionic dye to a cation polymer is described, for example, in JP-A-2-84637, pp. 18–26. The preparation method of colloidal silver as a light absorbent is described in U.S. Pat. Nos. 2,688,601 and 3,459,563. Among these methods, preferred are a method comprising incorporating a fine particle dye and a method using colloidal silver.

Gelatin is advantageous as the binder or protective colloid which can be used in the light-sensitive material according to the present invention, but other hydrophilic colloids may be used solely or in combination with gelatin. Preferred gelatin is a low-calcium gelatin having a calcium content of 800 ppm or less, more preferably 200 ppm or less. The present invention is preferably constructed such that the total calcium content in photographic constituent layers becomes 10 mg/m$^2$ or less. Further, an antiseptic as described in JP-A-63-271247 is preferably added for preventing the hydrophilic colloidal layers from proliferation of various molds or bacteria which cause deterioration of an image.

At the time when the light-sensitive material of the present invention is subjected to printer exposure, a band stop filter described in U.S. Pat. No. 4,880,726 is preferably used. By using this filter, color mixing is eliminated and color reproduction is outstandingly improved.

With respect to the silver halide emulsion, other materials (e.g., additives), photographic constituent layers (e.g., layer arrangement) applied to the light-sensitive material according to the present invention, the processing method for processing the light-sensitive material, and additives used for processing, those described in the following patents, in particular, EP 0355660A2 (corresponding to JP-A-2-139544) are preferably used.

TABLE 1

| Photographic Constituent | JP-A-62-215272 | JP-A-2-33144 | EP 0355622A2 |
|---|---|---|---|
| Silver halide emulsion | p. 10, right upper col., line 10 to p. 12, left lower col., line 5 and p. 12, right lower col., line 4 from the bottom to p. 13, left upper col. line 17 | p. 28, right upper col., line 16 to p. 29, right lower col., line 11 and p. 30, lines 2 to 5 | p. 45, line 53 to p. 47, line 3 and p. 47, lines 20 to 22 |
| Silver halide solvent | p. 12, left lower col., lines 6 to 14 and p. 13, left upper col., line 3 from the bottom to p. 18, left lower col., last line | — | — |
| Chemical sensitizer | p. 12, left lower col., line 3 from the bottom to right lower col., line 5 from the bottom, p. 18, right lower col., line 1 to p. 22, right upper col., line 9 from the bottom | p. 29, right lower col., line 12 to last line | p. 47, lines 4 to 9 |
| Spectral sensitizer (spectral sensitization) | p. 22, right upper col., line 8 from the bottom to p. 38, last line | p. 30, left upper col., lines 1 to 13 | p. 47, lines 10 to 15 |
| Emulsion stabilizer | p. 39, left upper col., line 1 to p. 72, right upper col., last line | p. 30, left upper col., line 14 to right upper col., line 1 | p. 47, lines 16–19 |
| Development accelerator | p. 72, left lower col., line 1 to p. 91, right upper col., line 3 | — | — |
| Color coupler (cyan, magenta, yellow couplers) | p. 91, right upper col., line 4 to p. 121, left upper col., line 6 | p. 3, right upper col., line 14 to p. 18, left upper col., last line and p. 30, right upper col., line 6 to p. 35, right lower col., line 11 | p. 4, lines 15 to 27, p. 5, line 30 to p. 28, last line, p. 45, lines 29–31 and p. 47, line 23 to p. 63, line 50 |
| Coloration increasing agent | p. 121, left upper col., line 7 to p. 125, right upper col., line 1 | — | — |
| Ultraviolet absorbent | p. 125, right upper col., line 2 to p. 127, left lower col., last line | p. 37, right lower col., line 14 to p. 38, left upper col., line 11 | p. 65, lines 22 to 31 |
| Discoloration inhibitor (image stabilizer) | p. 127, right lower col., line 1 to p. 137, left lower col., line 8 | p. 36, right upper col., line 12 to p. 37, left upper col., line 19 line 25, p. 45, lines 33 to 40, p. 65, lines 2 to 21 | p. 4, line 30 to p. 5, line 23, p. 29, line 1 to p. 45, |
| High boiling point and/or low boiling point organic solvent | p. 137, left lower col., line 9 to p. 144, right upper col., last line | p. 35, right lower col., line 14 to p. 36, left upper col., line 4 from the bottom | p. 64, lines 1 to 51 |
| Dispersion method of photographic additives | p. 144, left lower col., line 1 to p. 146, right upper col., line 7 | p. 27, right lower col., line 10 to p. 28, left upper col., last line and p. 35, right lower col., line 12 to p. 26, right upper col., line 7 | p. 63, line 51 to p. 64, line 56 |
| Hardening agent | p. 146, right upper col., line 8 to p. 155, left lower col., line 4 | — | — |
| Developing agent precursor | p. 155, left lower col., line 5 to p. 155, right lower col., line 2 | — | — |
| Development inhibitor-releasing compound | p. 155, right lower col., lines 3 to 9 | — | — |
| Support | p. 155, right lower col., line 19 to p. 156, left upper col., line 14 | p. 38, right upper col., line 18 to p. 39, left upper col., line 3 | p. 66, line 29 to p. 67, line 13 |
| Light-sensitive material layer structure | p. 156, left upper col., line 15 to p. 156, right lower col., line 14 | p. 28, right upper col., lines 1 to 15 | p. 45, lines 41 to 52 |
| Dyestuff | p. 156, right lower col., line 15 to p. 184, right lower col., last line | p. 38, left upper col., line 12 to right upper col., line 7 | p. 66, lines 18 to 22 |
| Color mixing inhibitor | p. 185, left upper col., line 1 to p. 188, right lower col., line 3 | p. 36, right upper col., lines 8 to 11 | p. 64, line 57 to p. 65, line 1 |
| Gradation controlling | p. 188, right lower col., | — | — |

TABLE 1-continued

| Photographic Constituent | JP-A-62-215272 | JP-A-2-33144 | EP 0355622A2 |
|---|---|---|---|
| agent | lines 4 to 8 | | |
| Stain inhibitor | p. 188, right lower col., line 9 to p. 193, right lower col., line 10 | p. 37, left upper col., last line to right lower col., line 13 | p. 65, line 32 to p. 66, line 17 |
| Surface active agent | p. 201, left lower col., line 1 to p. 210, right upper col., last line | p. 18, right upper col., line 1 to p. 24, right lower col., last line and p. 27, left lower col., line 10 from the bottom to right lower col., line 9 | — |
| Fluorine-containing compound (antistatic agent, coating aid, lubricant, adhesion-preventing agent) | p. 210, left lower col., line 1 to p. 222, left lower col., line 5 | p. 25, left upper col., line 1 to p. 27, right lower col., line 9 | — |
| Binder (hydrophilic colloid) | p. 222, left lower col., line 6 to p. 225, left upper col., last line | p. 38, right upper col., lines 8 to 18 | p. 66, lines 23 to 28 |
| Thickener | p. 225, right upper col., line 1 to p. 227, right upper col., line 2 | — | — |
| Antistatic agent | p. 227, right upper col., line 3 to p. 230, left upper col., line 1 | — | — |
| Polymer latex | p. 230, left upper col., line 2 to p. 239, last line | — | — |
| Matting agent | p. 240, left upper col., line 1 to p. 240, right upper col., last line | — | — |
| Photographic processing (processing steps and additives) | p. 3, right upper col., line 7 to p. 10, right upper col., line 5 | p. 39, left upper col., line 4 to p. 42, left upper col., last line | p. 67, line 14 to p. 69, line 28 |

Note)
The disclosure of JP-A-62-215272 referred to herein includes the amendments in the written revision filed on March 16, 1987 which is attached to the end of the publication.
Among color couplers, as the yellow coupler, so-called shortwave-type yellow couplers described in JP-A-63-231451, JP-A-63-123047, JP-A-63-241547, JP-A-1-173499, JP-A-1-213648 and JP-A-1-250944 are also preferably used.

The cyan, magenta or yellow coupler is preferably dissolved in a high boiling point organic solvent described in the Table above in the presence (or in the absence) of a low boiling point auxiliary solvent, impregnated into a loadable latex polymer (as described in U.S. Pat. No. 4,203,716) in the presence (or in the absence) of a high boiling point organic solvent described in the Table above, or dissolved together with a water-insoluble and organic solvent-soluble polymer, and then emulsified and dispersed in an aqueous hydrophilic colloid solution.

Preferred examples of the water-insoluble and organic solvent-soluble polymer include homopolymers and copolymers described in U.S. Pat. No. 4,857,449, cols. 7–15, and International Patent WO88/00723, pp. 12–30. Methacrylate-based or acrylamide-based polymers are more preferred and acrylamide-based polymers are particularly preferred in view of color image stability.

The light-sensitive material according to the present invention preferably uses a color image preservability improving compound as described in EP 0277589A2 in combination with couplers, particularly in combination with a pyrazoloazole coupler, a pyrrolotriazole coupler or an acylacetamide-type yellow coupler.

More specifically, compounds described in the European patent above which forms a chemically inert and substantially colorless compound by making a chemical bonding to the aromatic amine developing agent remained after color development and/or compounds described in the European patent above which forms a chemically inert and substantially colorless compound by making a chemical bonding to the oxidation product of the aromatic amine color developing agent remained after color development are preferably used individually or in combination to prevent the occurrence of stains or other side effects resulting from formation of a color dye due to the reaction during storage after processing of a coupler with a color developing agent or an oxidation product thereof remained in the film.

The cyan coupler which can be used in the present invention includes, in addition to the cyan coupler represented by formula (C—I), oil protected naphthol- or phenol-based couplers and representative examples thereof include naphthol couplers described in U.S. Pat. No. 2,474,293, preferably oxygen-releasing type highly active two-equivalent naphthol couplers described in U.S. Pat. Nos. 4,052,212, 4,146,396, 4,228,233 and 4,296,200. Specific examples of the phenol-based coupler are described in U.S. Pat. Nos. 2,369,929, 2,423,730, 2,772,162 and 2,895,826.

A cyan coupler having fatness to humidity and temperature is preferably used in the present invention and typical examples thereof include phenol-based cyan couplers described in U.S. Pat. No. 3,772,002, 2,5-diacylamino-substituted phenol-based couplers described in U.S. Pat. Nos. 2,772,162, 3,758,308, 4,126,396, 4,334,011 and 4,327,173, West German Patent (OLS) 3,329,729 and Japanese Patent Application No. 58-42671, and phenol couplers having a phenylureido group at the 2-position and an acylamino group at the 5-position described in U.S. Pat. Nos. 3,446,622, 4,333,999, 4,451,559 and 4,427,767.

The coupler of the present invention and the above-described couplers may of course be used in either way such that two or more kinds of couplers are added in the same layer so as to satisfy the characteristics the light-sensitive material is required to have or that the same compound is added to two or more different layers.

In addition to the foregoing, examples of preferred cyan couplers include diphenylimidazole-based cyan couplers described in JP-A-2-33144, 3-hydroxypyridine-based cyan coupler described in EP 0333185A2, cyclic active methylene-based cyan couplers described in JP-A-64-32260, pyrrolopyrazole-based cyan couplers described in EP 0456226A1, and pyrroloimidazole-based cyan couplers described in EP 0484909.

The magenta coupler represented by formula (M—I) of the present invention may be used in combination with other magenta couplers, for example, a 5-pyrazolone-type magenta coupler described in known publications shown in the table above. A preferred example of the 5-pyrazolone-based magenta coupler is arylthio-releasing 5-pyrazolone-based couplers described in International Applications WO92/18901, WO92/18902 and WO92/18903 because of small fluctuation in image preservability or image quality due to processing.

The magenta coupler of the present invention can also be used in combination with known pyrazoloazole-based couplers and preferred examples thereof, particularly in view of color hue and image stability or color forming property, include pyrazolotriazole couplers having a secondary or tertiary alkyl group bonded directly to the 2-, 3- or 6-position of the pyrazolotriazole ring described in JP-A-61-65245, pyrazoloazole couplers having a sulfonamido group in the molecule described in JP-A-61-65246, pyrazoloazole couplers having an alkoxyphenylsulfonamido ballast group described in JP-A-61-147254 and pyrazoloazole couplers having an alkoxy group or an aryloxy group at the 6-position described in European Patents 226,849A and 294,785A.

The yellow coupler used is preferably known acylacetanilide-based couplers and preferred among these are pivaloylacetanilide-based couplers having a halogen atom or an alkoxy group at the orth-position of the anilide ring, acylacetanilide-based couplers with the acyl group being a cycloalkanecarbonyl group substituted at the 1-position described in EP 0447969A, JP-A-5-107701 and JP-A-5-113642, and malondianilide-based couplers described in EP 0482552A and EP 0524540A.

With respect to the processing method of the color light-sensitive material of the present invention, in addition to the methods described in the table above, processing materials and processing methods described in JP-A-2-207250, from page 26, right lower column, line 1 to page 34, right upper column, line 9 and JP-A-4-97355, from page 5, left upper column, line 17 to page 18, right lower column, line 20 are preferred.

The dye material and processing method for use in the present invention will be described in detail. In the present invention, the light-sensitive material is subjected to color development, desilvering and water washing or stabilization. The color developer used in the present invention contains a known aromatic primary amine developing agent, preferably a p-phenylenediamine derivative and preferred examples thereof include compounds described JP-A-4-443, from page 4, right lower column, line 7 to page 6, right upper column, line 11 and JP-A-4-249244, from page 7, left column, line 23 to right column, line 16.

Among the above-described p-phenylenediamine derivatives, preferred are 4-amino-N-ethyl-N-(β-methanesulfonamidoethyl)-aniline, 4-amino-N-ethyl-N-(3-hydroxypropyl)-3-methylaniline, 4-amino-N-ethyl-N-(4-hydroxybutyl)-3-methylaniline, 4-amino-N-ethyl-N-(β-hydroxyethyl)-3-methylaniline and 4-amino-N-ethyl-N-(β-hydroxyethyl)-aniline.

The p-phenylenediamine derivative may be in the form of a salt such as sulfate, sulfite, hydrochloride, naphthalenedisulfonate or p-toluenesulfonate. The aromatic primary amine developing agent is used in an amount of preferably from 0.002 to 0.2 mol, more preferably from 0.005 to 0.1 mol, per liter of the developer.

In storing replenisher parts for the developing agent of the color developer at a low pH of from 2 to 6, sulfinates described in JP-A-5-5976, from page 4, left column, line 23 to page 9, left column, line 39 are preferably used. The sulfinate is contained in the replenisher of low pH in an amount of from 0.001 to 0.1 mol/liter, preferably from 0.002 to 0.2 mol/liter.

In practicing the present invention, the effect is outstanding when a color developer substantially free of benzyl alcohol is used. The "substantially free of" as used herein means that the benzyl alcohol concentration is preferably 2 ml/liter or less, more preferably 0.5 ml/liter or less, most preferably nil.

The color developer used in the present invention preferably contains substantially no sulfite ion so as to suppress the fluctuation in photographic properties accompanying the continuous processing and to achieve the effect of the present invention. The "contain substantially no sulfite ion" as used herein means that the sulfite ion concentration is $3.0\times10^{-3}$ mol/liter or less. Preferably the sulfite ion is contained in an amount of $1.0\times10^{-3}$ mol/liter or less and most preferably the sulfite ion is not contained. Here, the sulfite ion used in a slight amount for preventing oxidation of the processing agent kit containing a concentrated developing agent before preparation of a solution is excluded.

Also, the color developer used in the present invention preferably contains substantially no hydroxylamine so as to suppress the fluctuation in photographic properties accompanying the change in concentration of hydroxylamine. The "contain substantially no hydroxylamine" as used herein means that the hydroxylamine concentration is $5.0\times10^{-3}$ mol/liter or less. Most preferably, the color developer does not contain hydroxylamine at all.

The color developer used in the present invention more preferably contains an organic preservative in place of the above-described hydroxylamine or sulfite ion.

The organic preservative as used herein means organic compounds at large capable of reducing the deterioration rate of the aromatic primary amine color developing agent when introduced into the processing solution of a color photographic light-sensitive material. In other words, it indicates organic compounds having a function of preventing the color developing agent from oxidation due to an air or the like. Particularly effective organic preservatives are hydroxylamine derivatives (exclusive of hydroxylamine), hydroxamic acids, hydrazines, hydrazides, phenols, α-hydroxy ketones, α-amino ketones, saccharides, monoamines, diamines, polyamines, quaternary ammonium salts, nitroxy radicals, alcohols, oximes, diamide compounds and condensed ring-type amines. These are described in JP-B-48-30496, JP-A-52-143020, JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503 and 2,494,930, JP-A-1-97953, JP-A-1-186939, JP-A-1-186940, JP-A-1-187557 and JP-A-2-

306244. Other preservatives, which can be used, if desired, include various metals described in JP-A-57-44148 and JP-A-57-53749, salicylic acids described in JP-A-59-180588, amines described in JP-A-63-239447, JP-A-63-128340, JP-A-1-186939 and JP-A-1-187557, alkanolamines described in JP-A-54-3532, polyethyleneimines described in JP-A-56-94349, and aromatic polyhydroxy compounds described in U.S. Pat. No. 3,746,544. Among these, particularly preferred are alkanolamines such as triethanolamine, dialkylhydroxylamines such as N,N-diethylhydroxylamine and N,N-di(sulfoethyl)hydroxylamine, hydrazine derivatives (exclusive of hydrazine) such as N,N-bis(carboxymethyl)hydrazine and aromatic polyhydroxy compound represented by sodium catechol-3,5-disulfonate.

It is particularly preferred in view of improvement of the color developer and as a result, improvement in stability during a continuous processing to use a dialkylhydroxylamine and/or hydrazine derivative in combination with an alkanolamine or to use a dialkylhydroxylamine described in EP 0530921A1 in combination with an α-amino acid represented by glycine and an alkanol amine.

The color developer of the present invention preferably contains a chloride ion in an amount of from $3.5\times10^{-3}$ to $3.0\times10^{-1}$ mol/liter, more preferably from $1\times10^{-2}$ to $2\times10^{-1}$ mol/liter. If the chloride ion concentration exceeds $3.0\times10^{-1}$ mol/liter, the development is retarded and the maximum density and sensitivity are decreased, whereas if it is less than $3.5\times10^{-3}$ mol/liter, the fog cannot be prevented sufficiently.

The color developer of the present inventions also preferably contains a bromide ion in an amount of from $0.5\times10^{-5}$ to $1.0\times10^{-3}$ mol/liter, more preferably from $3.0\times10^{-5}$ to $5\times10^{-4}$ mol/liter. If the bromide ion concentration exceeds $1\times10^{-3}$ mol/liter, the development is retarded and the maximum density and sensitivity are decreased, whereas if it is less than $0.5\times10^{-5}$ mol/liter, the fog cannot be prevented sufficiently.

The chloride ion and bromide ion may be added directly to the color developer or may be eluted from the light-sensitive material to the color developer during development.

In the case of direct addition to the color developer, the chloride ion-providing substance includes sodium chloride, potassium chloride, ammonium chloride, lithium chloride, magnesium chloride and calcium chloride. The chloride ion may also be supplied from a florescent brightening agent contained in the color developer.

The bromide ion-providing substance includes sodium bromide, potassium bromide, ammonium bromide, lithium bromide, calcium bromide and magnesium bromide.

In the case when the chloride ion or the bromide ion is eluted from the light-sensitive material during development, they may be supplied from an emulsion or other than the emulsion.

The color developer used in the present invention has a pH of preferably from 9 to 12, more preferably from 9 to 11.0 and the color developer may contain other known developer ingredients.

In order to keep the pH in the above-described range, various buffering agents are preferably used. Examples of the buffering agent include carbonate, phosphate, borate, hydroxybenzoate, glycyl salt, N,N-dimethylglycin salt, leucine salt, norleucine salt, guanine salt, 3,4-dihydroxyphenylalanine salt, alanine salt, aminolactate, 2-amino-2-methyl-1,3-propanediol salt, valine salt, proline salt, trishydroxyaminomethane salt and lysine salt. In particular, carbonate, phosphate, tetraborate and hydroxybenzoate are advantageous in that they have excellent solubility and buffering ability at a high pH region of 9.0 or more, cause no adverse effect (e.g., fog) on the photographic performance when added to the color developer and are cheap, and these buffering agents are particularly preferably used.

Specific examples of the buffering agent include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate).

The buffering agent is added to the color developer in an amount of preferably 0.1 mol/liter or more, more preferably from 0.1 to 0.4 mol/liter.

In addition to the foregoing, the color developer may contain various chelating agents as a suspending agent for calcium or magnesium or so as to improve stability of the color developer. Examples of the chelating agent include nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, transcylohexanediaminetetraacetic acid, 1,2-diaminopropanetetraacetic acid, glycol ether diaminetetraacetic acid, ethylenediamineorthohydroxyphenylacetic acid, 2-phosphonobutane-1,2,4-tricarboxylic acid, 1-hydroxy-ethylidene1,1-diphosphonic acid, N,N'-bis(2-hydroxybenzyl)-ethylenediamine-N,N'-diacetic acid and hydroxyethyliminodiacetic acid. These chelating agents may be used in combination of two or more thereof, if desired.

The chelating agent is added in an amount enough to sequester the metal ion in the color developer, for example, of approximately from 0.1 to 10 g/l.

The color developer may contain a freely selected development accelerator, if desired.

Examples of the development accelerator include thioether compounds described in JP-B-37-16088, JP-B-37-5987, JP-B-38-7826, JP-B-44-12380, JP-B-45-9019 and U.S. Pat. No. 3,813,247, p-phenylenediamine compounds described in JP-A-52-49829 and JP-A-50-15554, quaternary ammonium salts represented by JP-A-50-137726, JP-B-44-30074, JP-A-56-156826 and JP-A-52 -43429, amine compounds described in U.S. Pat. Nos. 2,494,903, 3,128,182, 4,230,796 and 3,253,919, JP-B-41-11431, U.S. Pat. Nos. 2,482,546, 2,596,926 and 3,582,346, polyalkylene oxides described in JP-B-37-16088, JP-B-42-25201, U.S. Pat. No. 3,128,183, JP-B-41-11431, JP-B-42-23883 and U.S. Pat. No. 3,532,501, 1-phenyl-3-pyrazolidones and imidazoles.

In the present invention, a freely selected antifoggant may be added, if desired. Examples of the antifoggant include alkali metal halides such as sodium chloride, potassium bromide and potassium iodide and organic antifoggants.

The color developer used in the present invention preferably contains a fluorescent brightening agent. Preferred examples of the fluorescent brightening agent include 4,4'-diamino-2,2'-disulfostilbene-based compounds. The fluorescent brightening agent is added in an amount of from 0 to 5 g/liter, preferably from 0.1 to 4 g/liter.

If desired, various surface active agents such as alkylsulfonic acid, arylsulfonic acid, aliphatic carboxylic acid and aromatic carboxylic acid polyalkyleneimine may also be added.

The color development is followed by desilvering. The desilvering may be effected by conducting bleaching and fixing separately or simultaneously (bleach-fixing). In order to achieve a rapid processing, the bleaching may be followed by bleach-fixing. Further, any processing such as processing in a bleach-fixing bath composed of sequential two baths, fixing before bleach-fixing, or bleaching after bleach-fixing may be freely selected according the object.

Examples of the bleaching agent used in a bleaching solution or a bleach-fixing solution include compounds of a polyvalent metal such as iron(III), cobalt(III), chromium(IV) or copper(II), peracids, quinones and nitro compounds. Representative examples of the bleaching agent include iron chloride, ferricyanide, bichromate, an organic complex salt of iron(III) (e.g., a metal complex salt of an aminopolycarboxylic acid such as ethylenediaminetetraacetic acid, diethylenetriaminepentaacetic acid, cyclohexanediaminetetraacetic acid, methyliminodiacetic acid, 1,3-diaminopropanetetraacetic acid or glycol ether diaminetetraacetic acid), persulfate, bromate, permanganate and nitrobenzene. Among these, an aminopolycarboxylic acid iron(III) complex salt including an ethylenediaminetetraacetic acid iron(III) complex salt and a 1,3-diaminopropanetetraacetic acid iron(III) complex salt is preferred in view of rapid processing and prevention of environmental pollution. The aminopolycarboxylic acid iron(III) complex salt is particularly useful in either a bleaching solution or bleach-fixing solution. The bleaching solution or bleach-fixing solution using such an aminopolycarboxylic acid iron(III) complex salt is used at a pH of from 3 to 8.

The bleaching or bleach-fixing solution may contain known additives, for example, a rehalogenation agent such as ammonium bromide or ammonium chloride, a pH buffer such as ammonium nitrate and an anticorrosive for metal such as ammonium sulfate.

In addition to the above-described compounds, the bleaching or bleach-fixing solution preferably contains an organic acid for the purpose of preventing bleaching stains. A particularly preferred organic acid is compounds having an acid dissociation constant (pKa) of from 2 to 5.5. Specifically, an acetic acid and a propionic acid are preferred.

Examples of the fixing agent used in the fixing or bleach-fixing solution include thiosulfates, thiocyanates, thioether-based compounds, thioureas and a large quantity of iodide salts, and among these, thiosulfates are usually used and ammonium thiosulfate can be most widely used. A combination use of a thiosulfate with a thiocyanate, a thioether compound or a thiourea is also preferred.

Preferred examples of the preservative for the fixing or bleach-fixing solution include sulfites, bisulfites, carbonyl bisulfite adducts and sulfinic acid compounds described in European Patent 294769A. Further, the fixing or bleach-fixing solution preferably contains various aminopolycarboxylic acids or organic phosphonic acids (e.g., 1-hydroxyethylidene-1,1-diphosphonic acid, N,N,N',N'-ethylenediaminetetraphosphonic acid) for the purpose of stabilization of the solution.

Furthermore, the fixing or bleach-fixing solution can contain various fluorescent brightening agents, defoaming agents, surface active agents, polyvinylpyrrolidones or methanols.

The bleaching or bleach-fixing solution or a prebath thereof may contain a bleaching accelerator, if desired. Specific examples of useful bleaching accelerators include compounds having a mercapto group or disulfide bond described in U.S. Pat. No. 3,893,858, West German Patent 1,290,812, JP-A-53-95630 and Research Disclosure, No. 17129 (July, 1978); thiazolidine derivatives described in JP-A-50-140129; thiourea derivatives described in U.S. Pat. No. 3,706,561; iodide salts described in JP-A-58-16235; polyoxyethylene compounds described in West German Patent 2,748,430; polyamine compounds described in JP-B-45-8836; and bromide ions. Among these, compounds having a mercapto group or a disulfide group are preferred due to their large acceleration effect and compounds described in U.S. Pat. No. 3,893,858, West German Patent 1,290,812 and JP-A-53-95630 are particularly preferred. Also, compounds described in U.S. Pat. No. 4,552,834 are preferred. The bleaching accelerator may be added to the light-sensitive material. The bleaching accelerator is particularly effective when a light-sensitive material for photographing is bleach-fixed.

The total time for desilvering is preferably as short as possible within a range of causing no poor desilverization. It is preferably from 5 to 25 seconds, more preferably from 10 to 20 seconds. The processing time as used herein means the time period where the light-sensitive material is dipped in processing solutions. The temperature is from 25° C. to 50° C., preferably 35° C. to 45° C. As long as the temperature is in a preferred range, the desilverization rate is improved and the occurrence of stains after processing can be effectively prevented.

In desilverization, the stirring is preferably intensified as highly as possible. Specific examples of the method for intensifying stirring include a method comprising colliding a jet stream of a processing solution against the emulsion surface of the light-sensitive material described in JP-A-62-183460 and JP-A-62-183461, a method for increasing the stirring effect by using a rotary means described in JP-A-62-183461, a method for increasing the stirring effect by causing turbulence on the emulsion surface while moving the light-sensitive material with the emulsion surface being brought into contact with a wire blade provided in the solution, and a method for increasing the circulative flow rate of the entire processing solutions. Such a means for intensifying the stirring is effective in any of the bleaching solution, bleach-fixing solution or fixing solution. The intensification of stirring is considered to increase the supply rate of the bleaching agent and/or fixing agent into the emulsion layer and as a result, to increase the desilverization rate. The above-described means for intensifying stirring is more effective when a bleaching accelerator is used and in this case, the acceleration effect can be outstandingly increased or the inhibition of fixing due to the bleaching accelerator can be eliminated.

The automatic developing machine used for the light-sensitive material of the present invention preferably comprises a transportation means of a light-sensitive material described in JP-A-60-191257, JP-A-60-191258 and JP-A-60-191259. As described in JP-A-60-191257 above, the transportation means can extremely decrease the amount of a processing solution carried over from a previous bath to a post bath and provides a great effect in preventing the deterioration in performance of the processing solution. Such an effect is particularly useful in reducing the processing time or decreasing the replenishing amount of a processing solution in each step.

Irrespective of the liquid numerical aperture [contact area with air ($cm^2$)/liquid volume ($cm^3$)], the processing according to the present invention can exhibit superior performance to that provided by any combination other than the present invention, but in view of stability of the solution components, the liquid numerical aperture is preferably from 0 to 0.1 $cm^{-1}$ and in the case of a continuous processing, it is in practice preferably from 0.001 to 0.05 $cm^{-1}$, more preferably from 0.002 to 0.03 $cm^{-1}$.

The color light-sensitive material of the present invention is usually subjected to water washing after desilvering. The water washing may be replaced by stabilization. In such a stabilization processing, any of known methods described in JP-A-57-8543, JP-A-58-14834 and JP-A-60-220345 can be used. A water washing-stabilization as effected in the processing of a color light-sensitive material for photographing may also conducted, where the stabilization bath containing a dye stabilizer and a surface active agent is used as the final bath.

The water-washing solution and the stabilizing solution may contain a hard water softening agent such as inorganic phosphoric acid, polyaminocarboxylic acid and organic aminophosphonic acid; a metal salt such as Mg salt, Al salt and Bi salt; a surface active agent; or a hardening agent.

The amount of washing water in the water washing step can be set over a wide range according to the characteristics (e.g., materials used such as coupler) or use of the light-sensitive material, washing water temperature, number (stage) of water washing tanks, replenishing system such as countercurrent or co-current, or other various conditions. In order to prevent the proliferation of bacteria or adherence of floats generated to the light-sensitive material, which takes place when the amount of washing water is largely reduced in a multi-stage countercurrent system, a method for reducing calcium ions or magnesium ions described in JP-A-62-288838 can be very effectively used. Also, isothiazolone compounds and thiabendazoles described in JP-A-57-8542, chlorine-based germicides such as chlorinated sodium isocyanurate, benzotriazoles or germicides described in Hiroshi Horigushi, *Bokin, Bobai-Zai no Kagaku* (Sankyo Shuppan, 1986), *Biseibutsu no Mekkin, Sakkin, Bobai-Gijutsu* compiled by Eisei Gijutsu Kai (Kogyo Gijutsu Kai, 1982), and *Bokin-Bobai Zai Jiten* compiled by Nippon Bokin Bobai Gakkai (1986) can be used.

The washing water has a pH of from 4 to 9, preferably 5 to 8. The washing water temperature and the washing time are generally from 15° to 45° C. and 10 seconds to 2 minutes, preferably from 25° to 40° C. and from 15 to 45 seconds, respectively, though they may be established variously according to the characteristics and use of the light-sensitive material. In the present invention, the water washing time is particularly preferably from 10 to 40 seconds and in practice, it is selected in the range from 15 to 30 seconds.

Examples of the dye stabilizer which can be used in the stabilizing solution include aldehydes such as formalin and glutaraldehyde, N-methylol compounds, hexamethylenetetramine and aldehyde-sulfurous acid adducts. The stabilizing solution may also contain a pH-adjusting buffer such as boric acid and sodium hydroxide; a chelating agent such as 1-hydroxyethylidene-1,1-diphosphonic acid and ethylenediaminetetraacetic acid; a sulfurization inhibitor such as alkanolamine; a fluorescent brightening agent; or an antiseptic.

The overflow solution accompanying the replenishment of the above-described washing water and/or stabilizing solution can be re-used in such a step as desilvering.

In the case of processing by means of an automatic development machine, it is preferred to correct the concentration of each processing solution by adding water on thickening of the solution due to evaporation.

In the present invention, the washing water and/or stabilizing solution or other any processing solution may be jetted out. The jet stream can be generated by sucking a processing solution in a processing bath by means of a pump and jetting the solution toward the emulsion surface of a light-sensitive material through nozzles or slits positioned to face the emulsion surface. More specifically, a method comprising jetting out a solution compressed by means of a pump through slits or nozzles provided to face the emulsion surface described in JP-A-62-183460 can be used.

In the present invention, the washing water and/or stabilizing water treated with a reverse osmosis membrane are more effective. The reverse osmosis membrane may be made of cellulose acetate, crosslinked polyamide, polyether, polysulfon, polyacrylic acid or polyvinylene carbonate.

The pressure necessary to feed a solution against the reverse osmosis membrane is, in view of stain-preventing effect and prevention of reduction in water amount penetrated, preferably from 2 to 10 kg/cm$^2$, more preferably from 3 to 7 kg/cm$^2$.

The water washing and/or stabilization is preferably conducted in a multi-stage countercurrent system where a plurality of tanks are connected and the number of tanks is preferably from 2 to 5 tanks.

The treatment with a reverse osmosis membrane is preferably applied to water in the second or subsequent tanks for water washing and/or stabilization in such a multi-stage countercurrent system. More specifically, in the case of two-tank structure, water in the second tank, in the case of a three-tank structure, water in the second or third tank, and in the four-tank structure, water in the third or fourth tank is treated with a reverse osmosis membrane and the penetrated water is returned to the same tank (the tank where water for the reverse osmosis membrane treatment is sampled, hereinafter referred to as a "sampling tank") or to the subsequent water washing and/or stabilization tank. The thickened washing water and/or stabilizing solution may also be returned to the bleach-fixing bath positioned at the upper side than the sampling tank.

In the process of the present invention, the total processing time, in other words, the processing time from development to drying is preferably within 120 seconds, more preferably from 30 to 90 seconds. The processing time as used herein means the time period since the light-sensitive material is dipped in a developer until it comes out from the drying zone of a processor.

For the purpose of achieving a simple and rapid processing, the color light-sensitive material of the present invention may contain a color developing agent, preferably in the form of various precursors of the color developing agent. Examples thereof include indoaniline compounds described in U.S. Pat. No. 3,342,597, Schiff's base-type compounds described in U.S. Pat. No. 3,342,599, Research Disclosure No. 14850 and ibid., No. 15159, aldol compounds described in Research Disclosure No. 13924, metal salt complexes described in U.S. Patent 3,719,492 and urethane-based compounds described in JP-A-53-135262.

The color light-sensitive material of the present invention may contain, if desired, various 1-phenyl-3-pyrazolidones in order to accelerate color development. Typical examples thereof include compounds described in JP-A-56-64339, JP-A-57-144547 and JP-A-58-115438.

The processing time in a step as used in the present invention means the time period required between the initiation of processing of a light-sensitive material in a certain step and the initiation of processing in the next step. The practical processing time in an automatic developing machine is usually determined by the linear velocity and the volume of processing bath. In the present invention, the linear velocity is from 500 to 4,000 mm/min. as a standard. In the case of a small-sized developing machine called as a mini lab., the linear velocity is preferably from 500 to 2,500 mm/min. In some large-scaled laboratory, a high-speed processor having a linear velocity of from 10,000 to 50,000 mm/min is used as a developing machine.

From an aspect of apparatus, the crossover time (airing time) is preferably shortened to reduce the processing time and for example, a conveying method through blades capable of providing a shielding effect between processings described in JP-A-4-86659, FIG. 4, 5 or 6 and JP-A-5-66540, FIG. 4 or 5 is preferably used.

According to the present invention, a light-sensitive material can be provided which exhibits a high coloring property even in the case of a short time processing. Further, by using the light-sensitive material of the present invention, a color print where the dye image is fast to light or heat and the white background is excellent in stability can be provided even when it is produced by a rapid processing.

The present invention will be described in greater detail with reference to the following examples but the present invention should not be construed as being limited thereto.

EXAMPLE 1

3.3 g of sodium chloride was added to a 3% aqueous solution of lime-processed gelatin and then thereto 3.2 ml of N,N'-dimethylimidazolidine-2-thione (1% aq. soln.) was added. After adjusting the pH of the solution to 3.5, an aqueous solution containing 0.2 mol of silver nitrate and an aqueous solution containing 0.12 mol of sodium chloride and 0.08 mol of potassium bromide were added and mixed to the solution at 52° C. under vigorous stirring. Then, thereto an aqueous solution containing 0.8 mol of silver nitrate and an aqueous solution containing 0.48 mol of sodium chloride, 0.32 mol of potassium bromide and 0.02 mg of potassium hexachloro-iridate(IV) were added and mixed at 52° C. under vigorous stirring. After keeping the mixed solution at 52° C. for 5 minutes, the solution was desilvered and washed with water and thereto 90.0 g of lime-processed gelatin was further added. The resulting emulsion was adjusted to have a pH of 6.5 and subjected to spectral sensitization, sulfur sensitization, and gold sensitization by adding thereto Spectral Sensitizing Dye R-1 at 54° C. and further adding sodium thiosulfate and chloroauric acid. At the end of chemical sensitization, 150 mg of 1-(3-methylureidophenyl)-5-mercaptotetrazole was added for the purpose of stabilization and fog-prevention. Further, 2.6 g of Compound R-2 was added to the emulsion. The thus-obtained silver chlorobromide emulsion (average grain size: 0.53 μm; cubic grains having a coefficient of fluctuation in grain size distribution of 8%; silver bromide: 40 mol %) was designated as Emulsion 101.

A silver chlorobromide emulsion (average grain size: 0.45 μm; cubic grains having a coefficient of fluctuation in grain size distribution of 8%; silver bromide: 40 mol %) was prepared in the same manner as Emulsion 101 except for varying the temperature at the grain formation to have an average grain size of 0.45 μm and changing the spectral sensitizing dye added before chemical sensitization to G-1, and designated as Emulsion 102. In Emulsion 102, potassium hexachloroiridate(IV) was added in an amount of 0.032 mg, 1-(3 -methylureidophenyl)-5-mercaptotetrazole was added in an amount of 180 mg and Compound R-2 was not added.

Further, a silver chlorobromide emulsion (average grain size: 0.86 μm, cubic grains having a coefficient of fluctuation in grain size distribution of 7%; silver bromide: 40 mol %) was prepared in the same manner as Emulsion 101 except for varying the temperature at the grain formation to have an average grain size of 0.86 μm and changing the spectral sensitizing dye added before chemical sensitization to B-1, and was designated as Emulsion 103. In Emulsion 103, potassium hexachloroiridate(IV) was added in an amount of 0.006 mg, 1-(3-methylureidophenyl)-5-mercaptotetrazole was added in an amount of 90 mg and Compound R-2 was not added.

The spectral sensitizing dyes used in each emulsion were shown below.

Spectral Sensitizing Dye R-1
A 1:1 by mole mixture of:

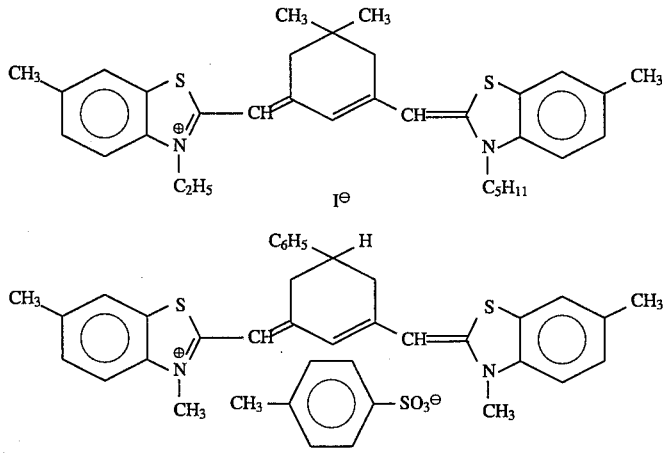

Compound R-2

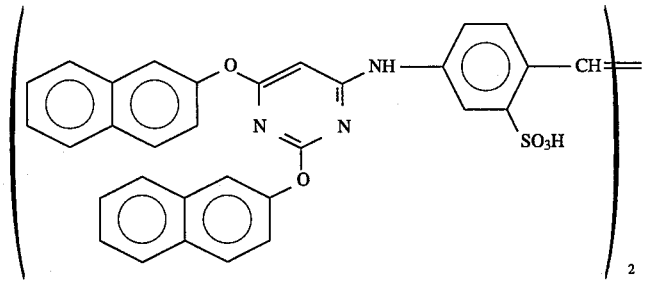

Spectral Sensitizing Dye G-1
A 6:1:3 (by mol) mixture of:

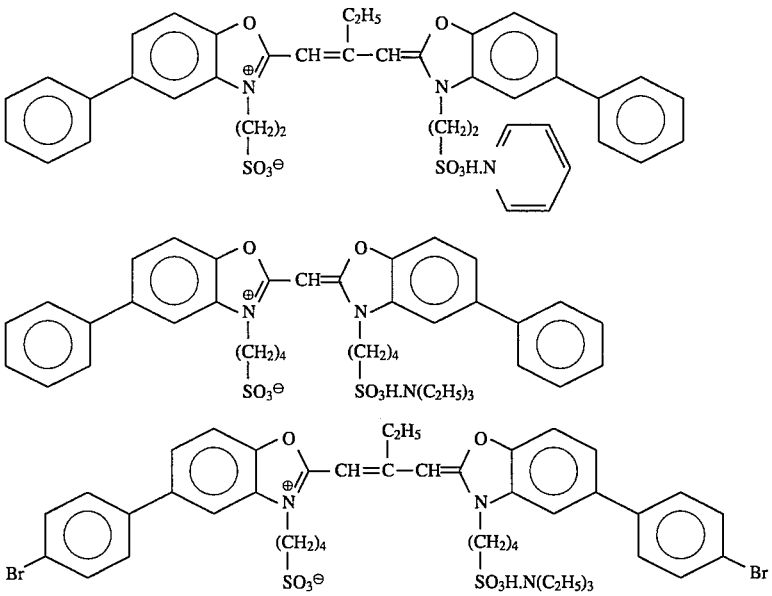

(added in an amount of $4.0 \times 10^{-4}$ mol per mol of silver halide)

Spectral Sensitizing Dye B-1

A 5:2:3 (by mol) mixture of:

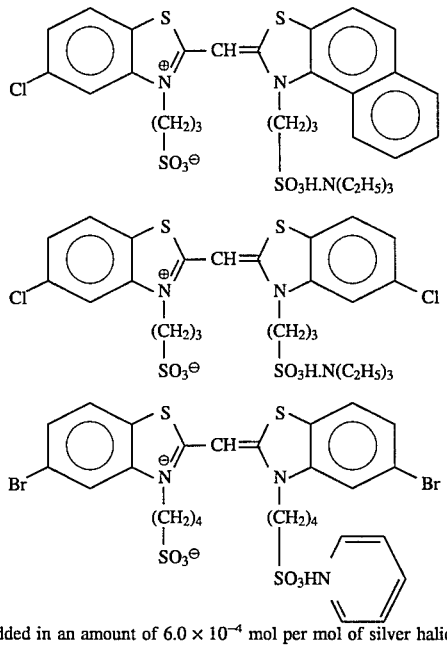

(added in an amount of $6.0 \times 10^{-4}$ mol per mol of silver halide)

Using these emulsions, a multilayered color light-sensitive material was prepared. The coating solutions were prepared as follows.

Coating Solution for First Layer 122.0 g of Yellow Coupler ExY, 15.4 g of Color Image Stabilizer Cpd-1, 7.5 g of Color Image Stabilizer Cpd-2, 16.7 g of Color Image Stabilizer Cpd-3 were dissolved in 44 g of Solvent Solv-1 and 180 ml of ethyl acetate, the resulting solution was mixed with 1,000 g of a 10% aqueous gelatin solution containing 86 ml of 10% sodium dodecylbenzenesulfonate, and the mixture was emulsified and dispersed under vigorous stirring in a homogenizer to prepare Emulsified Dispersion A. Emulsified Dispersion A and Emulsion 103 prepared above were mixed and dissolved and the gelatin amount was adjusted to prepare the coating solution for the first layer having the following composition. The coated amount of each emulsion indicates the amount calculated in terms of silver.

The coating solutions for the second to seventh layers were prepared in the same manner as the coating solution for the first layer. In each layer, 1-oxy-3,5-dichloro-s-triazine sodium salt was used as a gelatin hardening agent.

Further, Cpd-12, Cpd-13, Cpd-14 and Cpd-15 were added to each layer in an amount of 15 mg/m$^2$, 60 mg/m$^2$, 5 mg/m$^2$ and 10 mg/m$^2$ respectively. Furthermore, 1-(5-methyl-ureidophenyl)-5-mercaptotetrazole was added to the second, fourth, sixth and seventh layers in an amount of 0.15 mg/m$^2$, 0.15 mg/m$^2$, 0.6 mg/m$^2$ and 0.1 mg/m$^2$, respectively.

Still further, 4-hydroxy-6-methyl-1,3,3a,7-tetrazaindene was added to the first and third layers in an amount of $1\times10^{-4}$ mol and $2\times10^{-4}$ mol, respectively, per mol of silver halide.

In addition, the following water-soluble dyes (the numerals in parenthesis indicate the coated amount) were added to each emulsion layer for the purpose of irradiation prevention.

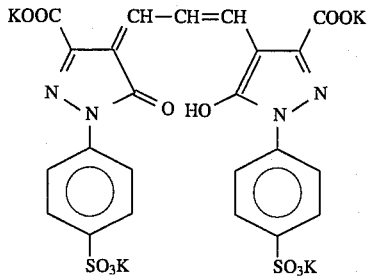

(10 mg/m²)

and

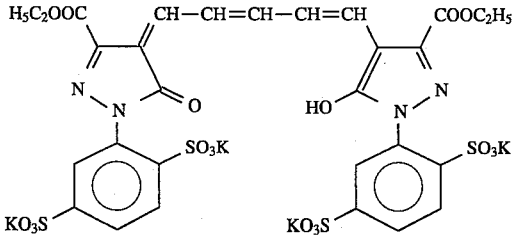

(40 mg/m²)

A paper support laminated on both surfaces thereof with polyethylene (the laminate layer on the emulsion-coated side being composed of two layers consisting of a 17 μm-thick upper layer containing 19% of $TiO_2$ and a 10 μm-thick lower layer containing no $TiO_2$, with the upper layer containing a trace amount of ultramarine) was subjected to corona discharge treatment on the surface, then an undercoat layer containing sodium dodecylbenzenesulfonate was provided, and thereon the coating solutions prepared above were coated in a super-position fashion to have the following compositions to thereby prepare Multilayered Color Printing Paper 101.

Layer Structure:

Each layer has the following composition. Numerals show the coating amount (g/m²). The coating amount of silver halide emulsions was shown in terms of silver.

| | |
|---|---|
| Support | |
| Polyethylene laminated paper [Polyethylene on the first layer side contains a white pigment ($TiO_2$) and a bluish dye (ultramarine).] | |
| First Layer (Blue-sensitive Emulsion Layer) | |
| Silver Chlorobromide Emulsion 103 described above | 0.30 |
| Gelatin | 1.33 |
| Yellow Coupler ExY | 0.76 |
| Color Image Stabilizer Cpd-1 | 0.10 |
| Color Image Stabilizer Cpd-2 | 0.05 |
| Color Image Stabilizer Cpd-3 | 0.10 |
| Solvent Solv-1 | 0.28 |
| Second Layer (Color Mixing Preventing Layer) | |
| Gelatin | 1.09 |
| Color Mixing Inhibitor Cpd-4 | 0.11 |
| Solvent Solv-1 | 0.07 |
| Solvent Solv-2 | 0.25 |
| Solvent Solv-3 | 0.19 |
| Solvent Solv-7 | 0.09 |
| Third Layer (Green-sensitive Emulsion Layer) | |
| Silver Chlorobromide Emulsion 102 described above | 0.15 |
| Gelatin | 1.19 |
| Magenta Coupler ExM | 0.15 |
| Ultraviolet Absorbent UV-1 | 0.15 |
| Color Image Stabilizer Cpd-2 | 0.013 |
| Color Image Stabilizer Cpd-5 | 0.013 |
| Color Image Stabilizer Cpd-6 | 0.013 |
| Color Image Stabilizer Cpd-7 | 0.10 |
| Color Image Stabilizer Cpd-8 | 0.013 |
| Solvent Solv-4 | 0.38 |
| Solvent Solv-5 | 0.19 |
| Fourth Layer (Color Mixing Preventing Layer) | |
| Gelatin | 0.77 |
| Color Mixing Inhibitor Cpd-4 | 0.08 |
| Solvent Solv-1 | 0.05 |
| Solvent Solv-2 | 0.18 |
| Solvent Solv-3 | 0.14 |
| Solvent Solv-7 | 0.06 |
| Fifth Layer (Red-sensitive Emulsion Layer) | |
| Silver Chlorobromide Emulsion 101 described above | 0.25 |
| Gelatin | 1.00 |
| Cyan Coupler ExC | 0.35 |
| Ultraviolet Absorbent UV-3 | 0.24 |
| Color Image Stabilizer Cpd-1 | 0.30 |
| Color Image Stabilizer Cpd-6 | 0.013 |
| Color Image Stabilizer Cpd-8 | 0.013 |
| Color Image Stabilizer Cpd-9 | 0.05 |
| Color Image Stabilizer Cpd-10 | 0.013 |
| Solvent Solv-1 | 0.013 |
| Solvent Solv-6 | 0.26 |
| Sixth Layer (Ultraviolet Absorbing Layer) | |
| Gelatin | 0.64 |
| Ultraviolet Absorbent UV-2 | 0.39 |
| Color Image Stabilizer Cpd-7 | 0.05 |
| Solvent Solv-8 | 0.05 |
| Seventh Layer (Protective Layer) | |
| Gelatin | 0.98 |
| Acryl-modified copolymer of polyvinyl alcohol (polymerization degree: 17%) | 0.04 |
| Liquid paraffin | 0.01 |
| Surface Active Agent Cpd-11 | 0.01 |

Yellow Coupler ExY
A 1:1 (by mole) mixture of:
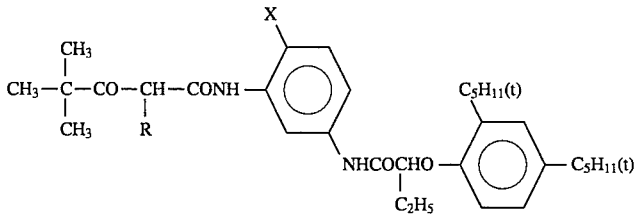
R = 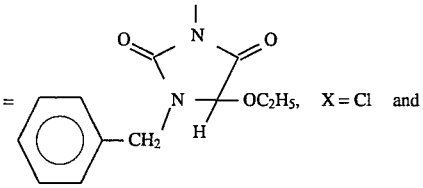 X = Cl and
R = 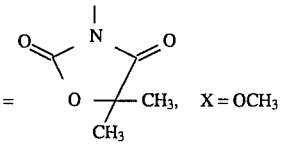 X = $OCH_3$
Magenta Coupler ExM
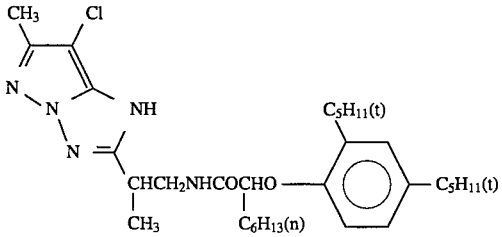
Cyan Coupler ExC
A 25:75 (by mole) mixture of:
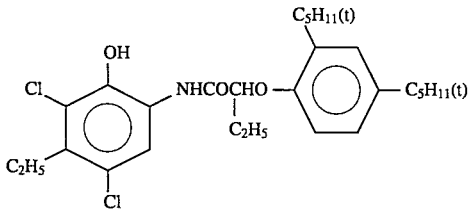
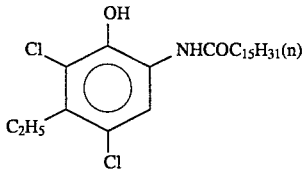

Color Image Stabilizer Cpd-1

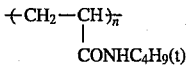

Number average molecular weight: 60,000

Color Image Stabilizer Cpd-2

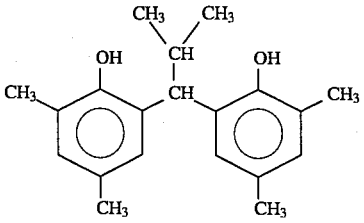

Color Image Stabilizer Cpd-3

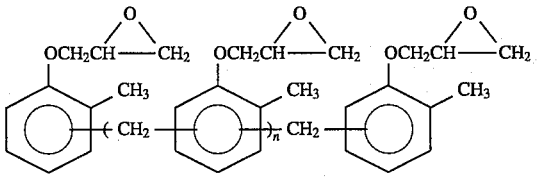

(n = 7 to 8 (on average))

Color Mixing Inhibitor Cpd-4

A 1:1:1 (by weight) mixture of:

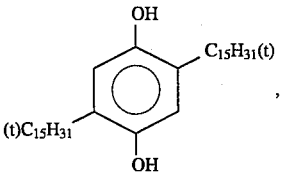

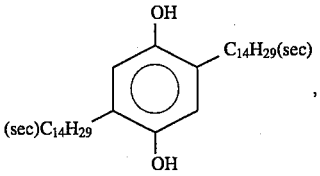

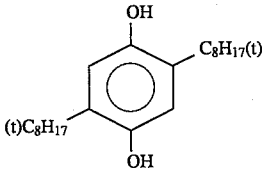

Color Image Stabilizer Cpd-5

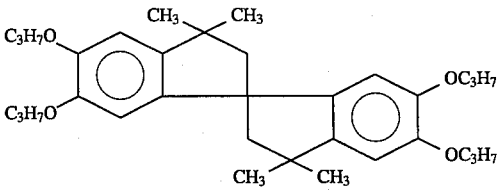

-continued

Color Image Stabilizer Cpd-6

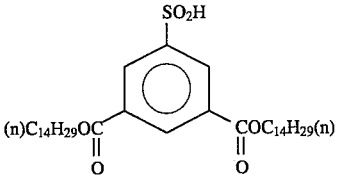

Color Image Stabilizer Cpd-7

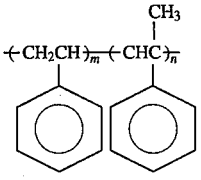

Number average MW: 600
m/n = 10/90

Color Image Stabilizer Cpd-8

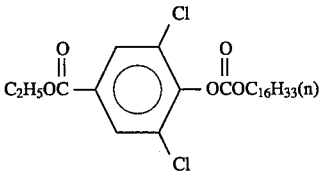

Color Image Stabilizer Cpd-9

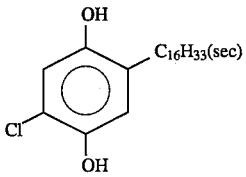

Color Image Stabilizer Cpd-10

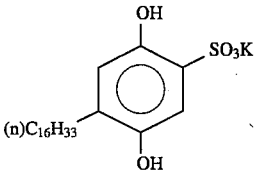

Surface Active Agent Cpd-11

A 7:3 (by weight) mixture of:

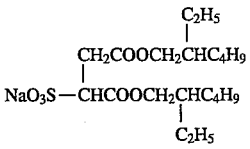

and

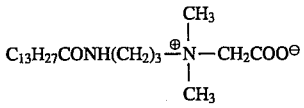

Antiseptic Cpd-12
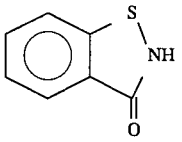
Antiseptic Cpd-13
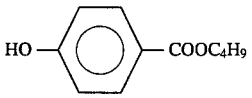
Antiseptic Cpd-14
A 1:1:1:1 mixture of a, b, c and d:
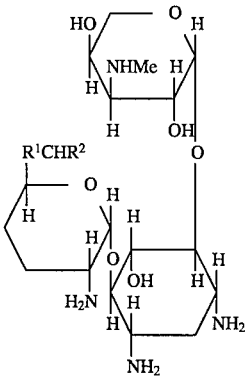
| | $R^1$ | $R^2$ |
|---|---|---|
| a | —Me | —NHMe |
| b | —Me | —$NH_2$ |
| c | —H | —$NH_2$ |
| d | —H | —NHMe |
Antiseptic Cpd-15
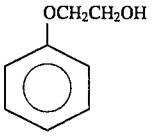
Ultraviolet Absorbent UV-1
A 1:3:4 (by weight) mixture of:
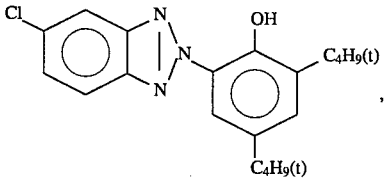
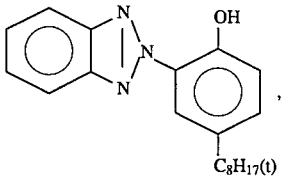
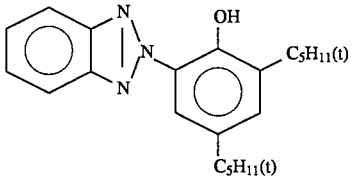
-continued
Ultraviolet Absorbent UV-2
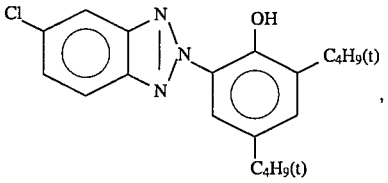
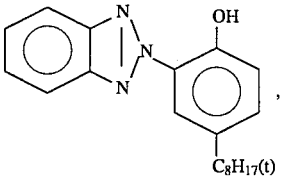
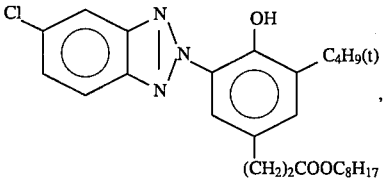
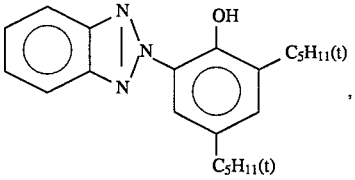
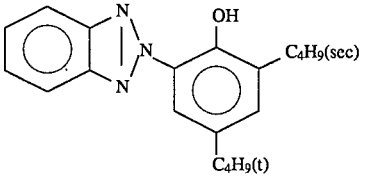
Ultraviolet Absorbent UV-3
A 1:3:2:1 (by weight) mixture of:
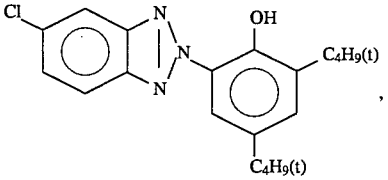
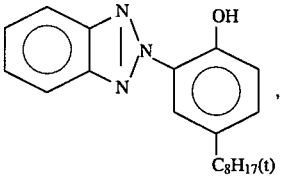
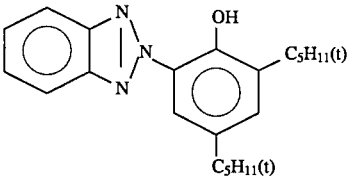

-continued

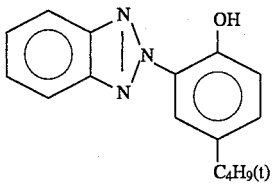

Solvent Solv-1

$C_8H_{17}CHCH(CH_2)_7COOC_8H_{17}$
$\backslash\ /$
O

Solvent Solv-2

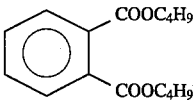

Solvent Solv-3

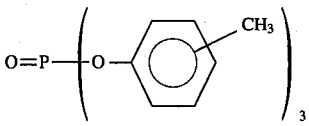

Solvent Solv-4

$O{=}P{-}(O{-}C_6H_{13}(n))_3$

Solvent Solv-5

$COOC_4H_{19}$
|
$(CH_2)_8$
|
$COOC_4H_{19}$

Solvent Solv-6

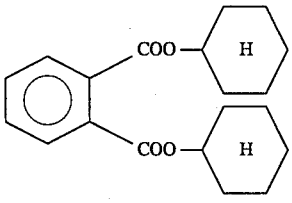

Solvent Solv-7

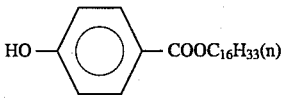

-continued

Solvent Solv-8

$COOC_8H_{17}$
|
$(CH_2)_8$
|
$COOC_8H_{17}$

Silver Halide Emulsions 104 to 106 were prepared in the same manner as Silver Halide Emulsions 101 to 103 used in Sample 101 except for changing the composition of the halogenated alkali aqueous solution added at the grain formation to sodium chloride alone (the molar amount was made equal to the total of potassium bromide and sodium chloride). In this preparation, potassium hexacyanoferrate(II) was added to the aqueous sodium chloride solution added second time at the grain formation in an amount of 5.6 mg for Emulsion 104, 7.8 mg for Emulsion 105 and 2.2 mg for Emulsion 106, the potassium hexachloroiridate(IV) was removed from the halogenated alkali aqueous solution used for grain formation, and a silver bromide fine grain emulsion (average grain size: 0.05 μm: containing potassium hexachloroiridate(III) in an amount of $1.8\times10^{-4}$ mol per mol of silver halide) was added before the initiation of chemical sensitization in an amount, in terms of silver bromide, of 0.4 mol for Emulsion 104, 0.5 mol for Emulsion 105 and 0.2 mol for Emulsion 106.

In the preparation of Emulsions 103 to 106, the amount of sulfur sensitizer and gold sensitizer was adjusted to render the chemical sensitization optimal.

Sample 102 was prepared in the same manner as Sample 101 except for changing Emulsion 101 to Emulsion 104, Emulsion 102 to Emulsion 105, and Emulsion 103 to Emulsion 106, to give the equal silver coated amount, respectively.

Samples 103 to 109 were prepared in the same manner as Sample 102 except for changing the silver coated amount and the oil-soluble component coated amount as shown in Table A. The coated amount of oil-soluble components was changed while keeping the proportion of respective components constant so as to cause no change in the compositional ratio of components.

Samples 110 to 114 were prepared in the same manner as Samples 105 to 109 except for changing the magenta coupler to Compound M-1.

TABLE A

| | Sample | | | | | | | | | | | | | |
|---|---|---|---|---|---|---|---|---|---|---|---|---|---|---|
| | 101 | 102 | 103 | 104 | 105 | 106 | 107 | 108 | 109 | 110 | 111 | 112 | 113 | 114 |
| First Layer | | | | | | | | | | | | | | |
| Silver halide emulsion (silver coated amount) | 103 (0.30) | 106 (0.30) | 106 (0.30) | 106 (0.30) | 106 (0.27) | 106 (0.27) | 106 (0.27) | 106 (0.24) | 106 (0.24) | 106 (0.27) | 106 (0.27) | 106 (0.27) | 106 (0.24) | 106 (0.24) |
| Gelatin coated amount | 1.33 | 1.33 | 1.33 | 1.33 | 1.33 | 1.33 | 1.33 | 1.33 | 1.33 | 1.33 | 1.33 | 1.33 | 1.33 | 1.33 |
| Oil-soluble component coated amount | 1.29 | 1.29 | 1.29 | 1.29 | 1.29 | 1.29 | 1.29 | 1.29 | 1.29 | 1.29 | 1.29 | 1.29 | 1.29 | 1.29 |
| Second Layer | | | | | | | | | | | | | | |
| Gelatin coated amount | 1.09 | 1.09 | 1.09 | 1.09 | 1.09 | 1.09 | 1.09 | 1.09 | 1.09 | 1.09 | 1.09 | 1.09 | 1.09 | 1.09 |

TABLE A-continued

| | Sample | | | | | | | | | | | | | |
|---|---|---|---|---|---|---|---|---|---|---|---|---|---|---|
| | 101 | 102 | 103 | 104 | 105 | 106 | 107 | 108 | 109 | 110 | 111 | 112 | 113 | 114 |
| Oil-soluble component coated amount | 0.80 | 0.80 | 0.70 | 0.60 | 0.080 | 0.70 | 0.60 | 0.80 | 0.60 | 0.80 | 0.70 | 0.60 | 0.80 | 0.60 |
| Third Layer | | | | | | | | | | | | | | |
| Silver halide Emulsion (silver coated amount) | 102 (0.15) | 105 (0.15) | 105 (0.15) | 105 (0.15) | 105 (0.13) | 105 (0.13) | 105 (0.13) | 105 (0.11) | 105 (0.11) | 105 (0.13) | 105 (0.13) | 105 (0.13) | 105 (0.11) | 105 (0.11) |
| Gelatin coated amount | 1.19 | 1.19 | 1.19 | 1.19 | 1.19 | 1.19 | 1.19 | 1.19 | 1.19 | 1.19 | 1.19 | 1.19 | 1.19 | 1.19 |
| Oil-soluble component coated amount | 1.02 | 1.02 | 0.81 | 0.69 | 1.02 | 0.81 | 0.69 | 1.02 | 0.69 | 1.02 | 0.81 | 0.69 | 1.02 | 0.69 |
| Magenta Coupler | ExM | ExM | ExM | ExM | ExM | ExM | ExM | ExM | ExM | M-1 | M-1 | M-1 | M-1 | M-1 |
| Fourth Layer | | | | | | | | | | | | | | |
| Gelatin coated amount | 0.77 | 0.77 | 0.77 | 0.77 | 0.77 | 0.77 | 0.77 | 0.77 | 0.77 | 0.77 | 0.77 | 0.77 | 0.77 | 0.77 |
| Oil-soluble component coated amount | 0.57 | 0.57 | 0.50 | 0.43 | 0.57 | 0.50 | 0.43 | 0.57 | 0.43 | 0.57 | 0.50 | 0.43 | 0.57 | 0.43 |
| Fifth Layer | | | | | | | | | | | | | | |
| Silver halide emulsion (silver coated amount) | 101 (0.25) | 104 (0.25) | 104 (0.25) | 104 (0.25) | 104 (0.20) | 104 (0.20) | 104 (0.20) | 104 (0.18) | 104 (0.18) | 104 (0.20) | 104 (0.20) | 104 (0.20) | 104 (0.18) | 104 (0.18) |
| Gelatin coated amount | 1.00 | 1.00 | 1.00 | 1.00 | 1.00 | 1.00 | 1.00 | 1.00 | 1.00 | 1.00 | 1.00 | 1.00 | 1.00 | 1.00 |
| Oil-soluble component coated amount | 1.25 | 1.25 | 1.00 | 0.86 | 1.25 | 1.00 | 0.86 | 1.25 | 0.86 | 1.25 | 1.00 | 0.86 | 1.25 | 0.86 |
| Sixth Layer | | | | | | | | | | | | | | |
| Gelatin coated amount | 0.64 | 0.64 | 0.64 | 0.64 | 0.64 | 0.64 | 0.64 | 0.64 | 0.64 | 0.64 | 0.64 | 0.64 | 0.64 | 0.64 |
| Oil-soluble component coated amount | 0.55 | 0.55 | 0.48 | 0.41 | 0.55 | 0.48 | 0.41 | 0.55 | 0.41 | 0.55 | 0.48 | 0.41 | 0.55 | 0.41 |
| Seventh Layer | | | | | | | | | | | | | | |
| Gelatin coated amount | 0.98 | 0.98 | 0.98 | 0.98 | 0.98 | 0.98 | 0.98 | 0.98 | 0.98 | 0.98 | 0.98 | 0.98 | 0.98 | 0.98 |
| Oil-soluble coated amount | 0.01 | 0.01 | 0.01 | 0.01 | 0.01 | 0.01 | 0.01 | 0.01 | 0.01 | 0.01 | 0.01 | 0.01 | 0.01 | 0.01 |
| Total silver coated amount | 0.70 | 0.70 | 0.70 | 0.70 | 0.60 | 0.60 | 0.60 | 0.53 | 0.53 | 0.60 | 0.60 | 0.60 | 0.53 | 0.53 |
| Oil-soluble coated amount in layers above the first layer | 4.20 | 4.20 | 3.50 | 3.00 | 4.20 | 3.50 | 3.00 | 4.20 | 3.00 | 4.20 | 3.50 | 3.00 | 4.20 | 3.00 |

Note:
Numerals for silver coated amount, gelatin coated amount and oil-soluble component coated amount all are in $g/m^2$.

Each of the light-sensitive materials obtained was exposed through an optical wedge for sensitometry at 250 CMS for 0.1 second using a sensitometer (Model FWH, manufactured by Fuji Photo Film Co., Ltd.; color temperature of light source: 3,200° K.) and then subjected to color development using the following processing solutions through processing steps described below. At this time, the color of exposure source was adjusted through a color filter such that the portion at a density of 0.8 of the wedgewise image obtained in a development time of 45 seconds became neutral gray. The development time was changed at an interval of 5 seconds from 20 seconds to 80 seconds. Each of processed samples was measured on the reflection densities of yellow, magenta and cyan and a so-called characteristics curve was obtained.

From the characteristics curve obtained as a result of measurement on densities of test pieces which were developed by varying the development time, the development time when the coloring of a yellow, magenta or cyan color image was saturated was determined and taken as the standard for evaluating the rapid processing property.

Then, each of processed test pieces obtained by a 45-second development was examined on the image fastness. Test pieces were irradiated by light using a xenon fademeter of 100,000 lux and the reflection density was measured after one day, 3 days, 5 days, 10 days, 15 days or 20 days to determine the change in density on the white background and the change in density of the dye image. The maximum among white background densities obtained by irradiation over 20 days was defined as the light irradiation stain value, and the reduction in image density after 20 day irradiation at the position where the density before light irradiation was 1.5 was defined as the light discoloration value.

Test pieces were separately stored under the conditions of 80° C. and 70% RH and measured on the reflection density after one day, 3 days, 5 days, 10 days, 15 days or 20 days to determine the change in density on the white background and the change in density of the dye image. The white background density after 20 day storage was defined as the wet-heat stain value and the reduction in image density after 20 day storage at the position where the density before storage was 1.5 was defined as the wet-heat discoloration value.

The results are shown in Table B.

-continued

| Processing Step | Temperature (°C.) | Processing Time (sec.) | Replenishing Amount* (ml) |
|---|---|---|---|
| Drying | 70–80 | 60 | |

*Replenishing amount was per 1 $m^2$ of light-sensitive material.
**In addition to 60 ml as shown above, 120 ml was flowed in from Rinsing 1 per 1 $m^2$ of light-sensitive material.
(The rinsing bath was in a countercurrent system from Rinsing 3 to Rinsing 1.)

| Color Developer | Tank Solution | Replenisher |
|---|---|---|
| Water | 800 ml | 800 ml |
| Ethylenediaminetetraacetic acid | 3.0 g | 3.0 g |
| Disodium 4,5-dihydroxy-benzene-1,3-disulfonate | 0.5 g | 0.5 g |
| Triethanolamine | 12.0 g | 12.0 g |
| Potassium chloride | 6.5 g | — |
| Potassium bromide | 0.03 g | — |
| Potassium carbonate | 27.0 g | 27.0 g |
| Fluorescent brightening agent (WHITEX4, produced by Sumitomo Chemical Co., Ltd.) | 1.0 g | 3.0 g |
| Sodium sulfite | 0.1 g | 0.1 g |
| Disodium-N,N'-bis(sulfnato-ethyl)hydroxylamine | 5.0 g | 10.0 g |
| Sodium triisopropyl-naphthalene (β) sulfonate | 0.1 g | 0.1 g |
| N-Ethyl-N-(β-methanesulfon-amidoethyl)-3-methyl-4-amino-aniline · ½ sulfate monohydrate | 5.0 g | 11.5 g |
| Water to make | 1,000 ml | 1,000 ml |
| pH (25° C.) | 10.00 | 11.00 |

TABLE B

| | Development Time for Saturation of Coloring | | | Xenon Light Irradiation | | Storage at 80° C., 70% RH | | |
|---|---|---|---|---|---|---|---|---|
| Sample | Yellow Density (sec) | Magenta Density (sec) | Cyan Density (sec) | Light Stain Value (B density) | Light Discoloration Value | Wet-heat Stain Value (G density) | Wet-heat discoloration Value | Remarks |
| 101 | 70 | 60 | 55 | 0.11 | 0.12 | 0.14 | 0.09 | Comparison |
| 102 | 46 | 33 | 37 | 0.11 | 0.12 | 0.15 | 0.10 | Comparison |
| 103 | 37 | 30 | 29 | 0.11 | 0.13 | 0.13 | 0.11 | Comparison |
| 104 | 31 | 25 | 24 | 0.12 | 0.19 | 0.12 | 0.12 | Comparison |
| 105 | 43 | 32 | 36 | 0.10 | 0.12 | 0.14 | 0.09 | Comparison |
| 106 | 35 | 28 | 27 | 0.11 | 0.14 | 0.13 | 0.12 | Comparison |
| 107 | 28 | 23 | 22 | 0.12 | 0.20 | 0.12 | 0.13 | Comparison |
| 108 | 42 | 32 | 35 | 0.10 | 0.12 | 0.15 | 0.10 | Comparison |
| 109 | 26 | 22 | 22 | 0.12 | 0.22 | 0.12 | 0.14 | Comparison |
| 110 | 43 | 32 | 35 | 0.11 | 0.10 | 0.12 | 0.07 | Comparison |
| 111 | 34 | 27 | 27 | 0.11 | 0.11 | 0.11 | 0.08 | Invention |
| 112 | 28 | 23 | 22 | 0.12 | 0.13 | 0.10 | 0.08 | Invention |
| 113 | 41 | 32 | 34 | 0.11 | 0.10 | 0.11 | 0.07 | Comparison |
| 114 | 26 | 22 | 22 | 0.12 | 0.13 | 0.10 | 0.08 | Invention |

| Processing Step | Temperature (°C.) | Processing Time (sec.) | Replenishing Amount* (ml) |
|---|---|---|---|
| Color development | 38.5 | 20–80 | 73 |
| Bleach-fixing | 30–35 | 45 | 60** |
| Rinsing 1 | 30–35 | 20 | — |
| Rinsing 2 | 30–35 | 20 | |
| Rinsing 3 | 30–35 | 20 | 360 |

| Bleach-fixing Solution | Tank Solution | Replenisher |
|---|---|---|
| Water | 600 ml | 150 ml |
| Ammonium thiosulfate (750 g/liter) | 93 ml | 230 ml |
| Ammonium sulfite | 40 g | 100 g |
| Ammonium ethylenediamine-tetraacetato iron(III) | 55 g | 135 g |

-continued

| Bleach-fixing Solution | Tank Solution | Replenisher |
|---|---|---|
| Ethylenediaminetetraacetic acid | 5 g | 12.5 g |
| Nitric acid (67%) | 30 g | 65 g |
| Water to make | 1,000 ml | 1,000 ml |
| pH (25° C.) | 5.80 | 5.60 |

| Rinsing Solution | |
|---|---|
| (The tank solution and the replenisher were same.) | |
| Sodium chlorinated isocyanurate | 0.02 g |
| Deionized water (electro-conductivity: 5 μs/cm or less) | 1,000 ml |
| pH | 6.50 |

Light-sensitive Material 101 using an emulsion having a silver bromide content of 40% took a long time for the saturation of coloring density and revealed to be not. suitable for rapid processing.

By using a high silver chloride emulsion (Light-sensitive Material 102), the time period for the saturation of coloring density could be reduced, which was, however, not sufficient. By reducing the silver coated amount, an aptitude for rapid processing was improved (Light-sensitive Material 102→105→108), which was, however, not sufficient, either. By reducing the oil-soluble component coated amount in layers above the first layer nearest to the support, the development rate was outstandingly increased.

However, in the light-sensitive materials using a comparative magenta coupler, the light fastness of the dye image formed was conspicuously worsened along with the reduction in the oil-soluble component coated amount in layers above the layer nearest to the support (Light-sensitive Material 102→103→104, Light-sensitive Material 105→106→107, and Light-sensitive Material 108→109). On the other hand, the light-sensitive layers using a magenta coupler of the present invention could keep the level where discoloration due to light irradiation was small and also the level where discoloration was reduced even when stored under a high temperature and a high humidity (Light-sensitive Material 110→111→112 and Light-sensitive Material 113→114).

Further, it is understood that when the use of the magenta coupler of the present invention was combined with the structure where the oil-soluble component coated amount in layers above the layer nearest to the support was reduced, not only the fastness was high on storage under a high temperature and a high humidity as an advantage of the coupler of the present invention but also the increase in stains could be outstandingly prevented.

EXAMPLE 2

Emulsified dispersions using the cyan coupler of the present invention were prepared as follows.

39.3 g of Cyan Coupler C-35, 1.4 g of Cyan Coupler ExC-2, 12.0 g of Color Image Stabilizer Cpd-1 and 20.0 g of Color Image Stabilizer Cpd-16 were dissolved in 40 g of Solvent Solv-2 and 95 ml of ethyl acetate, the resulting solution was mixed with 1,000 g of a 10% aqueous gelatin solution containing 38 ml of 10% sodium dodecylbenzenesulfonate, and the mixture was emulsified and dispersed under vigorous stirring in a homogenizer to prepare Emulsified Dispersion C1.

Emulsified Dispersion C2 was prepared in the same manner as Emulsified Dispersion C1 except that 39.3 g of Cyan Coupler C-35 was replaced by 27.0 g of Cyan Coupler C-44 and the coated amount of Color Image Stabilizer Cpd-1 was changed from 12.0 g to 3.6 g and that of Color Image Stabilizer Cpd-16 from 20.0 g to 10.0 g.

Sample 201 was prepared in the same manner as Light-sensitive Material 105 of Example 1 except for changing the composition of the fifth layer (red-sensitive emulsion layer) as follows.

Numerals indicate the coated amount (g/m$^2$). As for the silver halide emulsion, the coated amount is calculated in terms of silver.

| Fifth Layer (Red-sensitive Emulsion Layer) | |
|---|---|
| Silver Chlorobromide Emulsion 104 | 0.092 |
| Gelatin | 1.000 |
| Cyan Coupler C-35 | 0.275 |
| Cyan Coupler ExC-2 | 0.010 |
| Color Image Stabilizer Cpd-1 | 0.084 |
| Color Image Stabilizer Cpd-16 | 0.140 |
| Solvent Solv-2 | 0.280 |

Sample 202 was prepared by using Emulsified Dispersion C2 prepared above and changing the composition of the fifth layer (red-sensitive emulsion layer) as follows.

| Fifth Layer (Red-sensitive Emulsion Layer) | |
|---|---|
| Silver Chlorobromide Emulsion 104 | 0.092 |
| Gelatin | 1.000 |
| Cyan Coupler C-44 | 0.189 |
| Cyan Coupler ExC-2 | 0.010 |
| Color Image Stabilizer Cpd-1 | 0.084 |
| Color Image Stabilizer Cpd-16 | 0.140 |
| Solvent Solv-2 | 0.280 |

By changing the silver coated amount and the oil-soluble component coated amount in Samples 201 and 202 as shown in Table C, Samples 203 to 206 and Samples 213 to 216 were prepared. Further, by replacing the magenta coupler used in the third layer (green-sensitive emulsion layer) by Compound M-41 and changing the composition of the third layer as follow, Samples 207 and 208, and Samples 217 and 218 were prepared. Starting from these samples, the silver coated amount and the oil-soluble component coated amount were changed as shown in Table 3 to prepare Samples 209 to 212 and Samples 219 and 220. The oil-soluble component coated amount was changed while keeping the proportion of respective components constant so as to cause no change in the compositional ratio of components.

Using each sample, the gelatin coated amount was changed in proportion to the oil-soluble component coated amount and samples obtained here are affixed by character A in Table C.

TABLE C-1

| | Sample | | | | | | | | | | | | | |
|---|---|---|---|---|---|---|---|---|---|---|---|---|---|---|
| | 201 | 201-A | 202 | 202-A | 203 | 203-A | 204 | 204-A | 205 | 205-A | 206 | 206-A | 207 | 207-A |
| First Layer | | | | | | | | | | | | | | |
| Silver halide emulsion (silver coated amount) | 106 (0.27) | 106 (0.27) | 106 (0.27) | 106 (0.27) | 106 (0.27) | 106 (0.27) | 106 (0.27) | 106 (0.27) | 106 (0.27) | 106 (0.27) | 106 (0.27) | 106 (0.27) | 106 (0.27) | 106 (0.27) |
| Gelatin coated amount | 1.33 | 1.33 | 1.33 | 1.33 | 1.33 | 1.33 | 1.33 | 1.33 | 1.33 | 1.33 | 1.33 | 1.33 | 1.33 | 1.33 |
| Oil-soluble component coated amount | 1.29 | 1.29 | 1.29 | 1.29 | 1.29 | 1.29 | 1.29 | 1.29 | 1.29 | 1.29 | 1.29 | 1.29 | 1.29 | 1.29 |
| Second Layer | | | | | | | | | | | | | | |
| Gelatin coated amount | 1.09 | 1.09 | 1.09 | 1.09 | 1.09 | 0.95 | 1.09 | 0.95 | 1.09 | 0.82 | 1.09 | 0.82 | 1.09 | 1.09 |
| Oil-soluble component coated amount | 0.80 | 0.80 | 0.80 | 0.80 | 0.70 | 0.70 | 0.70 | 0.70 | 0.60 | 0.60 | 0.60 | 0.60 | 0.80 | 0.80 |
| Third Layer | | | | | | | | | | | | | | |
| Silver halide Emulsion (silver coated amount) | 105 (0.13) | 105 (0.13) | 105 (0.13) | 105 (0.13) | 105 (0.13) | 105 (0.13) | 105 (0.13) | 105 (0.13) | 105 (0.13) | 105 (0.13) | 105 (0.13) | 105 (0.13) | 105 (0.13) | 105 (0.13) |
| Gelatin coated amount | 1.19 | 1.19 | 1.19 | 1.19 | 1.19 | 0.95 | 1.19 | 0.95 | 1.19 | 0.81 | 1.19 | 0.81 | 1.19 | 0.89 |
| Oil-soluble component coated amount | 1.02 | 1.02 | 1.02 | 1.02 | 0.81 | 0.81 | 0.81 | 0.81 | 0.69 | 0.69 | 0.69 | 0.69 | 0.76 | 0.76 |
| Magenta Coupler | ExM | ExM | ExM | ExM | ExM | ExM | ExM | ExM | ExM | ExM | ExM | ExM | M-41 | M-41 |
| Fourth Layer | | | | | | | | | | | | | | |
| Gelatin coated amount | 0.77 | 0.77 | 0.77 | 0.77 | 0.77 | 0.68 | 0.77 | 0.68 | 0.77 | 0.58 | 0.77 | 0.58 | 0.77 | 0.77 |
| Oil-soluble component coated amount | 0.57 | 0.57 | 0.57 | 0.57 | 0.50 | 0.50 | 0.50 | 0.50 | 0.43 | 0.43 | 0.43 | 0.43 | 0.57 | 0.57 |
| Fifth Layer | | | | | | | | | | | | | | |
| Silver halide emulsion (silver coated amount) | 104 (0.09) | 104 (0.09) | 104 (0.09) | 104 (0.09) | 104 (0.09) | 104 (0.09) | 104 (0.09) | 104 (0.09) | 104 (0.09) | 104 (0.09) | 104 (0.09) | 104 (0.09) | 104 (0.09) | 104 (0.09) |
| Gelatin coated amount | 1.00 | 0.63 | 1.00 | 0.56 | 1.00 | 0.51 | 1.00 | 0.45 | 1.00 | 0.43 | 1.00 | 0.38 | 1.00 | 0.63 |
| Oil-soluble component coated amount | 0.79 | 0.79 | 0.70 | 0.70 | 0.63 | 0.63 | 0.56 | 0.56 | 0.54 | 0.54 | 0.48 | 0.48 | 0.79 | 0.79 |
| Emulsified Dispersion | C1 | C1 | C2 | C2 | C1 | C1 | C2 | C2 | C1 | C1 | C2 | C2 | C1 | C1 |
| Sixth Layer | | | | | | | | | | | | | | |
| Gelatin coated amount | 0.64 | 0.64 | 0.64 | 0.64 | 0.64 | 0.56 | 0.64 | 0.56 | 0.64 | 0.48 | 0.64 | 0.48 | 0.64 | 0.64 |
| Oil-soluble component coated amount | 0.55 | 0.55 | 0.55 | 0.55 | 0.48 | 0.48 | 0.48 | 0.48 | 0.41 | 0.41 | 0.41 | 0.41 | 0.55 | 0.55 |
| Seventh Layer | | | | | | | | | | | | | | |
| Gelatin coated amount | 0.98 | 0.98 | 0.98 | 0.98 | 0.98 | 0.98 | 0.98 | 0.98 | 0.98 | 0.98 | 0.98 | 0.98 | 0.98 | 0.98 |
| Oil-soluble coated amount | 0.01 | 0.01 | 0.01 | 0.01 | 0.01 | 0.01 | 0.01 | 0.01 | 0.01 | 0.01 | 0.01 | 0.01 | 0.01 | 0.01 |
| Total silver coated amount | 0.49 | 0.49 | 0.49 | 0.49 | 0.49 | 0.49 | 0.49 | 0.49 | 0.49 | 0.49 | 0.49 | 0.49 | 0.49 | 0.49 |

TABLE C-1-continued

| | Sample | | | | | | | | | | | | | |
|---|---|---|---|---|---|---|---|---|---|---|---|---|---|---|
| | 201 | 201-A | 202 | 202-A | 203 | 203-A | 204 | 204-A | 205 | 205-A | 206 | 206-A | 207 | 207-A |
| Total gelatin coated amount | 7.00 | 6.63 | 7.00 | 6.56 | 7.00 | 5.96 | 7.00 | 5.90 | 7.00 | 5.43 | 7.00 | 5.38 | 7.00 | 6.33 |
| Oil-soluble coated amount in layers above the first layer | 3.74 | 3.74 | 3.65 | 3.65 | 3.13 | 3.13 | 3.06 | 3.06 | 2.68 | 2.68 | 2.62 | 2.62 | 3.74 | 3.74 |

TABLE C-2

| | Sample | | | | | | | | | | | | | |
|---|---|---|---|---|---|---|---|---|---|---|---|---|---|---|
| | 208 | 208-A | 209 | 209-A | 210 | 210-A | 211 | 211-A | 212 | 212-A | 213 | 213-A | 214 | 214-A |
| First Layer | | | | | | | | | | | | | | |
| Silver halide emulsion | 106 | 106 | 106 | 106 | 106 | 106 | 106 | 106 | 106 | 106 | 106 | 106 | 106 | 106 |
| (silver coated amount) | (0.27) | (0.27) | (0.27) | (0.27) | (0.27) | (0.27) | (0.27) | (0.27) | (0.27) | (0.27) | (0.24) | (0.27) | (0.24) | (0.27) |
| Gelatin coated amount | 1.33 | 1.33 | 1.33 | 1.33 | 1.33 | 1.33 | 1.33 | 1.33 | 1.33 | 1.33 | 1.33 | 1.33 | 1.33 | 1.33 |
| Oil-soluble component coated amount | 1.29 | 1.29 | 1.29 | 1.29 | 1.29 | 1.29 | 1.29 | 1.29 | 1.29 | 1.29 | 1.29 | 1.29 | 1.29 | 1.29 |
| Second Layer | | | | | | | | | | | | | | |
| Gelatin coated amount | 1.09 | 1.09 | 1.09 | 0.95 | 1.09 | 0.95 | 1.09 | 0.82 | 1.09 | 0.82 | 1.09 | 1.09 | 1.09 | 1.09 |
| Oil-soluble component coated amount | 0.80 | 0.80 | 0.70 | 0.70 | 0.70 | 0.70 | 0.60 | 0.60 | 0.60 | 0.60 | 0.80 | 0.80 | 0.80 | 0.80 |
| Third Layer | | | | | | | | | | | | | | |
| Silver halide Emulsion | 105 | 105 | 105 | 105 | 105 | 105 | 105 | 105 | 105 | 105 | 105 | 105 | 105 | 105 |
| (silver coated amount) | (0.13) | (0.13) | (0.13) | (0.13) | (0.13) | (0.13) | (0.13) | (0.13) | (0.13) | (0.13) | (0.11) | (0.13) | (0.11) | (0.13) |
| Gelatin coated amount | 1.19 | 0.89 | 1.19 | 0.70 | 1.19 | 0.70 | 1.19 | 0.60 | 1.19 | 0.60 | 1.19 | 1.19 | 1.19 | 1.19 |
| Oil-soluble component coated amount | 0.76 | 0.76 | 0.60 | 0.60 | 0.60 | 0.60 | 0.51 | 0.51 | 0.51 | 0.51 | 1.02 | 1.02 | 1.02 | 1.02 |
| Magenta Coupler | M-41 | M-41 | M-41 | M-41 | M-41 | M-41 | M-41 | M-41 | M-41 | M-41 | ExM | ExM | ExM | ExM |
| Fourth Layer | | | | | | | | | | | | | | |
| Gelatin coated amount | 0.77 | 0.77 | 0.77 | 0.68 | 0.77 | 0.68 | 0.77 | 0.58 | 0.77 | 0.58 | 0.77 | 0.77 | 0.77 | 0.77 |
| Oil-soluble component coated amount | 0.57 | 0.57 | 0.50 | 0.50 | 0.50 | 0.50 | 0.43 | 0.43 | 0.43 | 0.43 | 0.57 | 0.57 | 0.57 | 0.57 |
| Fifth Layer | | | | | | | | | | | | | | |
| Silver halide emulsion | 104 | 104 | 104 | 104 | 104 | 104 | 104 | 104 | 104 | 104 | 104 | 104 | 104 | 104 |
| (silver coated amount) | (0.09) | (0.09) | (0.09) | (0.09) | (0.09) | (0.09) | (0.09) | (0.09) | (0.09) | (0.09) | (0.08) | (0.09) | (0.08) | (0.09) |
| Gelatin coated amount | 1.00 | 0.56 | 1.00 | 0.51 | 1.00 | 0.45 | 1.00 | 0.43 | 1.00 | 0.38 | 1.00 | 0.63 | 1.00 | 0.56 |
| Oil-soluble component coated amount | 0.70 | 0.70 | 0.63 | 0.63 | 0.56 | 0.56 | 0.54 | 0.54 | 0.48 | 0.48 | 0.79 | 0.79 | 0.7 | 0.70 |
| Emulsified Dispersion | C2 | C2 | C1 | C1 | C2 | C2 | C1 | C1 | C2 | C2 | C1 | C1 | C2 | C2 |

TABLE C-2-continued

| | Sample | | | | | | | | | | | | | |
|---|---|---|---|---|---|---|---|---|---|---|---|---|---|---|
| | 208 | 208-A | 209 | 209-A | 210 | 210-A | 211 | 211-A | 212 | 212-A | 213 | 213-A | 214 | 214-A |
| Sixth Layer | | | | | | | | | | | | | | |
| Gelatin coated amount | 0.64 | 0.64 | 0.64 | 0.56 | 0.64 | 0.56 | 0.64 | 0.48 | 0.64 | 0.48 | 0.64 | 0.64 | 0.64 | 0.64 |
| Oil-soluble component coated amount | 0.55 | 0.55 | 0.48 | 0.48 | 0.48 | 0.48 | 0.41 | 0.41 | 0.41 | 0.41 | 0.55 | 0.55 | 0.55 | 0.55 |
| Seventh Layer | | | | | | | | | | | | | | |
| Gelatin coated amount | 0.98 | 0.98 | 0.98 | 0.98 | 0.98 | 0.98 | 0.98 | 0.98 | 0.98 | 0.98 | 0.98 | 0.98 | 0.98 | 0.98 |
| Oil-soluble coated amount | 0.01 | 0.01 | 0.01 | 0.01 | 0.01 | 0.01 | 0.01 | 0.01 | 0.01 | 0.01 | 0.01 | 0.01 | 0.01 | 0.01 |
| Total silver coated amount | 0.49 | 0.49 | 0.49 | 0.49 | 0.49 | 0.49 | 0.49 | 0.49 | 0.49 | 0.49 | 0.43 | 0.43 | 0.43 | 0.43 |
| Total gelatin coated amount | 7.00 | 6.26 | 7.00 | 5.71 | 7.00 | 5.65 | 7.00 | 5.22 | 7.00 | 5.17 | 7.00 | 6.63 | 7.00 | 6.56 |
| Oil-soluble coated amount in layers above the first layer | 3.65 | 3.65 | 3.13 | 3.13 | 3.06 | 3.06 | 2.68 | 2.68 | 2.62 | 2.62 | 3.74 | 3.74 | 3.65 | 3.65 |

TABLE C-3

| | Sample | | | | | | | | | | | |
|---|---|---|---|---|---|---|---|---|---|---|---|---|
| | 215 | 215-A | 216 | 216-A | 217 | 217-A | 218 | 218-A | 219 | 219-A | 220 | 220-A |
| First Layer | | | | | | | | | | | | |
| Silver halide emulsion (silver coated amount) | 106 (0.24) | 106 (0.24) | 106 (0.24) | 106 (0.24) | 106 (0.24) | 106 (0.24) | 106 (0.24) | 106 (0.24) | 106 (0.24) | 106 (0.24) | 106 (0.24) | 106 (0.24) |
| Gelatin coated amount | 1.33 | 1.33 | 1.33 | 1.33 | 1.33 | 1.33 | 1.33 | 1.33 | 1.33 | 1.33 | 1.33 | 1.33 |
| Oil-soluble component coated amount | 1.29 | 1.29 | 1.29 | 1.29 | 1.29 | 1.29 | 1.29 | 1.29 | 1.29 | 1.29 | 1.29 | 1.29 |
| Second Layer | | | | | | | | | | | | |
| Gelatin coated amount | 1.09 | 0.82 | 1.09 | 0.82 | 1.09 | 1.09 | 1.09 | 1.09 | 1.09 | 0.82 | 1.09 | 0.82 |
| Oil-soluble component coated amount | 0.60 | 0.60 | 0.60 | 0.60 | 0.80 | 0.80 | 0.80 | 0.80 | 0.60 | 0.60 | 0.60 | 0.60 |
| Third Layer | | | | | | | | | | | | |
| Silver halide Emulsion (silver coated amount) | 105 (0.11) | 105 (0.11) | 105 (0.11) | 105 (0.11) | 105 (0.11) | 105 (0.11) | 105 (0.11) | 105 (0.11) | 105 (0.11) | 105 (0.11) | 105 (0.11) | 105 (0.11) |
| Gelatin coated amount | 1.19 | 0.81 | 1.19 | 0.81 | 1.19 | 0.89 | 1.19 | 0.89 | 1.19 | 0.60 | 1.19 | 0.60 |
| Oil-soluble component coated amount | 0.69 | 0.69 | 0.69 | 0.69 | 0.76 | 0.76 | 0.76 | 0.76 | 0.51 | 0.51 | 0.51 | 0.51 |
| Magenta Coupler | ExM | ExM | ExM | ExM | M-41 | M-41 | M-41 | M-41 | M-41 | M-41 | M-41 | M-41 |
| Fourth Layer | | | | | | | | | | | | |
| Gelatin coated amount | 0.77 | 0.58 | 0.77 | 0.58 | 0.77 | 0.77 | 0.77 | 0.77 | 0.77 | 0.58 | 0.77 | 0.58 |
| Oil-soluble component coated amount | 0.43 | 0.43 | 0.43 | 0.43 | 0.57 | 0.57 | 0.57 | 0.57 | 0.43 | 0.43 | 0.43 | 0.43 |
| Fifth Layer | | | | | | | | | | | | |
| Silver halide emulsion (silver coated amount) | 104 (0.08) | 104 (0.08) | 104 (0.08) | 104 (0.08) | 104 (0.08) | 104 (0.08) | 104 (0.08) | 104 (0.08) | 104 (0.08) | 104 (0.08) | 104 (0.08) | 104 (0.08) |
| Gelatin coated amount | 1.00 | 0.43 | 1.00 | 0.38 | 1.00 | 0.63 | 1.00 | 0.56 | 1.00 | 0.43 | 1.00 | 0.38 |
| Oil-soluble component coated amount | 0.54 | 0.54 | 0.48 | 0.48 | 0.79 | 0.79 | 0.70 | 0.70 | 0.54 | 0.54 | 0.48 | 0.48 |
| Emulsified Dispersion | C1 | C1 | C2 | C2 | C1 | C1 | C2 | C2 | C1 | C1 | C2 | C2 |
| Sixth Layer | | | | | | | | | | | | |
| Gelatin coated amount | 0.64 | 0.48 | 0.64 | 0.48 | 0.64 | 0.64 | 0.64 | 0.64 | 0.64 | 0.48 | 0.64 | 0.48 |
| Oil-soluble component coated amount | 0.41 | 0.41 | 0.41 | 0.41 | 0.55 | 0.55 | 0.55 | 0.55 | 0.41 | 0.41 | 0.41 | 0.41 |
| Seventh Layer | | | | | | | | | | | | |

TABLE C-3-continued

| | Sample | | | | | | | | | | | |
|---|---|---|---|---|---|---|---|---|---|---|---|---|
| | 215 | 215-A | 216 | 216-A | 217 | 217-A | 218 | 218-A | 219 | 219-A | 220 | 220-A |
| Gelatin coated amount | 0.98 | 0.98 | 0.98 | 0.98 | 0.98 | 0.98 | 0.98 | 0.98 | 0.98 | 0.98 | 0.98 | 0.98 |
| Oil-soluble coated amount | 0.01 | 0.01 | 0.01 | 0.01 | 0.01 | 0.01 | 0.01 | 0.01 | 0.01 | 0.01 | 0.01 | 0.01 |
| Total silver coated amount | 0.43 | 0.43 | 0.43 | 0.43 | 0.43 | 0.43 | 0.43 | 0.43 | 0.43 | 0.43 | 0.43 | 0.43 |
| Total gelatin coated amount | 7.00 | 5.43 | 7.00 | 5.38 | 7.00 | 6.33 | 7.00 | 6.26 | 7.00 | 5.22 | 7.00 | 5.17 |
| Oil-soluble coated amount in layers above the first layer | 2.68 | 2.68 | 2.62 | 2.62 | 3.74 | 3.74 | 3.65 | 3.65 | 2.68 | 2.68 | 2.62 | 2.62 |

Note:
Numerals for silver coated amount, gelatin coated amount and oil-soluble component coated amount all are in g/m$^2$.

| Third Layer (Green-sensitive Emulsion Layer) | |
|---|---|
| Silver Chlorobromide Emulsion 105 | 0.130 |
| Gelatin | 1.190 |
| Magenta Coupler M-41 | 0.174 |
| Ultraviolet Absorbent UV-1 | 0.150 |
| Color Image Stabilizer Cpd-2 | 0.013 |
| Color Image Stabilizer Cpd-5 | 0.013 |
| Color Image Stabilizer Cpd-6 | 0.013 |
| Color Image Stabilizer Cpd-7 | 0.100 |
| Color Image Stabilizer Cpd-8 | 0.013 |
| Solvent Solv-4 | 0.190 |
| Solvent Solv-5 | 0.095 |

Cyan Coupler ExC-2

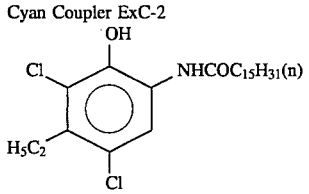

Color Image Stabilizer Cpd-16

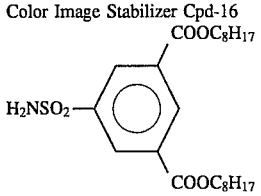

The thus-obtained 40 kinds of multilayered color photographic light-sensitive materials were examined on their aptitude for rapid processing and color density in the same manner as in Example 1. The light discoloration test was also. conducted in the same manner as in Example 1. The results obtained are shown in Table D.

TABLE D

| | Development Time for Color Saturation | | | | | | Xenon Light Irradiation | | |
|---|---|---|---|---|---|---|---|---|---|
| | Yellow Density | Magenta Density | Cyan Density | Maximum Color Density | | | Light Stain Value | Light Discoloration | |
| Sample | (sec) | (sec) | (sec) | Yellow | Magenta | Cyan | (B density) | Value | Remarks |
| 201 | 42 | 32 | 35 | 2.24 | 2.52 | 2.67 | 0.11 | 0.13 | Comparison |
| 201A | 39 | 30 | 33 | 2.26 | 2.53 | 2.67 | 0.10 | 0.14 | Comparison |
| 202 | 41 | 31 | 34 | 2.27 | 2.53 | 2.63 | 0.11 | 0.14 | Comparison |
| 202A | 38 | 30 | 32 | 2.28 | 2.54 | 2.64 | 0.10 | 0.15 | Comparison |
| 203 | 34 | 27 | 27 | 2.27 | 2.29 | 2.46 | 0.12 | 0.16 | Comparison |
| 203A | 33 | 26 | 26 | 2.30 | 2.30 | 2.47 | 0.11 | 0.18 | Comparison |
| 204 | 32 | 25 | 25 | 2.28 | 2.31 | 2.42 | 0.12 | 0.17 | Comparison |
| 204A | 30 | 24 | 24 | 2.31 | 2.31 | 2.43 | 0.11 | 0.19 | Comparison |
| 205 | 25 | 22 | 21 | 2.31 | 2.18 | 2.35 | 0.12 | 0.23 | Comparison |
| 205A | 23 | 19 | 18 | 2.33 | 2.19 | 2.36 | 0.11 | 0.25 | Comparison |
| 206 | 24 | 21 | 20 | 2.33 | 2.19 | 2.32 | 0.12 | 0.25 | Comparison |
| 206A | 22 | 18 | 17 | 2.35 | 2.20 | 2.33 | 0.11 | 0.27 | Comparison |
| 207 | 41 | 31 | 34 | 2.28 | 2.53 | 2.68 | 0.11 | 0.10 | Comparison |
| 207A | 38 | 29 | 32 | 2.29 | 2.53 | 2.67 | 0.10 | 0.11 | Comparison |
| 208 | 40 | 30 | 33 | 2.31 | 2.54 | 2.64 | 0,11 | 0.11 | Comparison |
| 208A | 37 | 29 | 31 | 2.30 | 2.55 | 2.63 | 0.10 | 0.11 | Comparison |
| 209 | 33 | 25 | 25 | 2.32 | 2.30 | 2.45 | 0.12 | 0.12 | Invention |
| 209A | 32 | 24 | 24 | 2.34 | 2.31 | 2.46 | 0.11 | 0.12 | Invention |
| 210 | 30 | 23 | 23 | 2.32 | 2.32 | 2.43 | 0.12 | 0.11 | Invention |
| 210A | 28 | 21 | 21 | 2.35 | 2.33 | 2.44 | 0.11 | 0.12 | Invention |
| 211 | 23 | 20 | 19 | 2.35 | 2.20 | 2.35 | 0.12 | 0.12 | Invention |
| 211A | 21 | 18 | 17 | 2.37 | 2.21 | 2.37 | 0.11 | 0.13 | Invention |
| 212 | 21 | 20 | 18 | 2.38 | 2.22 | 2.32 | 0.12 | 0.13 | Invention |

TABLE D-continued

| Sample | Development Time for Color Saturation: Yellow Density (sec) | Magenta Density (sec) | Cyan Density (sec) | Maximum Color Density: Yellow | Magenta | Cyan | Xenon Light Irradiation: Light Stain Value (B density) | Light Discoloration Value | Remarks |
|---|---|---|---|---|---|---|---|---|---|
| 212A | 20 | 17 | 16 | 2.39 | 2.23 | 2.34 | 0.11 | 0.13 | Invention |
| 213 | 40 | 30 | 31 | 2.09 | 2.40 | 2.45 | 0.11 | 0.15 | Comparison |
| 213A | 38 | 27 | 29 | 2.11 | 2.41 | 2.45 | 0.10 | 0.16 | Comparison |
| 214 | 39 | 29 | 30 | 2.12 | 2.41 | 2.42 | 0.11 | 0.16 | Comparison |
| 214A | 37 | 27 | 29 | 2.16 | 2.43 | 2.41 | 0.10 | 0.17 | Comparison |
| 215 | 23 | 19 | 19 | 2.15 | 2.07 | 2.11 | 0.12 | 0.25 | Comparison |
| 215A | 20 | 17 | 18 | 2.18 | 2.08 | 2.11 | 0.11 | 0.27 | Comparison |
| 216 | 22 | 18 | 18 | 2.17 | 2.09 | 2.08 | 0.12 | 0.26 | Comparison |
| 216A | 19 | 17 | 18 | 2.18 | 2.11 | 2.09 | 0.11 | 0.27 | Comparison |
| 217 | 39 | 29 | 32 | 2.11 | 2.42 | 2.44 | 0.11 | 0.11 | Comparison |
| 217A | 37 | 26 | 30 | 2.13 | 2.43 | 2.43 | 0.10 | 0.12 | Comparison |
| 218 | 38 | 28 | 30 | 2.14 | 2.43 | 2.43 | 0.11 | 0.12 | Comparison |
| 218A | 37 | 26 | 30 | 2.17 | 2.4 4 | 2.42 | 0.10 | 0.13 | Comparison |
| 219 | 22 | 18 | 19 | 2.18 | 2.11 | 2.12 | 0.12 | 0.15 | Invention |
| 219A | 19 | 17 | 18 | 2.21 | 2.12 | 2.11 | 0.11 | 0.15 | Invention |
| 220 | 21 | 18 | 19 | 2.21 | 2.14 | 2.10 | 0.11 | 0.16 | Invention |
| 220A | 18 | 17 | 18 | 2.22 | 2.13 | 2.09 | 0.11 | 0.16 | Invention |

On comparison between the results obtained here and those in Example 1, it is clear that the color density could be sufficiently high owing to the use of the cyan coupler of the present invention in combination even when the oil-soluble component coated amount was reduced and the development rate was increased.

EXAMPLE 3

By using samples prepared in Example 2, a shorter processing was conducted.

| Processing Step | Temperature (°C.) | Time (sec.) | Replenishing Amount* (ml) | Tank Volume (l) |
|---|---|---|---|---|
| Color development | 45 | 15 | 35 | 2.0 |
| Bleach-fixing | 40 | 15 | 35 | 2.0 |
| Rinsing (1) | 40 | 5 | — | 1.0 |
| Rinsing (2) | 40 | 5 | — | 1.0 |
| Rinsing (3) | 40 | 5 | — | 1.0 |
| Rinsing (4) | 40 | 5 | — | 1.0 |
| Rinsing (5) | 40 | 10 | — | 1.0 |
| Drying | 60–80 | 20 | 60 | |

*Replenishing amount was per $m^2$ of the light-sensitive material
A five-tank countercurrent system from Rinsing (5) to Rinsing (1) was employed.

In the above processing, water in Rinsing (4) was compressed to a reverse osmosis membrane, water permeated therethrough was fed to Rinsing (5) and concentrated water impermeable to the reverse osmosis membrane was returned to Rinsing (4). In order to reduce the crossover time between respective rinsings, blades were provided between tanks and the solution was passed therethrough.

The processing solutions used in this processing each had the following composition.

| Color Developer | Tank Solution | Replenisher |
|---|---|---|
| Water | 700 ml | 700 ml |
| Ethylenediaminetetraacetic acid | 1.5 g | 3.75 g |
| Disodium 4,5-dihydroxy-benzene-4,6-disulfonate | 0.25 g | 0.7 g |
| Triethanolamine | 5.8 g | 14.5 g |
| Potassium chloride | 10.0 g | — |
| Potassium bromide | 0.03 g | — |
| Potassium carbonate | 18.0 g | 24.0 g |
| Fluorescent brightening agent (UVX) | 1.5 g | 4.5 g |
| Sodium sulfite | 0.1 g | 0.1 g |
| Disodium-N,N'-bis(sulfnato-ethyl)hydroxylamine | 14.8 g | 29.6 g |
| 4-Amino-3-methyl-N-ethyl-N-(4-hydroxybutyl)aniline · 2-p-toluenesulfonic acid | 9.8 g | 29.3 g |
| Water to make | 1,000 ml | 1,000 ml |
| pH (25° C.) | 10.05 | 11.60 |

Bleach-fixing Solution

The replenisher was prepared by separating the component into two part solutions.

| First Replenisher: | |
|---|---|
| Water | 150 ml |
| Ethylenebisguanidine nitrate | 30 g |
| Ammonium sulfite monohydrate | 190 g |
| Ethylenediaminetetraacetic acid | 7.5 g |
| Ammonium bromide | 30 g |
| Ammonium thiosulfate (700 g/l) | 340 ml |
| Acetic acid (50%) | 250 ml |
| Water to make | 1,000 ml |
| pH (25° C.) | 4.8 |
| **Second Replenisher:** | |
| Water | 140 ml |

-continued

| | |
|---|---|
| Ethylenediaminetetraacetic acid | 11.0 g |
| Ammonium ethylenediaminetetraacetato iron(III) | 715 g |
| Acetic acid (50%) | 100 ml |
| Water to make | 1,000 ml |
| pH (25° C.) | 2.0 |

| Tank Solution of Bleach-fixing Solution | |
|---|---|
| First Replenisher | 300 ml |
| Second Replenisher | 200 ml |
| Water to make | 1,000 ml |
| pH (25° C.) | 5.0 |

| Replenishing Amount of Bleach-fixing Solution | |
|---|---|
| First Replenisher | 21 ml |
| Second Replenisher | 14 ml |
| (35 ml in total per $m^2$) | |

From the results obtained in this example, it is also confirmed as in Examples 1 and 2 that the light-sensitive material according to the present invention is suitable for rapid processing. More specifically, the light-sensitive materials according to the present invention showed high color-forming property even through a very short processing as 15-second development and the sample prints formed therefrom had excellent fastness of the dye image to light or humidity even when the water washing time was reduced.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having provided thereon photographic constituent layers comprising at least a yellow dye-forming silver halide emulsion layer, a magenta dye-forming silver halide emulsion layer and a cyan dye-forming silver halide emulsion layer, wherein the total silver coverage in said silver halide emulsion layers is 0.6 $g/m^2$ or less, said magenta dye-forming silver halide emulsion layer contains silver halide emulsion grains comprising silver chloride or silver chlorobromide substantially free of silver iodide having a silver chloride content of 90 mol % or more and at least one magenta dye-forming coupler represented by formula (M-I), and the total coating amount of oil-soluble components contained in photographic constituent layers above the silver halide emulsion layer nearest to the support is 3.5 $g/m^2$ or less:

(M-I)

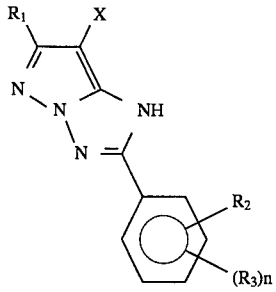

wherein $R_1$ represents a group represented by formula (Q-1), (Q-2) or (Q-3), $R_2$ and $R_3$ each represents a substituent, n represents from 0 to 4 and when n is 2 or greater, a plurality of $R_3$ groups may be the same or different, and X represents a group capable of being released on coupling reaction with an oxidation product of a developing agent;

$$—C(R_4)(R_5)—R_6 \quad \text{(Q-1)}$$

wherein $R_4$ represents an alkyl group, a cycloalkyl group, an aryl group or a heterocyclic group, $R_5$ and $R_6$ each represents a substituent, and $R_4$, $R_5$ and $R_6$ may be combined with each other to form a 5-, 6- or 7-membered monocyclic or condensed ring;

$$—CH(R_7)—R_8 \quad \text{(Q-2)}$$

wherein $R_7$ represents an alkyl group, a cycloalkyl group, an aryl group or a heterocyclic group, R8 represents a substituent, and $R_7$ and $R_8$ may be combined with each other to form a 5-, 6- or 7-membered monocyclic or condensed ring;

(Q-3)

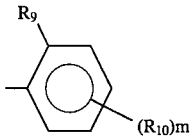

wherein $R_9$ and $R_{10}$ each represents a substituent and m represents from 0 to 4 and when m is 2 or greater, a plurality of $R_{10}$ groups may be the same or different.

2. A silver halide color photographic light-sensitive material as claimed in claim 1, wherein said magenta dye-forming coupler is represented by formula (M-1) where $R_1$ is a substituent represented by formula (Q-1) or (Q-3):

$$—C(R_4)(R_5)—R_6 \quad \text{(Q-1)}$$

wherein $R_4$ represents an alkyl group, a cycloalkyl group, an aryl group or a heterocyclic group, $R_5$ and $R_6$ each represents a substituent, and $R_4$, $R_5$ and $R_6$ may be combined with each other to form a 5-, 6- or 7-membered monocyclic or condensed ring;

(Q-3)

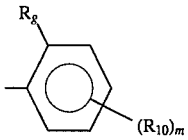

wherein $R_9$ and $R_{10}$ each represents a substituent and m represents from 0 to 4 and when m is 2 or greater, a plurality of $R_{10}$ groups may be the same or different.

3. A silver halide color photographic light-sensitive material as claimed in claim 1, wherein said magenta dye-forming coupler is represented by formula (M-II):

(M-II)

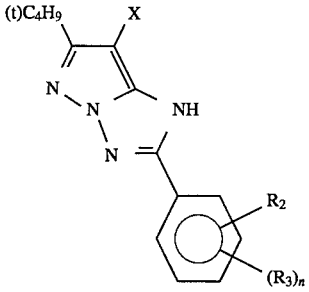

wherein $R_2$, $R_3$, n and X have the same meaning as $R_2$, $R_3$, n and X in formula (M-I), respectively.

4. A silver halide color photographic light-sensitive material as claimed in claim 1, wherein at least one layer of said cyan dye-forming layer contains at least one cyan dye-forming coupler represented by formula (C-I):

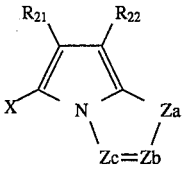

(C-I)

wherein Za represents —NH— or —CH($R_{23}$)—, Zb and Zc each represents —C($R_{24}$)= or —N=, $R_{21}$, $R_{22}$ and $R_{23}$ each represents an electron-attractive group having a Hammett's substituent constant σp of 0.20 or more, with the proviso that the sum of σp values of $R_{21}$ and $R_{22}$ is 0.65 or more, $R_{24}$ represents a hydrogen atom or a substituent and when two or more of $R_{24}$ groups are present, they may be the same or different, X represents a group capable of being released on coupling reaction with an oxidation product of a developing agent, and $R_{21}$, $R_{22}$, $R_{23}$, $R_{24}$ or X may be a divalent group and combined with a dimer or greater polymer or a polymer chain to form a polymer.

5. A silver halide color photogrphic material as claimed in claim 4, wherein the cyan coupler of formula (C-I) is represented by formula (IIa), (IIIa), (IVa), (Va) (VIa), (VIIa) or (VIIIa):

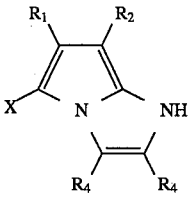

(IIa)

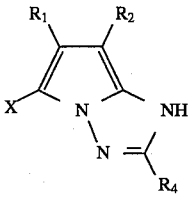

(IIIa)

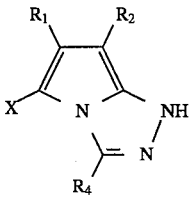

(IVa)

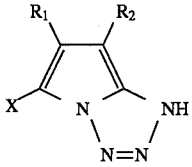

(Va)

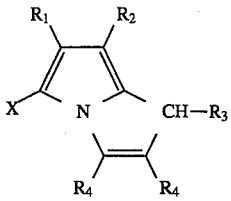

(VIa)

-continued

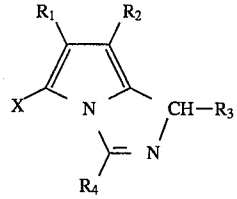

(VIIa)

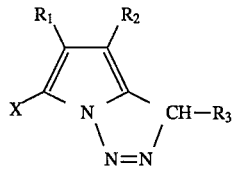

(VIIIa)

wherein $R_{21}$, $R_{22}$, $R_{23}$, $R_{24}$ and X each has the same meaning as in formula (C-I).

6. A silver halide color photographic light-sensitive material as claimed in claim 1, wherein the oil-soluble components comprise a dispersion of photographic organic additives dissolved in water-insoluble high boiling point organic solvents contained in hydrophilic colloid layers.

7. A silver halide color photographic light-sensitive material as claimed in claim 1, wherein the magenta coupler represented by formula (M-I) is used in the silver halide photographic material in an amount of from 0.01 to 10 mmol/$m^2$.

8. A silver halide color photographic light-sensitive material as claimed in claim 4, wherein the cyan dye-forming coupler represented by formula (C-I) is used in an amount of not less than 0.01 mmol/$m^2$ in the silver halide photographic material.

9. A silver halide color photographic light-sensitive material as claimed in claim 1, wherein the total coated amount of oil-soluble components contained in the photographic constituent layers is 3.4 g/$m^2$ or less.

10. A silver halide color photographic light-sensitive material as claimed in claim 1, wherein said cyan dye-forming silver halide emulsion layer contains at least one cyan dye-forming coupler represented by formula (IIIa):

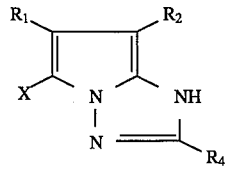

(IIIa)

wherein $R_1$ is a cyano group and $R_2$ is a fluorinated alkyl group or an alkoxycarbonyl group, $R_4$ represents a hydrogen atom or a substituent, and X represents a group capable of being released on coupling reaction with an oxidation product of a developing agent.

* * * * *